US012471676B2

(12) United States Patent
Case et al.

(10) Patent No.: US 12,471,676 B2
(45) Date of Patent: Nov. 18, 2025

(54) FOOTWEAR UPPERS INCLUDING BLADDERS, ARTICLES OF FOOTWEAR INCLUDING BLADDERS IN THE UPPER, AND METHODS OF FORMING SUCH UPPERS AND/OR ARTICLES OF FOOTWEAR

(71) Applicant: NIKE, Inc., Beaverton, OR (US)

(72) Inventors: Patrick R. Case, Portland, OR (US); Yoon Jeong Choi, Portland, OR (US); John S. MacGilbert, Tigard, OR (US); James Molyneux, Portland, OR (US); Colin Runkle, Portland, OR (US); Bryan K. Youngs, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 179 days.

(21) Appl. No.: 17/969,489

(22) Filed: Oct. 19, 2022

(65) Prior Publication Data

US 2023/0146597 A1 May 11, 2023

Related U.S. Application Data

(60) Provisional application No. 63/277,916, filed on Nov. 10, 2021, provisional application No. 63/277,932, filed on Nov. 10, 2021.

(51) Int. Cl.
*A43B 23/02* (2006.01)

(52) U.S. Cl.
CPC ..... *A43B 23/028* (2013.01); *A43B 23/0205* (2013.01); *A43B 23/025* (2013.01); (Continued)

(58) Field of Classification Search
CPC ..... A43B 23/029; A43B 23/0285; B32B 5/24
See application file for complete search history.

(56) References Cited

U.S. PATENT DOCUMENTS 4,217,705 A 8/1980 Donzis
5,343,638 A * 9/1994 Legassie ..... A43B 23/026 36/71

(Continued)

FOREIGN PATENT DOCUMENTS

EP 2441338 A2 4/2012
EP 2510820 A1 10/2012

(Continued)

OTHER PUBLICATIONS

What's Inside the Nike Air VaporMax?, The Sneaker Factory, thesneakerfactor.com, Sep. 24, 2020, https://web.archive.org/web/20200924080508/https://www.sneakerfactor.net/2019/10/whats-inside-the-nike-air-vapormax/.

(Continued)

*Primary Examiner* — Khoa D Huynh
*Assistant Examiner* — Grady Alexander Nunnery
(74) *Attorney, Agent, or Firm* — Banner & Witcoff, Ltd.

(57) ABSTRACT

Footwear upper components include a fabric element and a bladder component that defines a sealed interior chamber. The bladder component includes: (a) a first major surface engaged with the fabric element, wherein this first major surface defines at least part of a first perimeter seam surface and at least part of a first surface of the sealed interior chamber, (b) a second major surface opposite the first major surface, wherein this second major surface defines at least part of a second perimeter seam surface opposite the first perimeter seam surface and at least part of a second surface of the sealed interior chamber opposite the sealed interior chamber's first surface, and (c) and a fluid chamber between the first and second major surfaces. The first major surface (and optionally the second major surface) may include texturing, e.g., texturing corresponding to texture present on a surface of the fabric element.

20 Claims, 28 Drawing Sheets

(52) U.S. Cl.
CPC ..... *A43B 23/0255* (2013.01); *A43B 23/026* (2013.01); *A43B 23/029* (2013.01)

(56) References Cited

U.S. PATENT DOCUMENTS

| | | | | |
|---|---|---|---|---|
| 5,543,194 | A | 8/1996 | Rudy | |
| 5,713,141 | A | 2/1998 | Mitchell et al. | |
| 5,878,510 | A * | 3/1999 | Schoesler | A43B 17/026 36/43 |
| 6,910,288 | B2 | 6/2005 | Dua | |
| 7,086,179 | B2 | 8/2006 | Dojan et al. | |
| 7,622,014 | B2 | 11/2009 | Millette et al. | |
| 9,737,110 | B2 | 8/2017 | Davis et al. | |
| 10,327,506 | B2 | 6/2019 | Hensley et al. | |
| 10,555,580 | B2 | 2/2020 | Peyton | |
| 10,779,616 | B2 | 9/2020 | Becker et al. | |
| 10,960,630 | B2 | 3/2021 | Schneider et al. | |
| 11,564,449 | B2 | 1/2023 | Braithwaite et al. | |
| 11,583,034 | B2 | 2/2023 | Braithwaite et al. | |
| 2003/0121181 | A1 * | 7/2003 | Chang | A43D 11/003 36/77 R |
| 2004/0261202 | A1 | 12/2004 | Baek | |
| 2005/0016021 | A1 | 1/2005 | Marvin et al. | |
| 2005/0167029 | A1 | 8/2005 | Rapaport et al. | |
| 2012/0084999 | A1 | 4/2012 | Davis et al. | |
| 2012/0167413 | A1 | 7/2012 | Marvin et al. | |
| 2012/0279260 | A1 | 11/2012 | Dua et al. | |
| 2013/0283640 | A1 | 10/2013 | Elder et al. | |
| 2016/0037862 | A1 | 2/2016 | Beye et al. | |
| 2016/0353834 | A1 * | 12/2016 | Luedecke | A43B 13/122 |
| 2017/0196303 | A1 | 7/2017 | Davis et al. | |
| 2019/0082786 | A1 | 3/2019 | Cortez et al. | |
| 2019/0110557 | A1 | 4/2019 | Hobson et al. | |
| 2019/0208862 | A1 | 7/2019 | Poegl et al. | |
| 2019/0307207 | A1 | 10/2019 | Braithwaite et al. | |
| 2019/0328075 | A1 | 10/2019 | Poulsen et al. | |
| 2021/0244128 | A1 | 8/2021 | Costa et al. | |
| 2022/0015936 | A1 * | 1/2022 | Franco | A61F 5/0111 |
| 2023/0141164 | A1 | 5/2023 | Case et al. | |
| 2023/0141325 | A1 | 5/2023 | Case et al. | |
| 2023/0147306 | A1 | 5/2023 | Case et al. | |

FOREIGN PATENT DOCUMENTS

| | | | |
|---|---|---|---|
| WO | 0150901 | A1 | 7/2001 |
| WO | 2008124163 | A1 | 10/2008 |
| WO | 2021242787 | A1 | 12/2021 |
| WO | 2021247325 | A2 | 12/2021 |
| WO | 2022094183 | A1 | 5/2022 |

OTHER PUBLICATIONS

The Top Welding Techniques for Industrial Thermoplastic Fabric, Erez, erez-therm.com, Sep. 30, 2020, https://web.archive.org/web/20200931090724/https://erez-therm.com/welding-thermoplastics/.
Feb. 17, 2023 (WO) International Search Report and Written Opinion App—PCT/US2022/078367, 14 pages.
Jan. 10, 2023—(WO) ISR & WO—App. No. PCT/US2022/078364.

* cited by examiner

FOOTWEAR UPPERS INCLUDING BLADDERS, ARTICLES OF FOOTWEAR INCLUDING BLADDERS IN THE UPPER, AND METHODS OF FORMING SUCH UPPERS AND/OR ARTICLES OF FOOTWEAR

RELATED APPLICATION DATA

This application is a U.S. Non-Provisional Application based on (a) U.S. Provisional Patent Appln. No. 63/277,916 filed Nov. 10, 2021 and entitled "Footwear Uppers Including Bladders and Articles of Footwear Including Bladders in the Upper" and (b) U.S. Provisional Patent Appln. No. 63/277,932 filed Nov. 10, 2021 and entitled "Footwear Uppers Including Bladders and Articles of Footwear Including Bladders in the Upper." Each of U.S. Provisional Patent Appln. No. 63/277,916 and U.S. Provisional Patent Appln. No. 63/277,932 is entirely incorporated herein by reference.

FIELD OF THE INVENTION

The present invention relates to bladders for footwear uppers, footwear uppers including the bladders, articles of footwear including the bladders, and/or methods of making and using such bladders, uppers, and/or articles of footwear. In some aspects of this technology, the bladders will be engaged with a footwear upper component in an adhesive free manner or with an adhesive based bond. Additionally or alternatively, in some aspects of this technology, the bladders will include texturing, e.g., imprinted by surface contour features of the attached footwear upper component and/or imprinted from a mold surface during molding or during another process. The present technology may be used to create footwear upper components and articles of footwear of the types described in concurrently filed U.S. Provisional Patent Appln. No. 63/277,903, filed Nov. 10, 2021 and entitled "Bladders, Footwear Uppers Including Bladders, and Articles of Footwear Including Bladders in the Upper" and U.S. Provisional Patent Appln. No. 63/277,941, filed Nov. 10, 2021 and entitled "Bladders, Footwear Uppers Including Bladders, and Articles of Footwear Including Bladders in the Upper," each of which is entirely incorporated herein by reference.

BACKGROUND

Conventional articles of athletic footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to allow users to selectively change the size of the ankle opening and to permit the user to modify certain dimensions of the upper, particularly girth, to accommodate feet with varying proportions. In addition, the upper may include a tongue that extends under the lacing system to enhance the comfort of the footwear (e.g., to moderate pressure applied to the foot by the laces). The upper also may include a heel counter to limit or control movement of the heel.

SUMMARY

This Summary is provided to introduce some general concepts relating to this technology in a simplified form that are further described below in the Detailed Description. This Summary is not intended to identify key features or essential features of the invention.

Aspects of this technology relate to bladders for footwear uppers, footwear uppers including the bladders, articles of footwear including the bladders, and/or methods of making and using such bladders, uppers, and/or articles of footwear, e.g., of the types described and/or claimed below and/or of the types illustrated in the appended drawings. The bladders may be engaged with a fabric component of the upper in any desired manner. In some aspects of this technology, the bladders will be engaged with a fabric component of the upper in an adhesive free manner (e.g., by melt bonding, by welding techniques (e.g., RF welding, ultrasonic welding, etc.), etc.) or with an adhesive based bond. Additionally or alternatively, in some aspects of this technology, the bladder (e.g., its perimeter seam surface and/or its bladder chamber surface) will include texturing formed thereon, e.g., imprinted by the surface of the fabric material with which it is engaged, imprinted from a mold surface, applied in a different manner, etc. Such bladders, uppers, and/or articles of footwear may include any one or more structures, parts, features, properties, and/or combination(s) of structures, parts, features, and/or properties of the examples described and/or claimed below and/or of the examples illustrated in the appended drawings.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

DETAILED DESCRIPTION

Figure 1:
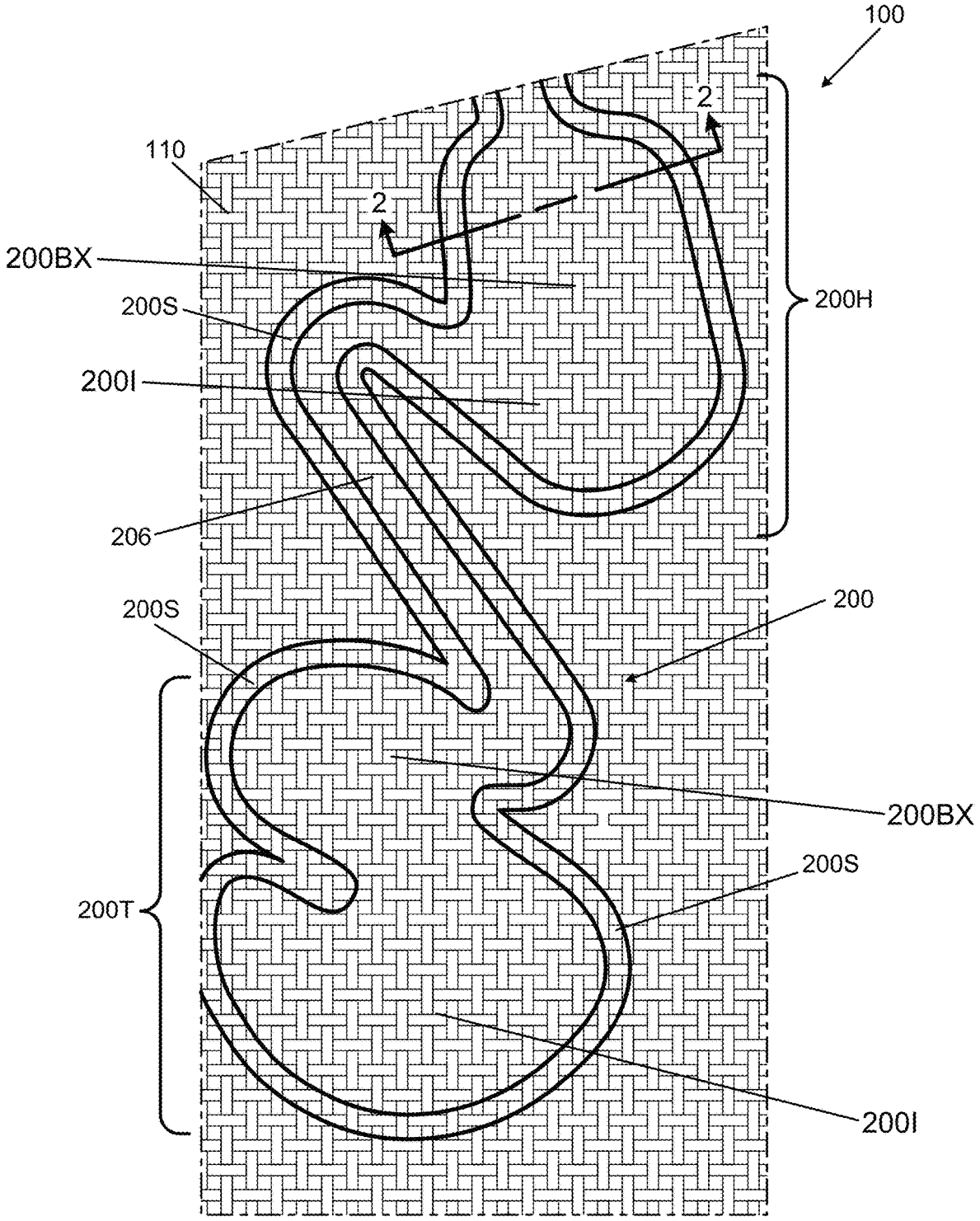
FIG. 1 provides a view of a portion of a footwear upper component having an engaged bladder in accordance with some examples of this technology.

In the following description of various examples of bladders, footwear uppers, and/or articles of footwear according to the present technology, reference is made to the accompanying drawings, which form a part hereof, and in which are shown by way of illustration various example structures and environments in which aspects of this technology may be practiced. It is to be understood that other structures and environments may be utilized and that structural and functional modifications may be made to the specifically described structures, functions, and methods without departing from the scope of the present disclosure.

I. General Description of Aspects of this Technology

As noted above, aspects of this technology relate to bladders, footwear uppers including such bladders, and articles of footwear including such bladders, e.g., of the types described and/or claimed below and/or of the types illustrated in the appended drawings. Such bladders, footwear uppers, and articles of footwear may include any one or more structures, parts, features, properties, and/or combination(s) of structures, parts, features, and/or properties of the examples described and/or claimed below and/or of the examples illustrated in the appended drawings.

This application and/or claims use the adjectives, e.g., "first," "second," "third," and the like, to identify certain components and/or features relating to this technology. These adjectives are used merely for convenience, e.g., to assist in maintaining a distinction between components and/or features of a specific structure. Use of these adjectives should not be construed as requiring a specific order or arrangement of the components and/or features being discussed. Also, use of these specific adjectives in the specification for a specific structure does not require that the same adjective be used in the claims to refer to the same part (e.g., a component or feature referred to as the "third" in the specification may correspond to any numerical adjective used for that component or feature in the claims).

This application describes footwear components (e.g., upper components (including fabric components), bladder components, sole structures, etc.) that are "bonded" together. The term "bonded" (and derivatives thereof) means that the components are joined securely to one another. The term "bonded" encompasses bonds formed using adhesives or cements (including hot melt adhesives) as well as bonds formed in an "adhesive free" manner, i.e., without use of a separate adhesive component. "Adhesive free" bonds include bonds formed by fusing or melting components together (e.g., if the components include compositions that are compatible to mix and join together to form a bond, such as two components including a thermoplastic polyurethane component); bonds formed by welding techniques (e.g., RF welding, ultrasonic welding, high-frequency welding, laser welding, impulse welding, etc.); bonds formed by heat sealing; etc. Some adhesive free bonds may form a seamless joint between the two previously separate components (e.g., the materials mix and join together and then re-harden with no discernible junction). The term "melt bond" and variations thereof, as used herein, mean bonds formed where localized melting of each component occurs (e.g., melting of the thermoplastic polymer present in each component), the melted components combine together, and then the combined components harden to thereby "fuse" and "bond" the two components together. Such melt bonded joints are adhesive free and may be seamless. The term "engaged with" is used herein as a generic term and includes both adhesive based bonds and adhesive free bonds within its scope as well as other potential types of engagement that fix two (or more) components together in a "non-bonded" manner (including through the use of mechanical connectors or fasteners, through the use of sewing or stitching, etc.).

The term "bladder precursor" as used herein means at least some portion of a final bladder structure (e.g., a portion of bladder 200), such as one of a first sheet or layer of thermoplastic polymer material 200A and/or a second sheet or layer of thermoplastic polymer material 200B discussed in more detail below. A "bladder precursor" also may be considered all bladder components in an unsealed condition (e.g., before seam 200S is formed) or a completely sealed bladder before it is inflated and/or fully inflated.

Some aspects or examples of this technology relate to footwear uppers that include: (a) a first fabric element (e.g., a first knit fabric element) that includes a first thermoplastic polyurethane component; and (b) a bladder component that defines a sealed interior chamber for containing a fluid. This bladder component includes an outer perimeter seam that extends at least partially around the sealed interior chamber. At least a portion of the outer perimeter seam is engaged (e.g., bonded, melt bonded, etc.) to the first thermoplastic polyurethane component of the first fabric element. The bladder component may include a first thermoplastic sheet and a second thermoplastic sheet facing the first thermoplastic sheet, wherein the outer perimeter seam fixes the first thermoplastic sheet to the second thermoplastic sheet. In such structures, a first major interior surface of the first thermoplastic sheet, a first major interior surface of the second thermoplastic sheet, and the outer perimeter seam define the sealed interior chamber. Additionally, in some examples of this technology, the first thermoplastic sheet will include a first major exterior surface opposite its first major interior surface, and at least a portion of this first major exterior surface of the first thermoplastic sheet will be engaged (e.g., bonded, melt bonded, etc.) to the first fabric element (e.g., the first thermoplastic polyurethane component of the first fabric element). In some aspects of this technology, the first fabric element and the bladder component (the outer perimeter seam and/or the first major exterior surface) will be joined together, optionally in an adhesive free manner (e.g., by melt bonding).

Additionally or alternatively, some aspects of this technology relate to footwear upper components that include: (a) a first fabric element (e.g., a first knit fabric element) that includes a first surface having texturing; and (b) a bladder component that defines a sealed interior chamber for containing a fluid. In this aspect of this technology, the bladder component will include: (a) a first major surface engaged with (e.g., bonded to) the first surface of the first fabric element, wherein the first major surface defines at least part of a first perimeter seam surface and at least part of a first surface of the sealed interior chamber, (b) a second major surface opposite the first major surface, wherein the second major surface defines at least part of a second perimeter seam surface opposite the first perimeter seam surface and at least part of a second surface of the sealed interior chamber opposite the first surface of the sealed interior chamber, and (c) a fluid chamber located between the first major surface and the second major surface. At least a portion of the first major surface (e.g., at least part of the first perimeter seam surface and/or at least part of the first surface of the sealed interior chamber) will include texturing having surface contour features corresponding to (e.g., imprinted by) the texturing present on the first surface of the first fabric element.

Additional aspects of this technology relate to methods of forming footwear upper components that include: (a) placing a bladder or a bladder precursor on a first fabric element (e.g., a first knit fabric element), wherein the first fabric element includes a first thermoplastic polyurethane component (the bladder or the bladder precursor includes at least a first thermoplastic polymer layer and optionally a second thermoplastic polymer layer overlapping the first thermoplastic polymer layer); and (b) applying heat and pressure to form a seam to engage (e.g., bond) the first thermoplastic polymer layer with the second thermoplastic polymer layer (if a second thermoplastic polymer layer is present) and/or to engage (e.g., bond) at least a portion of the first thermoplastic polymer layer with the first thermoplastic polyurethane component of the first fabric element. Alternatively, the second thermoplastic polymer layer may be bonded to the first thermoplastic polymer layer after the first fabric element and the first thermoplastic polymer layer are bonded together. The seam, the first thermoplastic polymer layer, and the second thermoplastic polymer layer define a sealed interior chamber for containing a fluid (e.g., a gas). Once the bladder is fully formed, the sealed interior chamber may be filled with fluid (e.g., inflated with a gas). In at least some examples of this technology, the first fabric element and the bladder or bladder precursor (the seam and/or at least some portion of the first thermoplastic polymer layer) will be joined together in an adhesive free manner (e.g., by melt bonding the first thermoplastic polyurethane component of the first fabric element with the first thermoplastic polymer layer of the bladder or bladder precursor).

Still additional aspects of this technology relate to methods of forming footwear upper components that include: (a) placing a bladder or a bladder precursor on a first fabric element, wherein the first fabric element includes a first surface having texturing, and wherein the bladder or the bladder precursor includes at least a first thermoplastic polymer layer, and optionally a second thermoplastic polymer layer overlapping the first thermoplastic polymer layer; and (b) forming texturing on at least a portion of the first thermoplastic polymer layer by applying heat and pressure to form at least one of: (i) a seam that engages (e.g., bonds) the first thermoplastic polymer layer with the second thermoplastic polymer layer (if present) and/or (ii) an engagement of (e.g., a bond between) at least the portion of the first thermoplastic polymer layer with the first fabric element. The second thermoplastic polymer layer may be bonded to the first thermoplastic polymer layer after the first fabric element and the first thermoplastic polymer layer are bonded. The bladder (or the bladder precursor) defines a sealed interior chamber for containing a fluid such as a gas (in a volume inside the seam and between the first and second thermoplastic polymer layers). The texturing formed on at least the portion of the first thermoplastic polymer layer corresponds in surface contour features to (and is imprinted by) the texturing included on the first surface of the first fabric element.

Still additional aspects of this technology relate to footwear upper components that include: (a) a first fabric element; and (b) a bladder component that defines a sealed interior chamber for containing a fluid (e.g., as gas). This example bladder component includes: (i) a first major surface engaged with the first fabric element, wherein the first major surface defines at least part of a first perimeter seam surface and at least part of a first surface of the sealed interior chamber, (ii) a second major surface opposite the first major surface, wherein the second major surface defines at least part of a second perimeter seam surface opposite the first perimeter seam surface and at least part of a second surface of the sealed interior chamber opposite the first surface of the sealed interior chamber, and (iii) and a fluid chamber located between the first major surface and the second major surface, and wherein at least a portion of the second major surface includes molded-in texturing (e.g., a plurality of raised ridges, a plurality of raised grid elements, a plurality of recessed grid elements, a herringbone pattern, a plurality of rounded elements (e.g., with raised rounded elements, recessed rounded elements, a combination of both, circular elements, oval elements, elliptical elements, teardrop shaped elements, etc.), etc.). Texturing may be different in different areas of the bladder (e.g., the molded-in texturing may include a first portion having a first pattern, a second portion having a second pattern different from the first pattern, etc.). The term "molded-in" texturing means texturing applied using a mold component irrespective of the particular process used (e.g., molding a bladder alone, molding a bladder while attaching to a fabric, formed in a vacuum forming process, forming in a thermoforming process, etc.). The term "molded-in" texturing, unless otherwise noted, includes texturing applied during an embossing or calendering process or a rolling process using a textured roller.

Further aspects of this technology relate to articles of footwear including the bladders and/or footwear uppers of the various types described above and described in more detail below. Still additional aspects of this technology relate to methods of making the bladders, footwear upper components, footwear uppers, and/or articles of footwear described above and described in more detail below.

Given the general description of features, examples, aspects, structures, and methods according to examples of the technology provided above, a more detailed description of specific example bladders, footwear upper components, footwear uppers, articles of footwear, and methods in accordance with this technology follows.

II. Detailed Description of Example Bladders, Footwear Uppers, Articles of Footwear, and Other Components/Features According to this Technology As described above, aspects of the present technology relate to footwear upper components that include a bladder engaged with a fabric component that will form a portion of the footwear upper (e.g., a tongue portion, an instep portion, a heel and/or ankle support portion, etc.). FIG. 1 illustrates a portion of an example footwear upper component 100 that includes a fabric component 110 engaged with (e.g., bonded to) a bladder component 200. The bladder component 200 of this example includes an outer perimeter seam 200S that extends continuously around (as a closed loop) and defines an entire outer perimeter of a sealed interior chamber 200I for containing a gas or other fluid. The sealed interior chamber 200I may comprise a single chamber that is in open fluid communication throughout its interior (e.g., a single sealed interior chamber 200I). While other shapes and arrangements are possible, in this illustrated example, the bladder component 200 includes an instep and/or tongue based region 200T, a heel and/or ankle support region 200H and a fluid line 206 connecting the instep and/or tongue based region 200T with the heel and/or ankle support region 200H (and placing these regions in fluid communication with one another). The bladder 200 of this example may be flat pressed onto and engaged with the fabric component 110 using heat and pressure in an inflated or uninflated condition. The structure of the bladder 200 and its incorporation into a footwear upper component 100, an overall footwear upper, and/or a footwear structure will be described in more detail below.

FIGS. 2A-2J are cross sectional views, e.g., taken along line 2-2 in FIG. 1. These cross sectional views show several example variations in footwear upper components 100, fabric components 110, bladder components 200, and their engagements in accordance with examples of this technology. As shown in FIGS. 2A-2J, the bladder component 200 is formed from a first sheet or layer of thermoplastic polymer material 200A (e.g., a thermoplastic polyurethane or TPU) engaged with a second sheet or layer of thermoplastic polymer material 200B (e.g., a thermoplastic polyurethane or TPU), e.g., at a bonded outer perimeter seam 200S. The sealed interior chamber 200I is provided in the area bounded by the outer perimeter seam 200S and by the first and second sheets or layers of thermoplastic polymer material 200A, 200B. The outer perimeter seam 200S may be used for engaging the bladder component 200 with a fabric component of the footwear upper base 102, e.g., by stitching through the outer perimeter seam 200S into the fabric component 110; by an adhesive connection; by a melt bond, welded, or other adhesive-free bonded connection; etc.

Figure 2A:
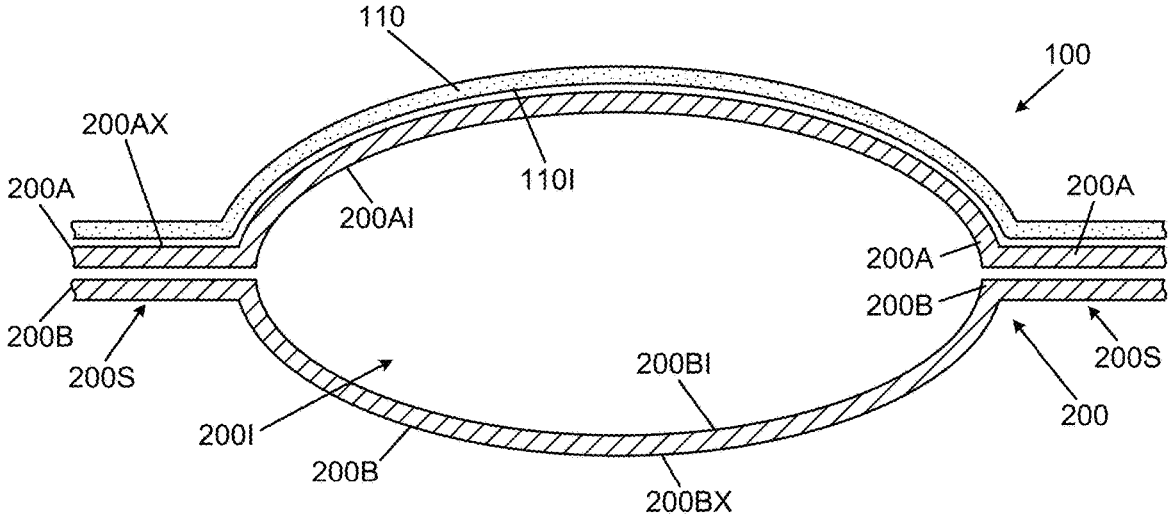
FIGS. 2A-2J provide cross sectional views, e.g., along line 2-2 in FIG. 1, showing various alternative structures in accordance with some aspects of this technology.

The example footwear upper component 100 of FIG. 2A includes a complete adhesive free bond between: (a) the first sheet or layer of thermoplastic polymer material 200A and the second sheet or layer of thermoplastic polymer material 200B (bonding bladder 200 interior surfaces 200AI and 200BI) and (b) the first sheet or layer of thermoplastic polymer material 200A and the fabric component 110 (bonding bladder exterior surface 200AX with fabric surface 110I). Small gaps between components are provided in the depictions shown in FIG. 2A (as well as in FIGS. 2B-2J) so that the different components of the structure can be more readily discerned. In this illustrated example, fabric component 110 may comprise a TPU material, such as a fabric material (including a knit fabric material) in which one or more yarns is/are formed by and/or coated with a TPU material. This type of adhesive free bonding may be accomplished, for example, by melt bonding components 110 and 200A to one another and melt bonding components 200A and 200B to one another; by welding components 110 and 200A to one another and welding components 200A and 200B to one another; etc. In at least some of these adhesive free bonds, heat and pressure may be applied to the desired seam area 200S and/or any desired areas where the fabric component 110 is to be connected to the first sheet or layer of thermoplastic polymer material 200A (e.g., along at least a portion of the seam 200S area, along at least a portion of the surface of the first sheet or layer of thermoplastic polymer material 200A forming the sealed interior chamber 200I, etc., and/or where the first sheet or layer of thermoplastic polymer material 200A is to be connected to the second sheet or layer of thermoplastic polymer material 200B (e.g., at the seam 200S, at internal welds, etc.), etc.). Each of components 110, 200A, and 200B may include a TPU material that will melt and/or soften at the location(s) where adequate heat and pressure are applied. This localized melting and/or softening will allow the melted and/or softened materials of the components 110, 200A, and 200B to mix and combine together. Then, after the heat and/or pressure are removed or adequately relaxed, the materials of components 110, 200A, 200B will harden to form bonded components 110/200A and/or bonded components 200A/200B. If sufficient melting and/or softening took place during the bonding step, the resultant joints between components 110/200A and/or components 200A/200B may appear seamless.

The adhesive free bonds in the structure of FIG. 2A between: (a) the first sheet or layer of thermoplastic polymer material 200A and the second sheet or layer of thermoplastic polymer material 200B and (b) the first sheet or layer of thermoplastic polymer material 200A and the fabric component 110 may be formed in a single step or they may be formed in separate steps (in either order). Further, the sealed interior chamber 200I may be inflated with gas or filled with other fluid before the bladder 200 is bonded to the fabric component 110 or after the bladder 200 is bonded to the fabric component 110. In some examples of this technology, at least 50% (and in some examples, at least 60%, at least 75%, at least 80%, at least 90%, at least 95%, or even 100%) of the surface area of an exterior surface 200AX of the outer perimeter seam 200S (formed from first sheet or layer of thermoplastic polymer material 200A) will be bonded to the fabric component 110. Additionally or alternatively, in some examples of this technology, at least 25%, at least 40%, at least 50%, at least 60%, at least 75%, at least 80%, at least 90%, at least 95%, or even 100% of the overall surface area of exterior surface 200AX of the first sheet or layer of thermoplastic polymer material 200A will be bonded to fabric component 110.

Figure 2B:
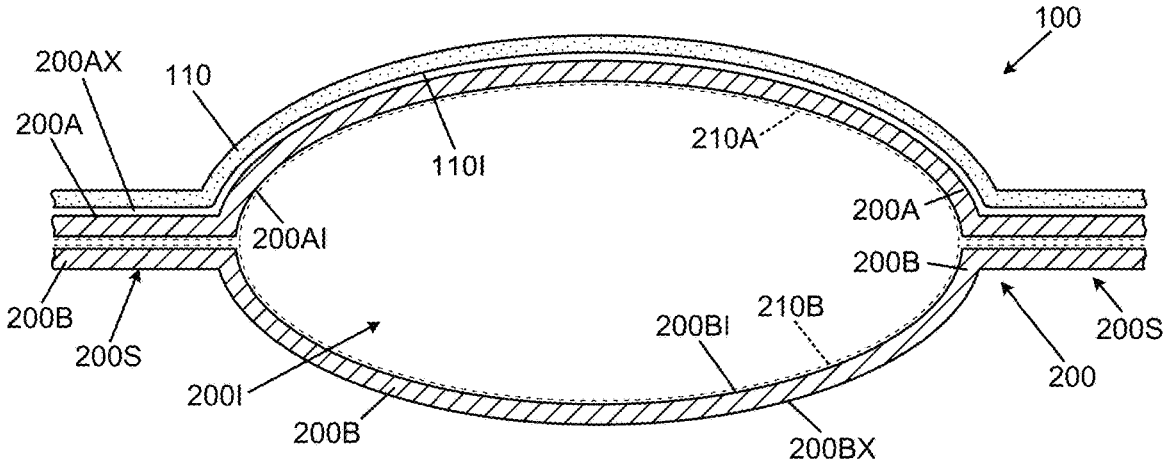

The example footwear upper component 100 of FIG. 2B is similar to that shown in FIG. 2A except the interior surfaces 200AI, 200BI of both the first sheet or layer of thermoplastic polymer material 200A and the second sheet or layer of thermoplastic polymer material 200B have a hot melt adhesive 210A and 210B, respectively, applied to or otherwise included with it. Thus, in this overall structure: (i) the bond between the first sheet or layer of thermoplastic polymer material 200A (its exterior surface 200AX) and the fabric component 110 (its surface 110I) constitutes an adhesive free bond of the types described above and (ii) the bond between the first sheet or layer of thermoplastic polymer material 200A (its interior surface 200AI) and the second sheet or layer of thermoplastic polymer material 200B (its interior surface 200BI) constitutes an adhesive bond from the hot melt material 210A, 210B. The interior chamber 200I may be formed (e.g., left unbonded) by using a pressing device that has a hole through it and/or otherwise does not apply sufficient heat and/or pressure to the thermoplastic polymer materials 200A, 200B located at the interior chamber 200I area. Again, in this illustrated example, fabric component 110 may comprise a TPU material, such as a fabric material (including a knit fabric material) in which one or more yarns is/are formed by and/or coated with a TPU material that is compatible to bond with a TPU material included in the first sheet or layer of thermoplastic polymer material 200A.

The bonds in the structure of FIG. 2B between: (a) the first sheet or layer of thermoplastic polymer material 200A and the second sheet or layer of thermoplastic polymer material 200B and (b) the first sheet or layer of thermoplastic polymer material 200A and the fabric component 110 may be formed in a single step or they may be formed in separate steps (in either order). Further, the sealed interior chamber 200I may be inflated with gas or filled with other fluid before the bladder 200 is bonded to the fabric component 110 or after the bladder 200 is bonded to the fabric component 110. The surface area of the first sheet or layer of thermoplastic polymer material 200A forming the bond with fabric component 110 may be within any of the ranges described above for FIG. 2A.

Figure 2C:
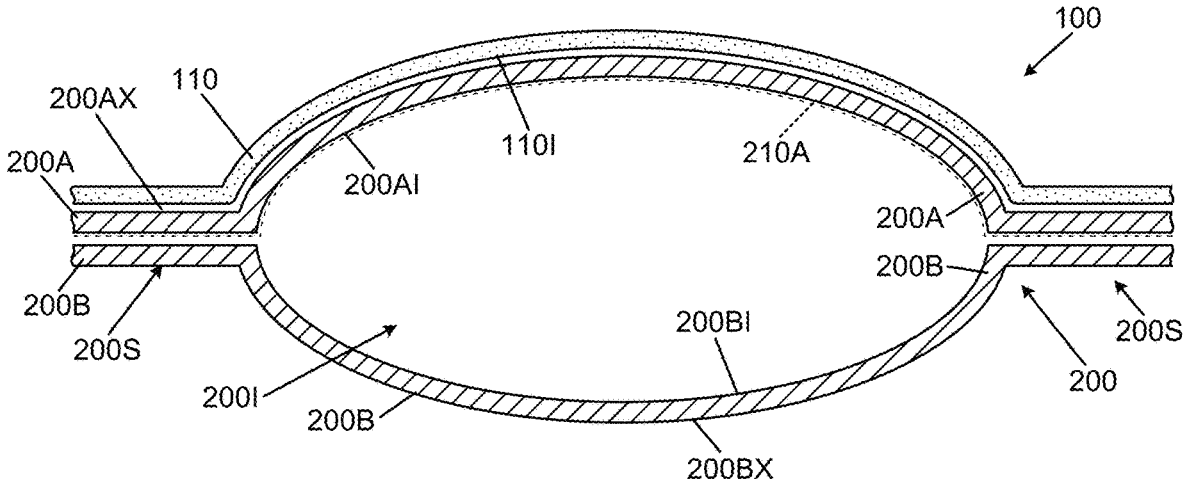
Figure 2D:
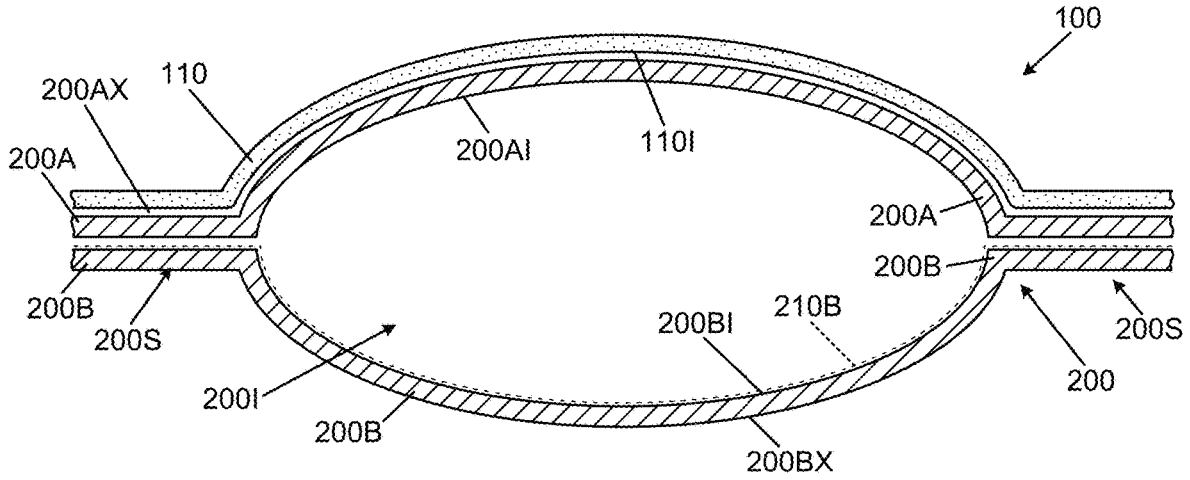

The example footwear upper component 100 structures of FIGS. 2C and 2D are similar to that shown in FIG. 2B except the interior surfaces 200AI, 200BI of only one of the first sheet or layer of thermoplastic polymer material 200A (FIG. 2C) or the second sheet or layer of thermoplastic polymer material 200B (FIG. 2D) has a hot melt adhesive 210A and 210B, respectively, applied to or otherwise included with it. Thus, in these overall structures, the bond between the first sheet or layer of thermoplastic polymer material 200A and the fabric component 110 (joining surfaces 200AX and 110I) constitutes an adhesive free bond of the types described above and the bond between the first sheet or layer of thermoplastic polymer material 200A and the second sheet or layer of thermoplastic polymer material 200B (joining surfaces 200AI and 200BI) constitutes an adhesive bond from the hot melt material 210A or 210B. The interior chamber 200I may be formed (e.g., left unbonded) by using a pressing device that has a hole through it and/or otherwise does not apply sufficient heat and/or pressure to the thermoplastic polymer materials 200A, 200B located at the interior chamber 200I area. Again, in these illustrated examples, fabric component 110 may comprise a TPU material, such as a fabric material (including a knit fabric material) in which one or more yarns is/are formed by and/or coated with a TPU material that is compatible to bond with a TPU material included in the first sheet or layer of thermoplastic polymer material 200A.

The bonds in the structures of FIGS. 2C and 2D between: (a) the first sheet or layer of thermoplastic polymer material 200A and the second sheet or layer of thermoplastic polymer material 200B and (b) the first sheet or layer of thermoplastic polymer material 200A and the fabric component 110 may be formed in a single step or they may be formed in separate steps (in either order). Further, the sealed interior chamber 200I may be inflated with gas or filled with other fluid before the bladder 200 is bonded to the fabric component 110 or after the bladder 200 is bonded to the fabric component 110. The surface area of the first sheet or layer of thermoplastic polymer material 200A forming the bond with fabric component 110 may be within any of the ranges described above for FIG. 2A.

Figure 2E:
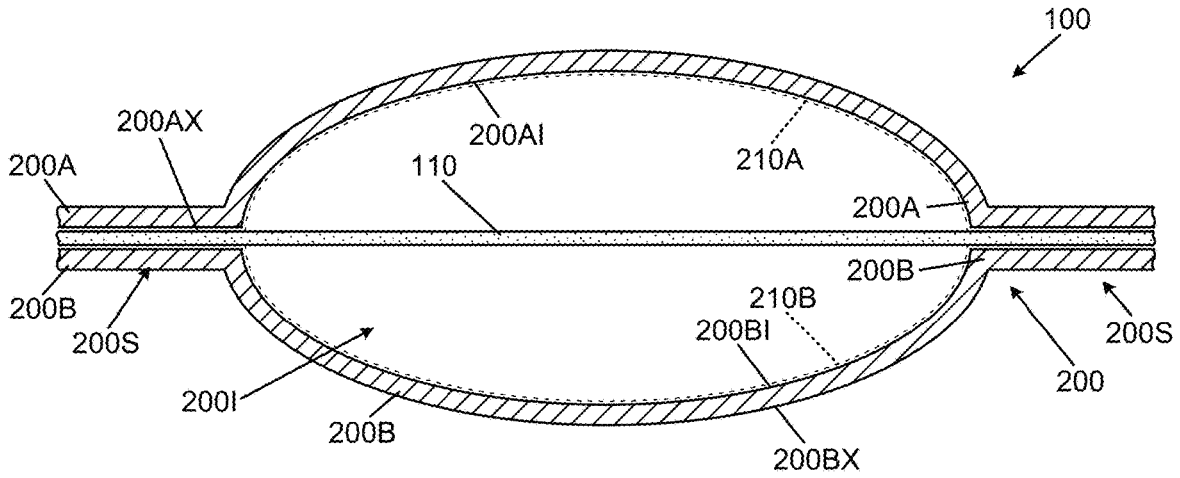
Figure 2F:
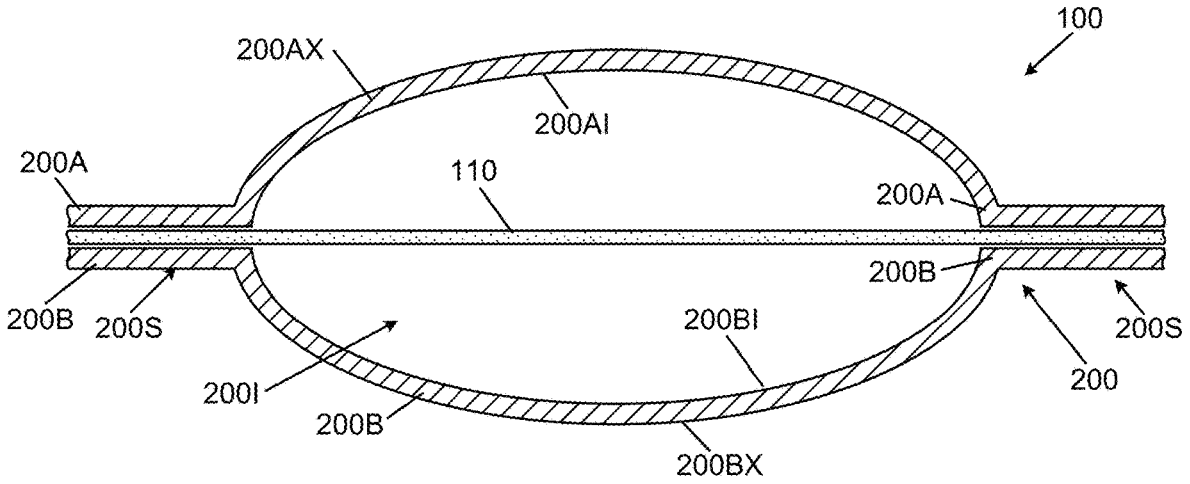

FIGS. 2E and 2F show different arrangements of footwear upper components 100 in which a fabric component 110 is located between a first sheet or layer of thermoplastic polymer material 200A and a second sheet or layer of thermoplastic polymer material 200B forming a bladder 200 having an interior chamber 200I. In the example of FIG. 2E, both the first sheet or layer of thermoplastic polymer material 200A and the second sheet or layer of thermoplastic polymer material 200B have a hot melt adhesive 210A, 210B, respectively, applied to it and engaging the fabric component 110 as an adhesive bond. In the example of FIG. 2F, on the other hand, neither of the first sheet or layer of thermoplastic polymer material 200A nor the second sheet or layer of thermoplastic polymer material 200B has a hot melt adhesive applied to it. Thus, fabric component 110 engages the first sheet or layer of thermoplastic polymer material 200A and the second sheet or layer of thermoplastic polymer material 200B in an adhesive free manner in the example of FIG. 2F. The interior chamber 200I may be formed (e.g., left unbonded) by using a pressing device that has a hole through it and/or otherwise does not apply sufficient heat and/or pressure to the thermoplastic polymer materials 200A, 200B located at the interior chamber 200I area. In at least the example of FIG. 2F, fabric component 110 may comprise a TPU material, such as a fabric material (including a knit fabric material) in which one or more yarns is/are formed by and/or coated with a TPU material that is compatible to bond with a TPU material included in the first sheet or layer of thermoplastic polymer material 200A and the second sheet or layer of thermoplastic polymer material 200B. In the examples of FIGS. 2E and 2F (as well as FIGS. 2A-2D), the fabric component 110 may extend to locations beyond the seam 200S. Additionally or alternatively, in some examples of this technology, the fabric component 110 need not completely span the interior chamber 200I (e.g., the fabric component 110 may present just at the seam 200S area).

As an alternative, the hot melt material 210A may be omitted from the example of FIG. 2E, e.g., provided the material of fabric component 110 can bond with the material of the first thermoplastic polymer material 200A in an adhesive free manner. As a further alternative, the hot melt material 210B may be omitted, e.g., provided the material of fabric component 110 can bond with the material of the second thermoplastic polymer material 200B in an adhesive free manner. As yet further alternatives, if desired, one or both surfaces of the fabric component 110 may have a hot melt adhesive applied to it, in which case, hot melt material 210A and/or 210B can be omitted from the facing sheet or layer of thermoplastic polymer material 200A and/or 200B.

The bonds in the structures of FIGS. 2E and 2F between: (a) the first sheet or layer of thermoplastic polymer material 200A and the fabric component 110 and (b) the second sheet or layer of thermoplastic polymer material 200B and the fabric component 110 may be formed in a single step or they may be formed in separate steps (in either order).

Bladder 200 structures may include various features to control the shape of the bladder 200 once it is inflated or filled and/or to control bladder expansion features when fluid pressure and/or volume changes. For example, internal welds (e.g., spot welds, straight and/or curved weld lines, etc.) joining the interior surface 200AI of the first sheet or layer of thermoplastic polymer material 200A with the interior surface 200BI of the second sheet or layer of thermoplastic polymer material 200B may be used control the inflated or filled bladder shape 200. Additionally or alternatively, interior components may be included within the interior chamber 200I and engaged with the interior surfaces 200AI, 200BI of the first sheet or layer of thermoplastic polymer material 200A and the second sheet or layer of thermoplastic polymer material 200B. The interior component(s) may limit the distance that the interior surfaces 200AI, 200BI of the first sheet or layer of thermoplastic polymer material 200A and the second sheet or layer of thermoplastic polymer material 200B can separate from one another when the bladder 200 is inflated or filled. Such interior component structures, shape control methods, and shape control structures may be used with bladder components 200 in accordance with at least some examples of this technology.

Figure 2G:
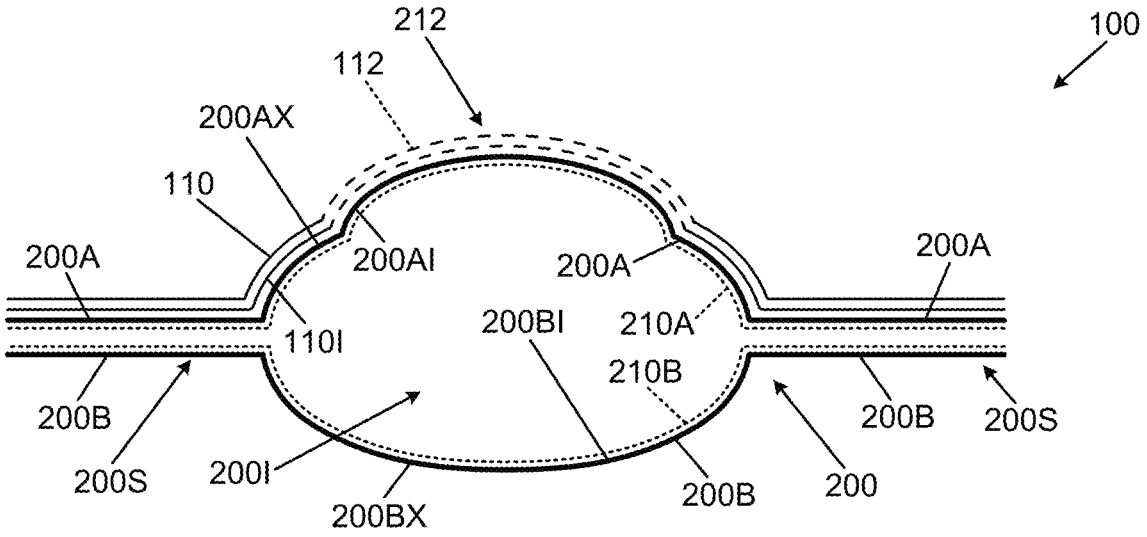

Other shape control and/or bladder expansion control structures and methods also may be used with this technology. FIG. 2G illustrates an example footwear upper component 100 including a bladder structure 200 of the type shown in FIG. 2B. Specifically, the example of FIG. 2G shows a footwear upper component 100 in which: (a) the interior surface 200AI, 200BI of each of the first sheet or layer of thermoplastic polymer material 200A and the second sheet or layer of thermoplastic polymer material 200B includes a hot melt adhesive 210A, 210B and (b) the fabric component 110 (e.g., a TPU material, such as a TPU knit material) is applied to the exterior surface 200AX of the first sheet or layer of thermoplastic material 200A in an adhesive free manner. Alternatively, however, any of the footwear upper component 100 structures of FIGS. 2A-2D could be used. In the example footwear upper component 100 of FIG. 2G, at least a portion of the fabric component 110 is formed from a soluble material (e.g., water soluble, organic soluble, etc.). FIG. 2G shows broken lines in a region 112 where a solvent is applied to the fabric component 110 to dissolve at least a portion of the fabric component 110 in this example. This dissolution opens a hole and/or weakens the fabric component 110 in region 112, thereby allowing a bulged region 212 of the bladder 200 to be formed when the bladder 200 is inflated and/or when pressure and/or volume is increased in that area of the bladder 200. Thus, in this example, the fabric component 110 partially covers the exterior surface 200AX of the sealed interior chamber 200I or is weakened in region 112. This type of selective dissolution and/or weakening of fabric component 110 can control the shape of the inflated bladder 200 and/or provide a controlled direction of expansion of the bladder 200 under a fluid pressure applied in the interior chamber 200I at this area. In a final footwear product, if desired, the bulged region 212 may face inward with respect to the footwear upper to contact and/or apply force to the wearer's foot. The bulging and/or contacting actions may increase support for the area of the foot and/or improve comfort or fit of the footwear (e.g., by eliminating excess space within the upper). Alternatively, the bulged region 212 could face outward and away from a wearer's foot.

Figure 2H:
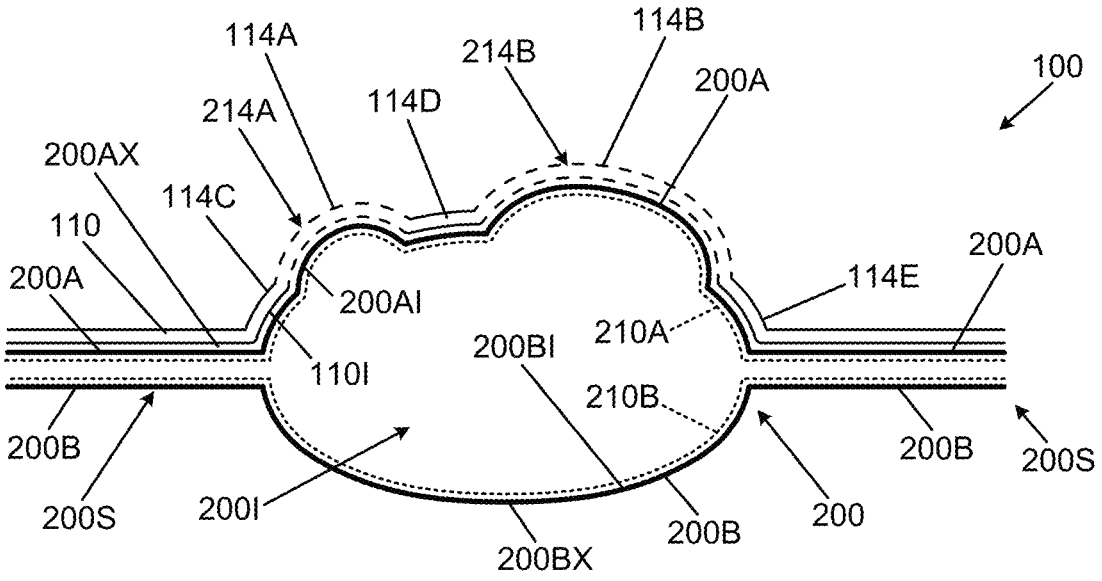

FIG. 2H illustrates an example of controlling the shape and/or direction of expansion of a bladder 200 using the properties of the fabric component 110. In the example of FIG. 2H, the footwear upper component 100 includes a hot melt adhesive 210A, 210B on the interior surfaces 200AI, 200BI of each of the first sheet or layer of thermoplastic polymer material 200A and the second sheet or layer of thermoplastic polymer material 200B. The fabric component 110 (e.g., a TPU material, such as a TPU knit material) is applied to the exterior surface 200AX of the first sheet or layer of thermoplastic material 200A in an adhesive free manner in this illustrated example. Alternatively, however, any of the footwear upper component 100 structures of FIGS. 2A-2D could be used. In the example footwear upper component 100 of FIG. 2H: (i) one or more portions 114A, 114B of the fabric component 110 are formed from a looser structure (e.g., by forming portions 114A, 114B using a looser knit or weave structure, by forming portions 114A, 114B from a more stretchable or more elastic material, and/or by forming portions 114A, 114B from a more stretchable knit or weave pattern, etc.) and/or (ii) one or more portions 114C, 114D, 114E of the fabric component 110 are formed from a tighter structure (e.g., by forming portions 114C, 114D, 114E using a tighter knit or weave structure, by forming portions 114C, 114D, 114E from a less stretchable or less elastic material, and/or by forming portions 114C, 114D, 114E from a less stretchable knit or weave pattern, etc.). Selectively locating relatively dense or relatively unstretchable portions (e.g., fabric portions 114C, 114D, 114E) and relatively loose or relatively stretchable portions (e.g., fabric portions 114A, 114B) of the fabric component 110 at desired locations allows one or more bulged regions (e.g., bulged regions 214A, 214B) of the bladder 200 to be formed when the bladder 200 is inflated. This type of selective placement of regions (e.g., fabric portions 114A-114E) of fabric component 110 can control the shape of the inflated bladder 200 and/or provide a controlled direction of expansion of the bladder 200 under a fluid pressure applied in the interior chamber 200I at this area. In a final footwear product, if desired, the bulged region(s) 214A, 214B may face inward with respect to the footwear upper to contact and/or apply force to the wearer's foot. The bulging and/or contacting actions may increase support for the area of the foot and/or improve comfort or fit of the footwear (e.g., by eliminating excess space within the upper). Alternatively, the bulged region(s) 214A, 214B could face outward and away from a wearer's foot.

Figure 2I:
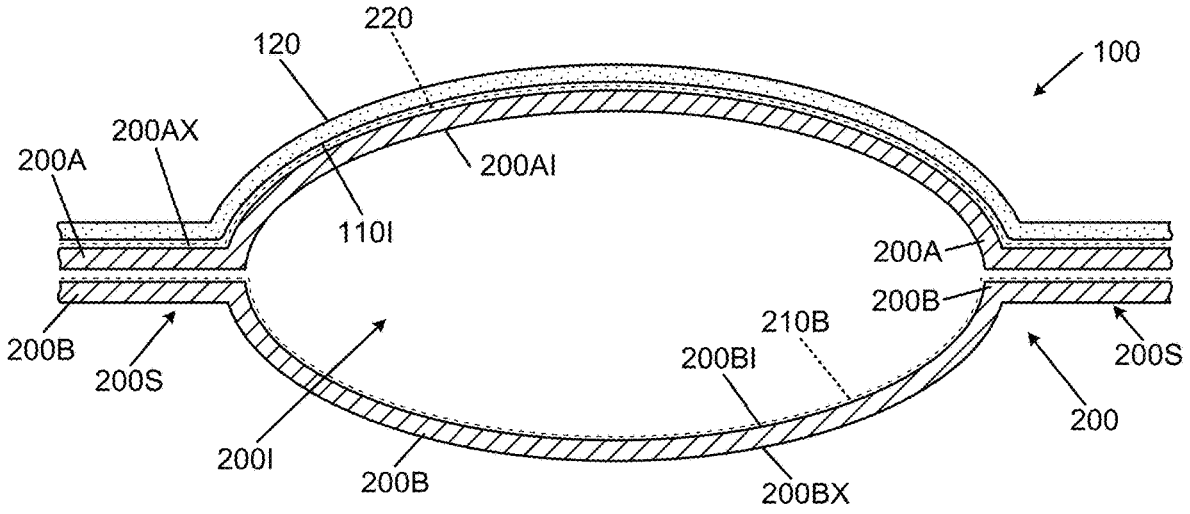

In the examples of FIGS. 2A-2H described above, the fabric component 110 was formed of and/or included a material (e.g., a TPU material) that was compatible with the material(s) of at least one of the first sheet or layer of thermoplastic polymer material 200A and/or the second sheet or layer of thermoplastic polymer material 200B. This enables the fabric component 110 to bond with the first sheet or layer of thermoplastic polymer material 200A and/or the second sheet or layer of thermoplastic polymer material 200B in an adhesive free manner. In some examples of this technology, however, a fabric component 120 may be used that is not formed of and/or formed to include a material (e.g., a TPU material) compatible with the material(s) of at least one of the first sheet or layer of thermoplastic polymer material 200A and/or the second sheet or layer of thermoplastic polymer material 200B to form an adhesive free bond (at least under the heat and pressure conditions to be used). Rather, such a fabric component 120 may be engaged with at least one of the first sheet or layer of thermoplastic polymer material 200A and/or the second sheet or layer of thermoplastic polymer material 200B by an adhesive bond. FIG. 2I illustrates an example footwear upper component 100 similar to the structure described above in conjunction with FIG. 2D but where fabric component 120 is engaged with the exterior surface 200AX of the first sheet or layer of thermoplastic polymer material 200A via an adhesive layer 220 (e.g., a hot melt adhesive layer). Heat and pressure may be applied to engage (adhesively bond) fabric component 120 to the first sheet or layer of thermoplastic polymer material 200A. The application of heat and pressure to bond fabric component 120 to the first sheet or layer of thermoplastic polymer material 200A may take place simultaneous with or separate from steps used to bond the first sheet or layer of thermoplastic polymer material 200A with the second sheet or layer of thermoplastic polymer material 200B. When performed separately, the various components may be bonded with one another in any desired order. Additionally, the application of heat and pressure to bond fabric component 120 to the first sheet or layer of thermoplastic polymer material 200A may take place before or after the interior bladder chamber 200I is inflated.

In a similar manner, the material of fabric component 120 may be used in place of fabric component 110 in any of the various footwear upper component 100 structures shown in FIGS. 2A-2G, e.g., provided a suitable adhesive (e.g., hot melt adhesive) is used to bond fabric component 120 with one or both of the first sheet or layer of thermoplastic polymer material 200A and/or the second sheet or layer of thermoplastic polymer material 200B. The second hot melt layer 210B shown in FIG. 2I may not be needed in all examples of this structure 100, e.g., if the interior surfaces 200AI, 200BI of the first sheet or layer of thermoplastic polymer material 200A and the second sheet or layer of thermoplastic polymer material 200B are capable of forming an adhesive free bond under the conditions used to form footwear upper component 100.

Figure 2J:
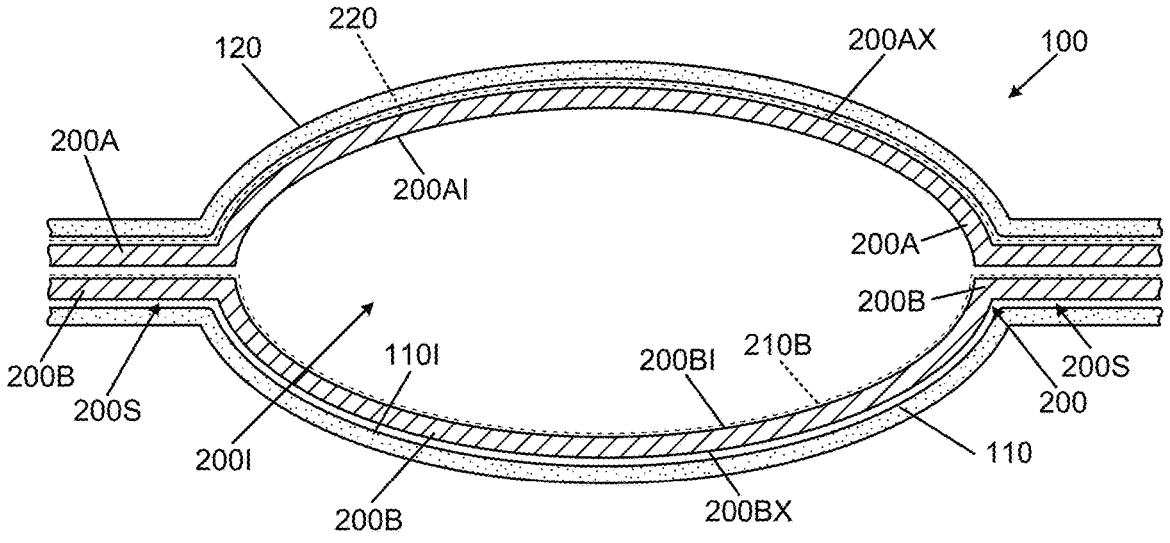

FIG. 2J illustrates a footwear upper component 100 similar to the structure described above in conjunction with FIG. 2I, but in this illustrated structure, the opposite side of the bladder 200/bladder interior chamber 200I also has a fabric component 110 and/or 120 engaged with its exterior surface (the exterior surface 200BX of second sheet or layer of thermoplastic polymer material 200B in this illustrated example). While FIG. 2J shows this additional fabric component as a fabric component 110 capable of forming an adhesive free bond with the second sheet or layer of thermoplastic polymer material 200B, an adhesive based bond and/or a fabric component like fabric component 120 also may be used in the structure of FIG. 2J in place of fabric component 110. Either or both fabric components 110, 120 of FIG. 2J may include an opening defined through it (e.g., of the types described above in region 112 of FIG. 2G), and at least a portion of an exterior surface 200AX, 200BX of the sealed interior chamber 200I may be exposed through that opening. Additionally or alternatively, the second hot melt layer 210B shown in FIG. 2J may not be needed in all examples of this structure 100, e.g., if the interior surfaces 200AI, 200BI of the first sheet or layer of thermoplastic polymer material 200A and the second sheet or layer of thermoplastic polymer material 200B are capable of forming an adhesive free bond under the conditions used to form the bladder 200 and/or the footwear upper component 100.

Heat and pressure may be applied to: (a) engage (adhesively bond) fabric component 120 to the first sheet or layer of thermoplastic polymer material 200A and (b) engage (adhesively bond or adhesive free bond) fabric component 110 to the second sheet or layer of thermoplastic polymer material 200B. The application of heat and pressure to bond these components may take place simultaneously or separately. Further, the application of heat and pressure to bond these components may take place simultaneously or separately from the steps used to form the bladder 200 (e.g., the steps to form seam 200S between the interior surfaces 200AI, 200BI of layers 200A, 200B). Additionally, the application of heat and pressure to bond the fabric components 110, 120 to the sheets or layers of thermoplastic polymer material 200A, 200B may take place before or after the interior bladder chamber 200I is inflated.

As shown in the examples of FIGS. 2A-2J, the outer perimeter seam 200S includes: (a) a first seam portion engaging a first side of the first sheet or layer of thermoplastic polymer material 200A with a first side of the second sheet or layer of thermoplastic polymer material 200B (e.g., the left sides of FIGS. 2A-2J) and (b) a second seam portion engaging a second side of the first sheet or layer of thermoplastic polymer material 200A with a second side of the second sheet or layer of thermoplastic polymer material 200B (e.g., the right sides of FIGS. 2A-2J), wherein the first seam portion is located on an opposite side of the sealed interior chamber 200I from the second seam portion. In some examples of this technology, the portion of the first major exterior surface 200AX of the first sheet or layer of thermoplastic polymer material 200A that is bonded to the fabric component 110 or 120 (e.g., a knit fabric element including a thermoplastic polyurethane component) may extend continuously from the first seam portion to the second seam portion. In such structures, at least some portion of the first sheet or layer of thermoplastic polymer material 200A that forms the sealed interior chamber 200I of the bladder 200 will be bonded to the fabric component 110 or 120 (e.g., an adhesive bond, an adhesive free bond, etc.). As some more specific examples, at least 25%, at least 40%, at least 50%, at least 60%, at least 75%, at least 80%, at least 90%, at least 95%, or even 100% of the surface area of the exterior major surface 200AX of the first sheet or layer of thermoplastic polymer material 200A that forms the sealed interior chamber 200I of the bladder 200 will be bonded to the fabric component 110 or 120 (e.g., an adhesive bond, an adhesive free bond, etc.). Additionally or alternatively, when the second sheet or layer of thermoplastic polymer material 200B is bonded to a fabric component 110, 120 (e.g., as shown in FIG. 2J), its exterior major surface 200BX may be bonded to the fabric component 110, 120 over any of the same surface area ranges described above for exterior major surface 200AX.

Figure 3A:
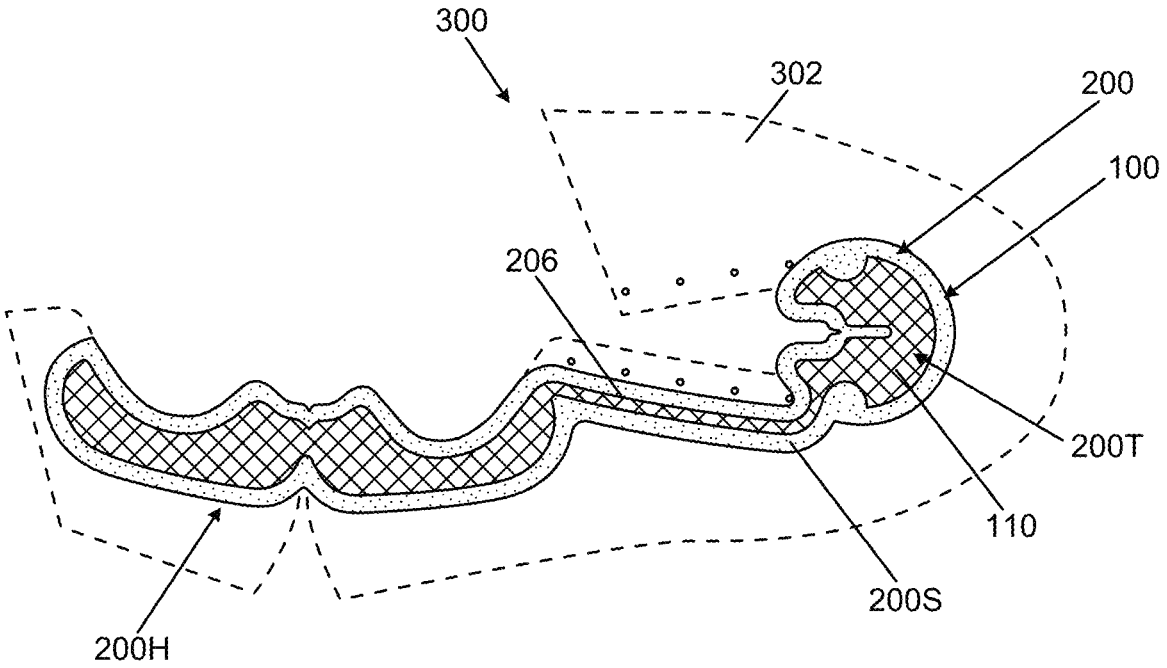
FIGS. 3A-5C show various example footwear upper constructions and methods of controlling bladder expansion in accordance with some aspects of this technology.
Figure 3B:
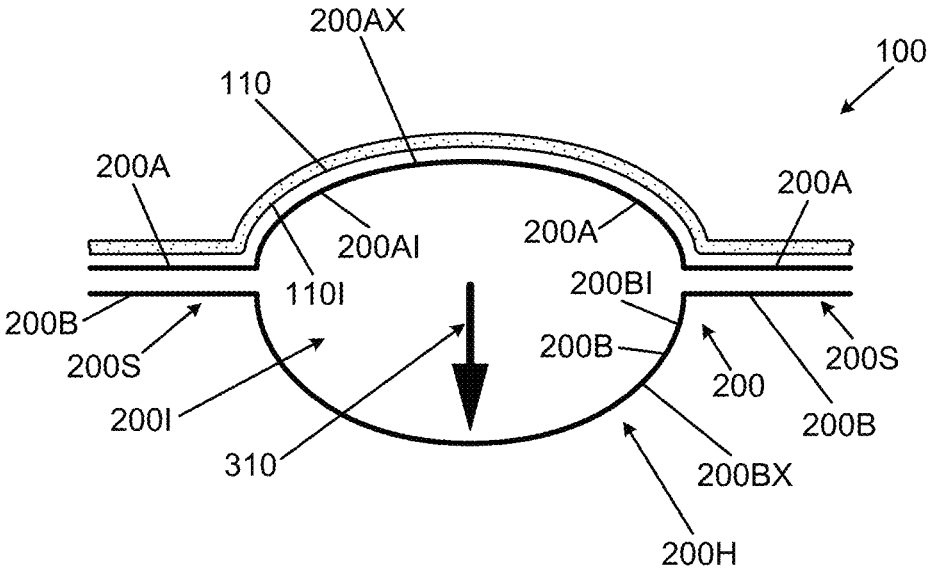

As mentioned above (e.g., in conjunction with FIGS. 2G and 2H), features of the fabric components (e.g., fabric components 110 and/or 120) may be structured and/or controlled to enable control of the shape and/or expansion direction of bladder 200 under fluid pressure applied in the interior chamber 200I. FIGS. 3A-3B illustrate an additional example of "one way" bladder 200 expansion. FIG. 3A illustrates a footwear upper 300 including a footwear upper blank 302 (e.g., made from one or more fabric components) having a footwear upper component 100 with an attached bladder 200 of the types described above (FIGS. 1-2J) engaged with it. If desired, a component of footwear upper blank 302 may comprise one of fabric components 110, 120 shown in FIG. 2J.

FIG. 3B provides a cross sectional view of one example footwear upper component 100 as a separate component from footwear upper blank 302. While FIG. 3B shows fabric component 110 as a TPU material engagable with the first sheet or layer of thermoplastic polymer material 200A by an adhesive free bond, an adhesive based bond may be used in at least some examples of this technology. In this illustrated example, the first sheet or layer of thermoplastic polymer material 200A is mounted to the footwear upper blank 302 such that the first sheet or layer of thermoplastic polymer material 200A forms an exterior layer of the overall footwear upper component 100 and the second sheet or layer of thermoplastic polymer material 200B forms an interior layer facing the wearer's foot. At least the portion of fabric component 110 extending across the exterior surface 200AX of the bladder interior chamber 200I may be formed to have high tenacity (e.g., high strength, high abrasion resistance, etc.) and/or high resistance to stretch. In this manner, as shown in FIG. 3B, fluid pressure inside interior chamber 200I will tend to cause the bladder 200 to displace inwardly (downwardly in FIG. 3B; see arrow 310), away from the fabric component 110 and toward a wearer's foot (particularly if fabric component 110 has higher tenacity and/or higher resistance to stretch than any fabric material engaged with the bladder 200 at the bottom side shown in FIG. 3B (if any).

When the example footwear upper 300 of FIG. 3A is incorporated into an article of footwear (e.g., see FIG. 9E), the interior chamber 200I may be in open fluid communication at all areas inside perimeter seam 200S. In use, force applied to the instep oriented bladder chamber(s) 200T, e.g., via a footwear securing strap, by bending of the wearer's foot (when taking a step, initiating or landing a jump, etc.), etc., may cause fluid to move to the heel and/or ankle support chamber(s) 200H via fluid line 206. If the fabric component 110 applied over the heel and/or ankle support chamber(s) 200H has high tenacity and/or stretch resistance, this movement of fluid from instep chamber 200T to heel and/or ankle support chamber(s) 200H will cause the bladder interior surface (formed by the second sheet or layer of thermoplastic polymeric material 200B in this example) to deflect downward and inward into the overall footwear upper 300 and toward a wearer's foot (see arrow 310). This deflection of the bladder 200's second sheet or layer of thermoplastic polymeric material 200B provides additional fluid to support the wearer's heel and/or ankle.

Figure 4A:
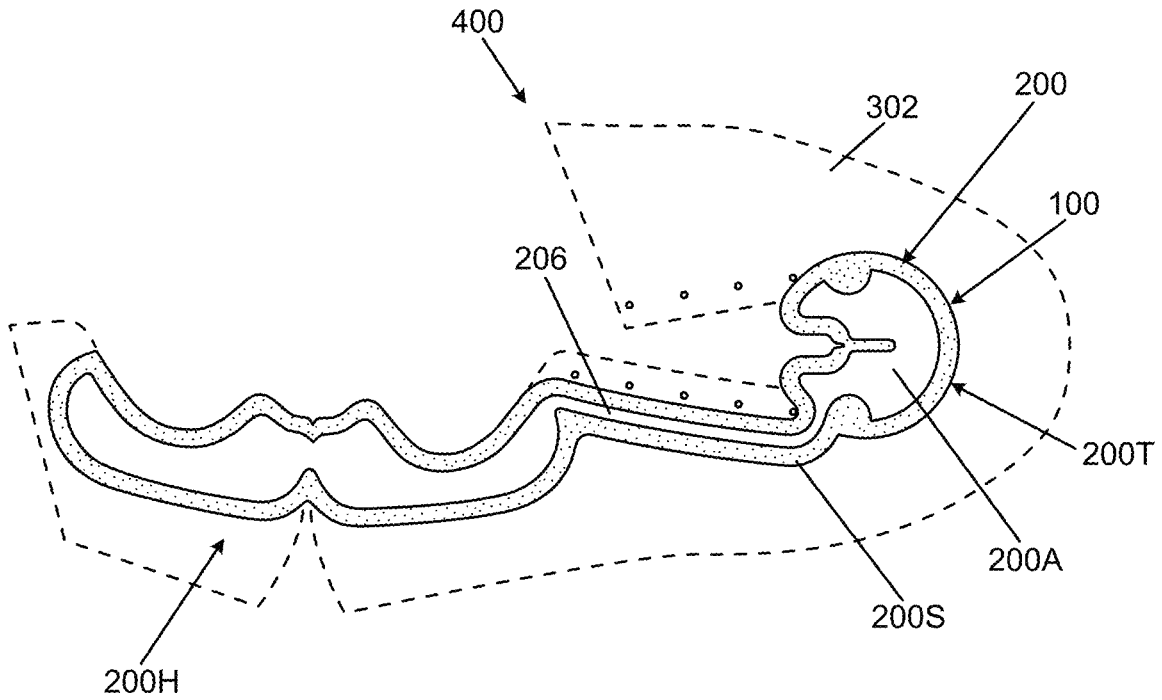
Figure 4B:
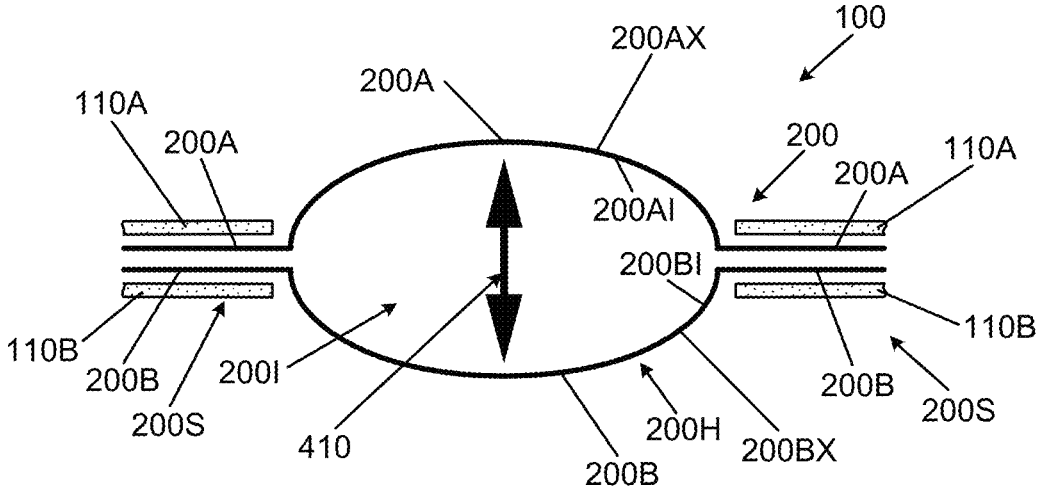

In some examples of this technology, features of the footwear upper component 100 may be controlled to allow for "two way" expansion. FIGS. 4A-4B illustrate an example of "two way" bladder 200 expansion. FIG. 4A illustrates a footwear upper 400 including a footwear upper blank 302 (e.g., made from one or more fabric components) having a footwear upper component 100 with an attached bladder 200 of the types described above (FIGS. 1-2J) engaged with it. If desired, a component of footwear upper blank 302 may comprise one of fabric components 110, 120 shown in FIG. 2J.

FIG. 4B provides a cross sectional view of one example footwear upper component 100 as a separate component from footwear upper blank 302. While FIG. 4B shows fabric components 110A, 110B as TPU materials engagable with the first sheet or layer of thermoplastic polymer material 200A and the second sheet or layer of thermoplastic material 200B, respectively, by adhesive free bonds, either or both of these fabric engagements shown in FIG. 4B may be adhesive based bonds. In this illustrated example, fabric component 110A is mounted to the first sheet or layer of thermoplastic polymer material 200A (e.g., only at the seam 200S area) such that both of fabric component 110A and the first sheet or layer of thermoplastic polymer material 200A form the exterior layer of the footwear upper component 100. The exterior surface 200AX of the bladder 200 (formed by first sheet or layer of thermoplastic material 200A) is exposed at areas inside the outer perimeter seam 200S in this illustrated example. Also, in this illustrated example, fabric component 110B is mounted to the second sheet or layer of thermoplastic polymer material 200B (e.g., only at the seam 200S area) such that both of fabric component 110B and the second sheet or layer of thermoplastic polymer material 200B form the interior layer of the footwear upper component 100. The exterior surface 200BX of the bladder 200 (formed by second sheet or layer of thermoplastic material 200B) is not covered by fabric component 110B at areas inside the outer perimeter seam 200S in this illustrated example. Fabric components 110A, 110B extend outward beyond outer perimeter seam 200S in this illustrated example (although one or both of the fabric components 110A, 110B need not do so in some examples of this technology).

Thus, in this illustrated example, at least some portions of the bladder 200's first sheet or layer of thermoplastic polymer material 200A and second sheet or layer of thermoplastic material 200B will be exposed in the footwear upper 300 in areas defining the sealed interior chamber 200I. In this manner, as shown in FIG. 4B, fluid pressure inside interior chamber 200I will tend to cause the bladder 200 to displace outwardly (upwardly and downwardly in FIG. 4B; see arrow 410). When the example footwear upper 400 of FIG. 4A is incorporated into an article of footwear (e.g., see FIG. 9E), the interior chamber 200I may be in open fluid communication at all areas inside perimeter seam 200S. In use, force applied to the instep oriented bladder chamber(s) 200T, e.g., via a footwear securing strap, by bending of the wearer's foot (when taking a step, initiating or landing a jump, etc.), etc., may cause fluid to move to the heel and/or ankle support chamber(s) 200H via fluid line 206. Such movement of fluid: (a) will cause the bladder 200 upper or outer surface (formed by the first sheet or layer of thermoplastic polymeric material 200A in this example) to deflect upward and outward and (b) will cause the bladder 200 lower or inner surface (formed by the second sheet or layer of thermoplastic polymeric material 200B in this example) to deflect downward and inward into the overall footwear upper 300. See double headed deflection arrow 410. This deflection of the bladder 200 provides additional fluid to support the wearer's heel and/or ankle and may provide a visual indication of the movement of fluid (due to the bladder 200's outer surface deflection).

Figure 5A:
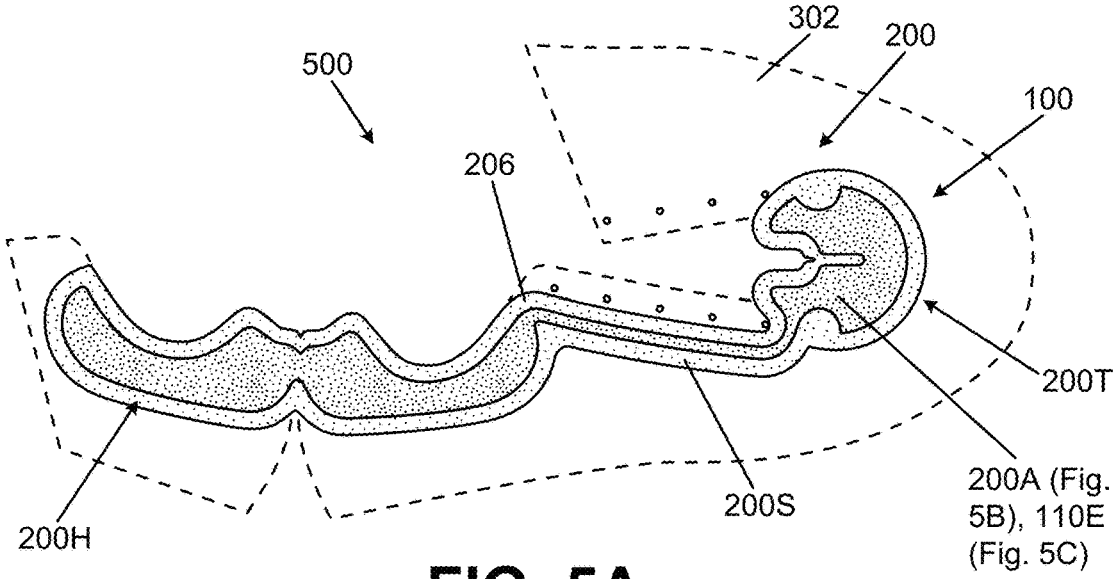
Figure 5B:
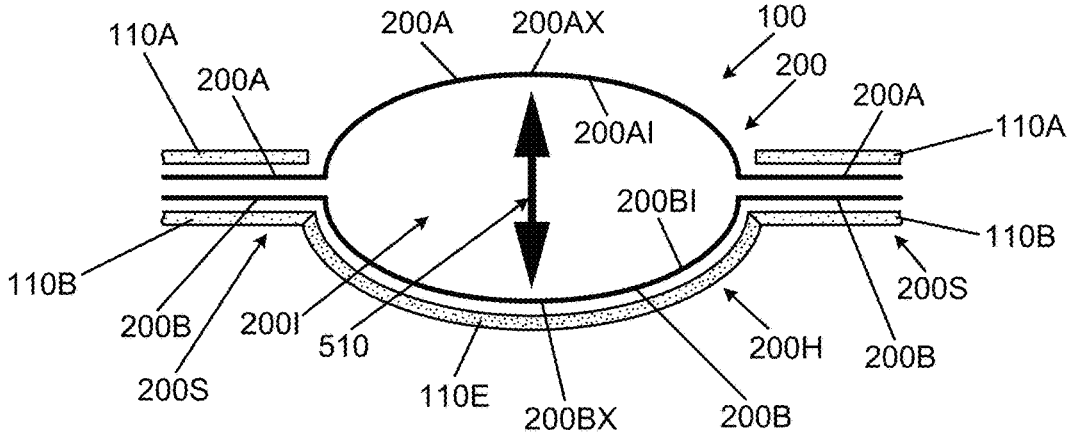
Figure 5C:
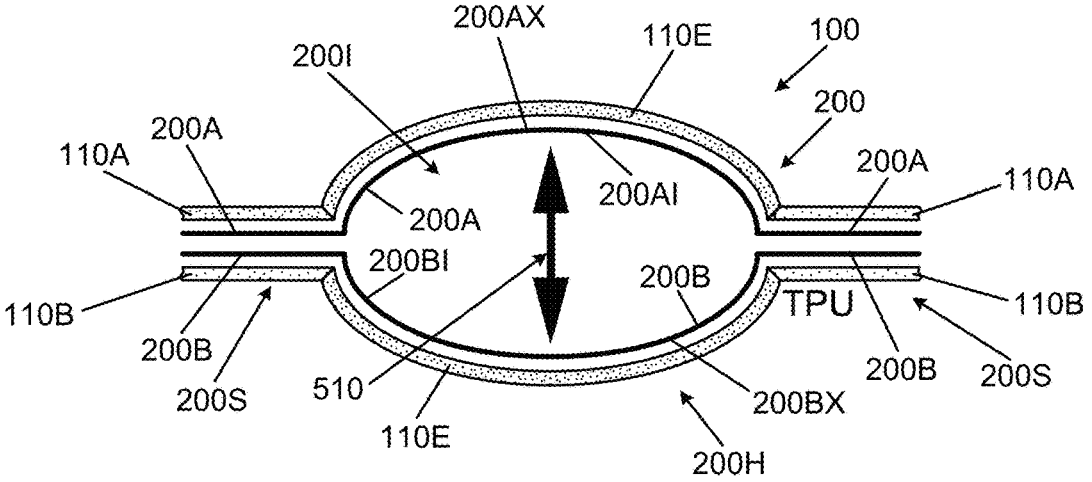

FIGS. 5A-5C illustrate additional examples of "two way" bladder 200 expansion. FIG. 5A illustrates a footwear upper 500 including a footwear upper blank 302 (e.g., made from one or more fabric components) having a footwear upper component 100 with an attached bladder 200 of the types described above (FIGS. 1-2J) engaged with it. If desired, a component of footwear upper blank 302 may comprise one of fabric components 110, 120 shown in FIG. 2J.

FIG. 5B provides a cross sectional view of one example of this type of footwear upper component 100 as a separate component from footwear upper blank 302. While FIG. 5B shows fabric components 110A, 110B as TPU materials engagable with the first sheet or layer of thermoplastic polymer material 200A and the second sheet or layer of thermoplastic material 200B, respectively, by adhesive free bonds, either or both of these fabric engagements shown in FIG. 5B may be adhesive based bonds. In this illustrated example, fabric component 110A is mounted to the first sheet or layer of thermoplastic polymer material 200A (e.g., only at the seam 200S area) such that both of fabric component 110A and the first sheet or layer of thermoplastic polymer material 200A form the exterior layer of the footwear upper component 100. The exterior surface 200AX of the bladder 200 (formed by first sheet or layer of thermoplastic material 200A) is exposed at areas inside the outer perimeter seam 200S in this illustrated example. Also, in this illustrated example, fabric component 110B is mounted to the second sheet or layer of thermoplastic polymer material 200B. Fabric component 110B of this example includes an elastic component 110E (e.g., a fabric component) that extends at least partially across (and at least partially covers (and optionally completely covers)) the exterior surface 200BX of bladder 200 component (formed by the second sheet or layer of thermoplastic polymer material 200B). Fabric components 110A, 110B extend outward beyond outer perimeter seam 200S in this illustrated example (although one or both of the fabric components 110A, 110B need not do so in some examples of this technology). Also, in some examples of this technology, the elastic component 110E may be provided on the first sheet or layer of thermoplastic polymeric material 200A rather than on the second sheet or layer of thermoplastic polymeric material 200B as shown in FIG. 5B (i.e., elastic component 110E may be flipped vertically from its position shown in FIG. 5B). The elastic component 110E may be positioned at locations where increased displacement of the bladder 200 is desired. For example, in a final footwear product, if desired, the elastic component 110E of FIG. 5B may face inward with respect to the footwear upper to contact and/or apply force to the wearer's foot, e.g., at the heel and/or ankle area.

The structure of FIG. 5C is similar to that shown in FIG. 5B, but in FIG. 5C, the exterior surface of the bladder 200's sealed interior chamber 200I (formed by exterior surface 200AX) also is at least partially covered (and optionally completely covered) with an elastic component 110E.

In the illustrated examples of FIGS. 5A-5C, fluid pressure inside interior chamber 200I will tend to cause the bladder 200 to displace outwardly (upwardly and downwardly in FIGS. 5B and 5C; see arrows 510) and stretch the elastic component 110E adjacent the interior chamber 200I. When the example footwear upper 500 of FIG. 5A is incorporated into an article of footwear (e.g., see FIG. 9E), the interior chamber 200I may be in open fluid communication at all areas inside perimeter seam 200S. In use, force applied to the instep oriented bladder chamber(s) 200T, e.g., via a footwear securing strap, by bending of the wearer's foot (when taking a step, initiating or landing a jump, etc.), etc., may cause fluid to move to the heel and/or ankle support chamber(s) 200H via fluid line 206. Such movement of fluid: (a) will cause the bladder 200 upper (exterior) surface to deflect outward and (b) will cause the bladder 200 lower (interior) surface to deflect inward into the overall footwear upper 300. See double headed deflection arrows 510 in FIGS. 5B and 5C. This deflection of the bladder 200 will stretch elastic component(s) 110E and provides additional fluid to support the wearer's heel and/or ankle and/or may improve comfort and fit (e.g., by eliminating excess space in the shoe interior and/or reducing foot movement within the shoe). This deflection also may provide a visual indication of the movement of fluid (due to the bladder 200's outer surface deflection). The elasticity of fabric component(s) 110E may be selected and/or altered to control the amount and/or direction of displacement of the bladder 200's sealed interior chamber 200I. Additionally or alternatively, when top and bottom elastic fabric components 110E are provided as in FIG. 5C, the relative elasticity of these two elastic fabric components 110E may be selected and/or altered (i.e., their elasticities may be the same or different and the differences may be controlled) to control the relative amounts of displacement of the surfaces 200AX and 200BX of the bladder 200's sealed interior chamber 200I.

Figure 6A:
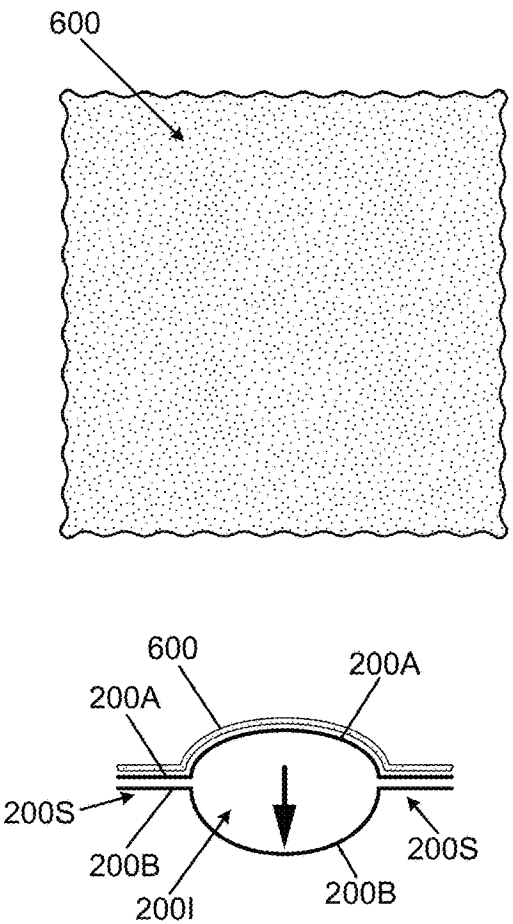
FIGS. 6A-6E show various examples of pressing techniques that may be used to form footwear upper components in accordance with at least some aspects of this technology.

As described above, the bladder 200 and fabric components 110, 120 may be engaged together (e.g., by an adhesive based bond, by an adhesive free bond, etc.) using heat and pressure (e.g., to activate a hot melt adhesive, to perform localized melting, etc.). FIGS. 6A-6E provide information regarding various pressing techniques that may be used in some examples of this technology. FIG. 6A illustrates an example of a full press in which a silicone press pad 600 is applied over the bladder 200. The bottom of the bladder 200 can be supported at the seam 200S area to allow application of heat and pressure at the seam 200S. In some methods, the bottom of interior chamber 200I of the bladder 200 may be unsupported (e.g., mounted over a hole or recess) so that the interior surfaces 200AI, 200BI of the bladder 200's interior chamber 200I do not bond together.

Figure 6B:
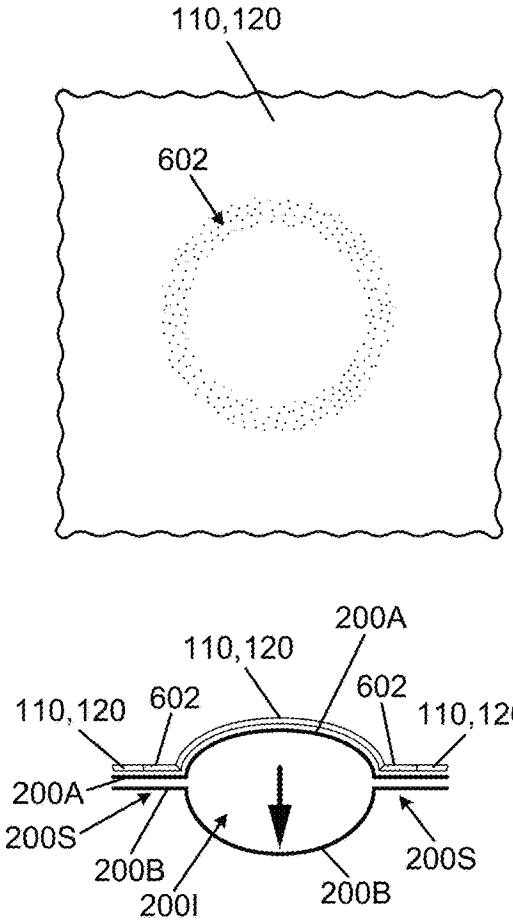

FIG. 6B illustrates a zonal press technique. In this instance, the silicone press pad 602 is shaped as a closed loop or ring (not necessarily round, but forming a closed perimeter have the shape of the desired bladder 200 seam 200S) and presses a fabric component 110, 120 to bond fabric component 110, 120 to the bladder 200 at the seam 200S area. Because little pressure is applied to the first sheet or layer of thermoplastic polymer 200A by the fabric component 110, 120 outside of the press pad 602, the bladder 200's interior chamber 200I remains unbonded and open. The fabric component 110, 120 attaches (adhesively or adhesive free) to the bladder 200 at the seam 200S (due to the ring shaped press pad 602), but the fabric component 110, 120 remains unattached at other locations. This pressing technique also bonds the first and second sheets or layers of thermoplastic polymer material 200A, 200B together (adhesively or in an adhesive free manner).

Figure 6C:
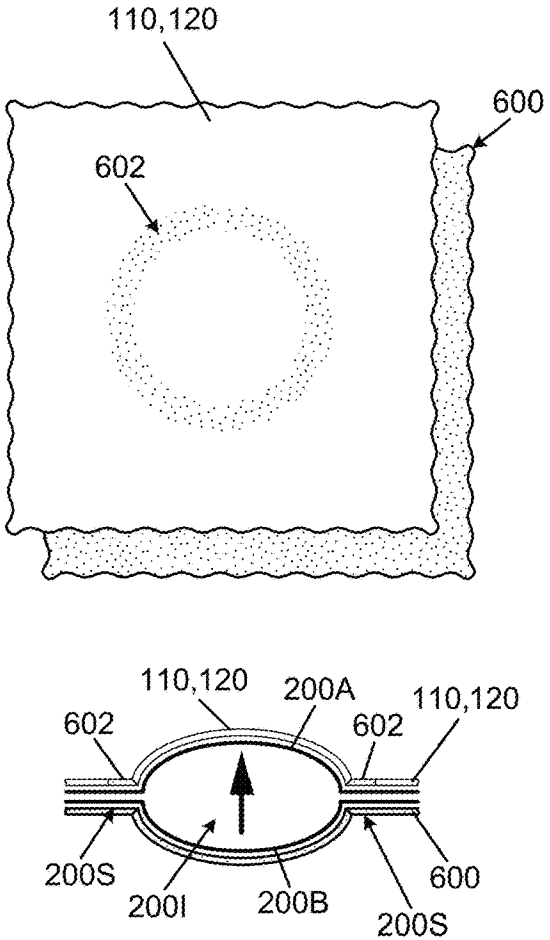

FIG. 6C illustrates a pressing technique where a full press (e.g., FIG. 6A) is provided on one side and a zonal press (e.g., FIG. 6B) is provided on the opposite side. A ring shaped silicone press pad 602 of this example is shaped to form the shape of the bladder 200's interior chamber 200I. In this manner, fabric component 110, 120 can be bonded with the bladder 200 at the seam 200S and the two sheets or layers of thermoplastic polymer material 200A, 200B can be bonded together in a manner similar to that described above in FIG. 6B.

Figure 6E:
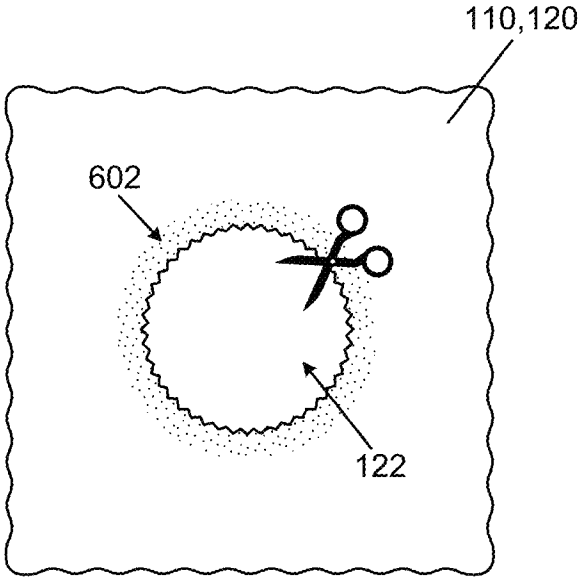
Figure 6E:
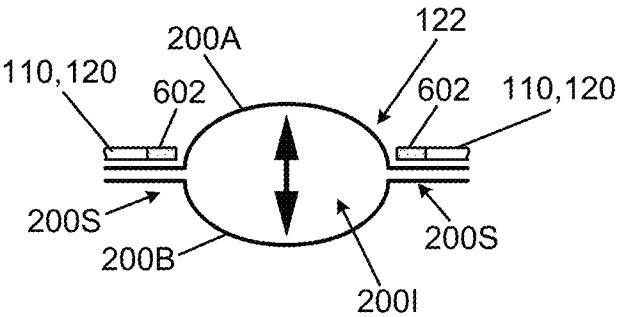
Figure 6D:
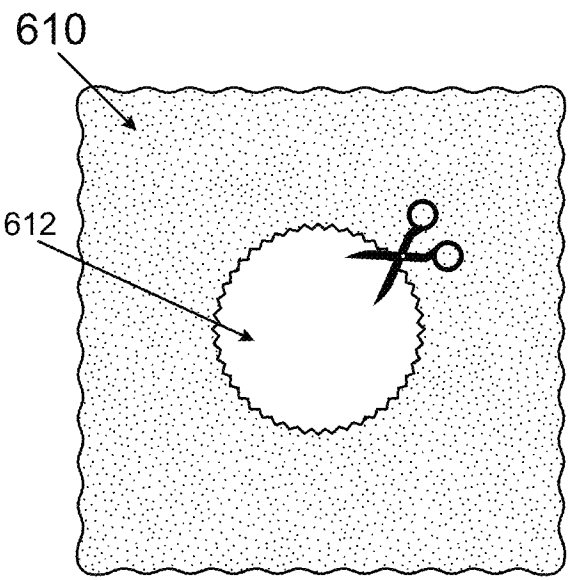
Figure 6D:
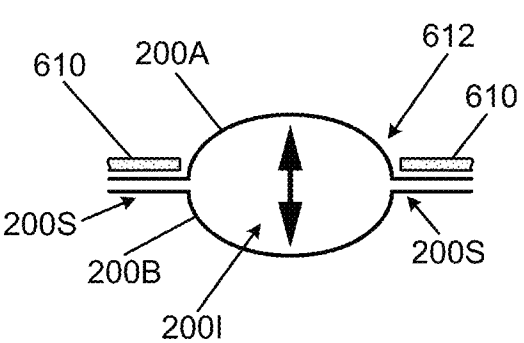

FIG. 6D illustrates an example pressing technique in which the silicone pressure pad 610 includes an opening 612 (e.g., shaped like the desired bladder 200's sealed interior chamber 200I). When heat and pressure are applied by the silicone pressure pad 610, the outer perimeter seam 200S is formed and the remainder of the bladder 200's layers (the first sheet or layer of thermoplastic polymeric material 200A and the second sheet or layer of thermoplastic polymeric material 200B) remain unattached to thereby form the sealed interior chamber 200I.

FIG. 6E illustrates an example pressing technique using a ring shaped silicone pressure pad 602 and a fabric component 110, 120 that each has an opening 122 formed in it. The opening 122 and the ring shaped silicone pressure pad 602 may be shaped to correspond to the desired bladder 200's seam 200S and/or sealed interior chamber 200I. The opening 122 (as well as any opening used to form bulged region 112 discussed above) may be formed as a cutout, may be formed directly in the pressure pad 602 and/or fabric component 110, 120 during its fabrication (e.g., during knitting of fabric component 110, 120), etc. When heat and pressure are applied by the silicone pressure pad 602, the outer perimeter seam 200S is formed and the remainder of the bladder 200's layers (the first sheet or layer of thermoplastic polymeric material 200A and the second sheet or layer of thermoplastic polymeric material 200B) remain unattached to thereby form the sealed interior chamber 200I.

Under any of the pressing techniques described above in conjunction with FIGS. 6A to 6E, one or more fabric components 110, 120 may be included in the pressing step. If a fabric component 120 is to be used that will not itself create an adhesive free bond with the bladder 200 under the pressing conditions, an adhesive (e.g., a hot melt adhesive) may be applied to the fabric component 120 and/or to the first and/or second sheet or layer of thermoplastic polymer material 200A and/or 200B. In some aspects of this technology, a single heating and pressing step will be used to create both the sealed bladder 200 and join it to the fabric component(s) 110/120 to form the overall footwear upper component 100 (e.g., of the types shown in FIGS. 2A-2J).

Figure 7A:
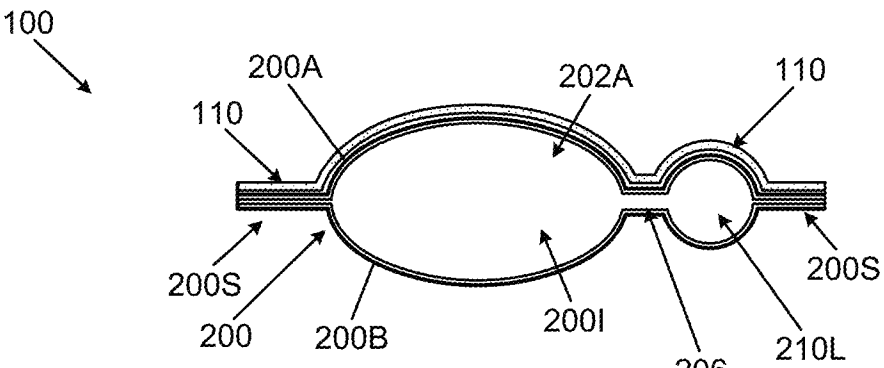
FIGS. 7A and 7B illustrate structures and methods for forming interconnected bladder chambers in accordance with some aspects of this technology.

FIG. 7A provides a cross sectional view of a portion of the bladder 200 with a fabric component 110 attached to it. In this illustrated example, the bladder 200 includes a first chamber (e.g., an instep chamber like chamber 200T shown in FIGS. 3A, 4A, and 5A and like chamber 202A shown in FIGS. 9A, 9C-9E), another chamber (e.g., a heel and/or ankle support chamber like chamber 200H shown in FIGS. 3A, 4A, and 5A and like chamber 210L shown in FIGS. 9A, 9C-9E), and a fluid line (e.g., like fluid line 206 shown in FIGS. 3A, 4A, 5A, 9A, and 9C-9E) interconnecting the other two chambers (202A, 210L) and placing the other two chambers in fluid communication with one another. The fabric component 110 shown in FIG. 7A may be engaged with the entire exterior surface of the first sheet or layer of thermoplastic polymer material 200A (e.g., in an adhesive free manner) or it may just be engaged with the exterior surface of the first sheet or layer of thermoplastic polymer material 200A at the locations of the seam 200S. During the pressing step (when applying heat and pressure), the pressing pad (e.g., see FIGS. 6A-6E) may include a gap at locations corresponding to chamber 202A, chamber 210L, and fluid line 206. As another option, adhesive material may be omitted on the interior surfaces of the bladder chamber 200I at locations where the chambers 202A, 210L and/or fluid line 206 are to be produced (so the interior surfaces 200AI, 200BI do not bond where the interior chamber(s) is (are) desired). Sealed and interconnected fluid chambers 202A, 210L are provided by the illustrated structures and methods. The bonds forming the seam 200S and the bonds forming the junction between the first sheet or layer of thermoplastic polymer material 200A and the fabric component 110 may be adhesive free and/or adhesive based.

Figure 7B:
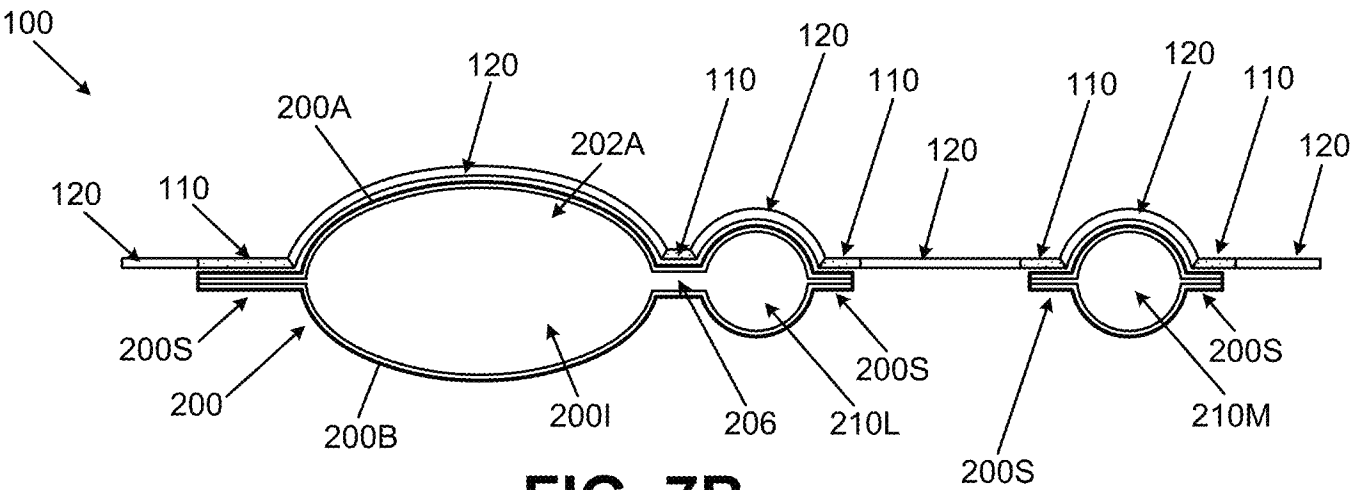

FIG. 7B provides a cross sectional view of another portion of a bladder 200 with two different types of fabric components 110, 120 engaged with it. In this illustrated example, fabric component 110 represents a fabric component (e.g., a knit component) made from or including a TPU component that is capable of forming an adhesive free bond with the first sheet or layer of thermoplastic polymer material 200A under the heat and pressure conditions to be used. Fabric component 120, on the other hand, represents a fabric component (e.g., a polyester knit component) that is not capable of forming an adhesive free bond with the first sheet or layer of thermoplastic polymer material 200A under the heat and pressure conditions to be used. Fabric component 110 is provided at the seam areas 200S. If desired, fabric component 110 also may be provided over a fluid line area 206. Fabric component 120 is provided at locations corresponding to the exterior surface of the sealed interior chamber 200I of the various fluid chambers 202A, 210L, 210M. Because fabric component 120 does not bond with the first sheet or layer of thermoplastic polymer material 200A at these areas, the fabric component 120 may move with respect to the first sheet or layer of thermoplastic polymer material 200A, it may stretch, etc. Fabric component 120 also is provided in areas between bladder chambers (e.g., between bladder chambers 210L and 210M in this example) and outside of the bladder seam 200S. Fabric components 110, 120 may form distinct portions of a single and continuous piece of fabric.

Figure 8:
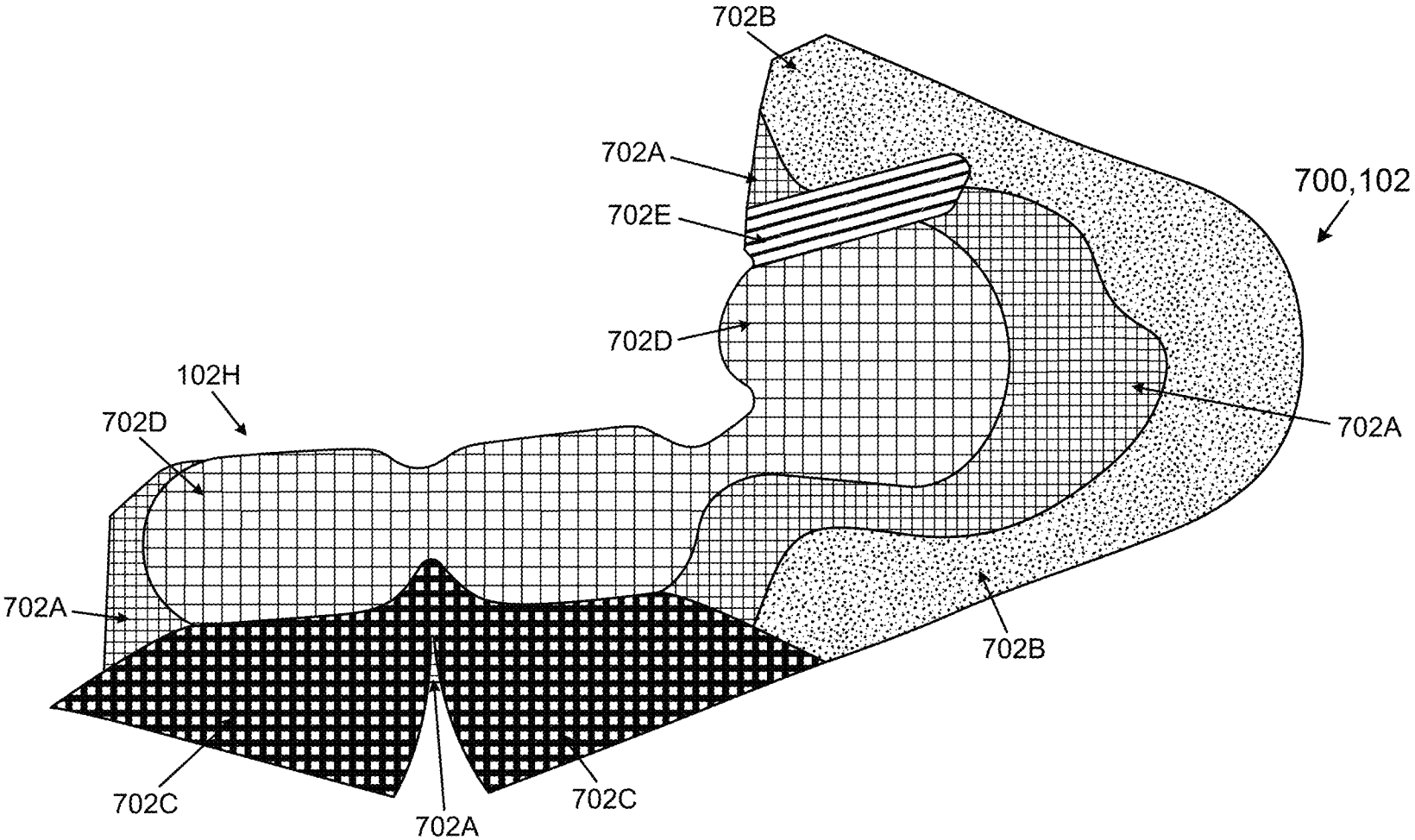
FIG. 8 illustrates a footwear upper blank that may be included in footwear components and structures in accordance with at least some examples of this technology.

FIG. 8 illustrates an upper blank 700 showing different potential fabrics or other materials for components of a footwear upper base 102 in accordance with some examples of this technology. Such a combination of components may be used, for example, in the uppers and/or articles of footwear described above (e.g., the uppers 300, 400, and 500 of FIGS. 3A, 4A, and 5A) and those described in more detail below. FIG. 8 shows an upper blank 700 formed from five different fabric components 702A, 702B, 702C, 702D, and 702E that are fixed together in any appropriate manner (e.g., by one or more of sewing, adhesives, melt bonding, etc.). Fabric component 702A forms a base component of the footwear upper base 102, and this fabric component 702A may be formed, for example, from a fabric comprising a chenille fabric with medium sized mesh openings. This fabric component 702A forms instep and heel regions of the footwear upper base 102. If desired, the fabric component 702A may underlie some or all of other fabric components, e.g., some or all of fabric components 702B-702D).

A denser chenille fabric component 702B is engaged with the front and midfoot-to-forefoot sides of fabric component 702A in this example. This denser fabric component 702B provides enhanced durability and abrasion resistance and provides a stable and/or strong base for engaging one or more components of a sole structure. Another dense chenille fabric component 702C with small mesh openings is engaged with fabric component 702A at the heel-containing region 102H of the footwear upper base 102. Fabric component 702C also may provide durability, abrasion resistance, and/or a stable and/or strong base for engaging one or more sole structure 104 components.

Fabric component 702D of this example comprises a thermoplastic polyurethane ("TPU") containing fabric component, e.g., a fabric component, optionally a knit fabric component, including at least one yarn formed from a TPU material and/or coated with a TPU material. This fabric component 702D forms a base for engaging components of a bladder 200, e.g., in an adhesive free manner (e.g., in melt bonded or welded manners, using heat and pressure, or the like, as described above). Fabric component 702D may be formed as a mesh with relatively large openings, e.g., to enhance breathability.

Fabric component 702E of this example upper blank 700 is located at a medial side of the upper blank 700. Fabric component 702E may comprise an elastic or elastomeric component, such as a stretchable chenille fabric, that helps provide comfort, stretches to enable easy donning and doffing, and/or helps hold the overall footwear upper to a wearer's foot.

Figure 9A:
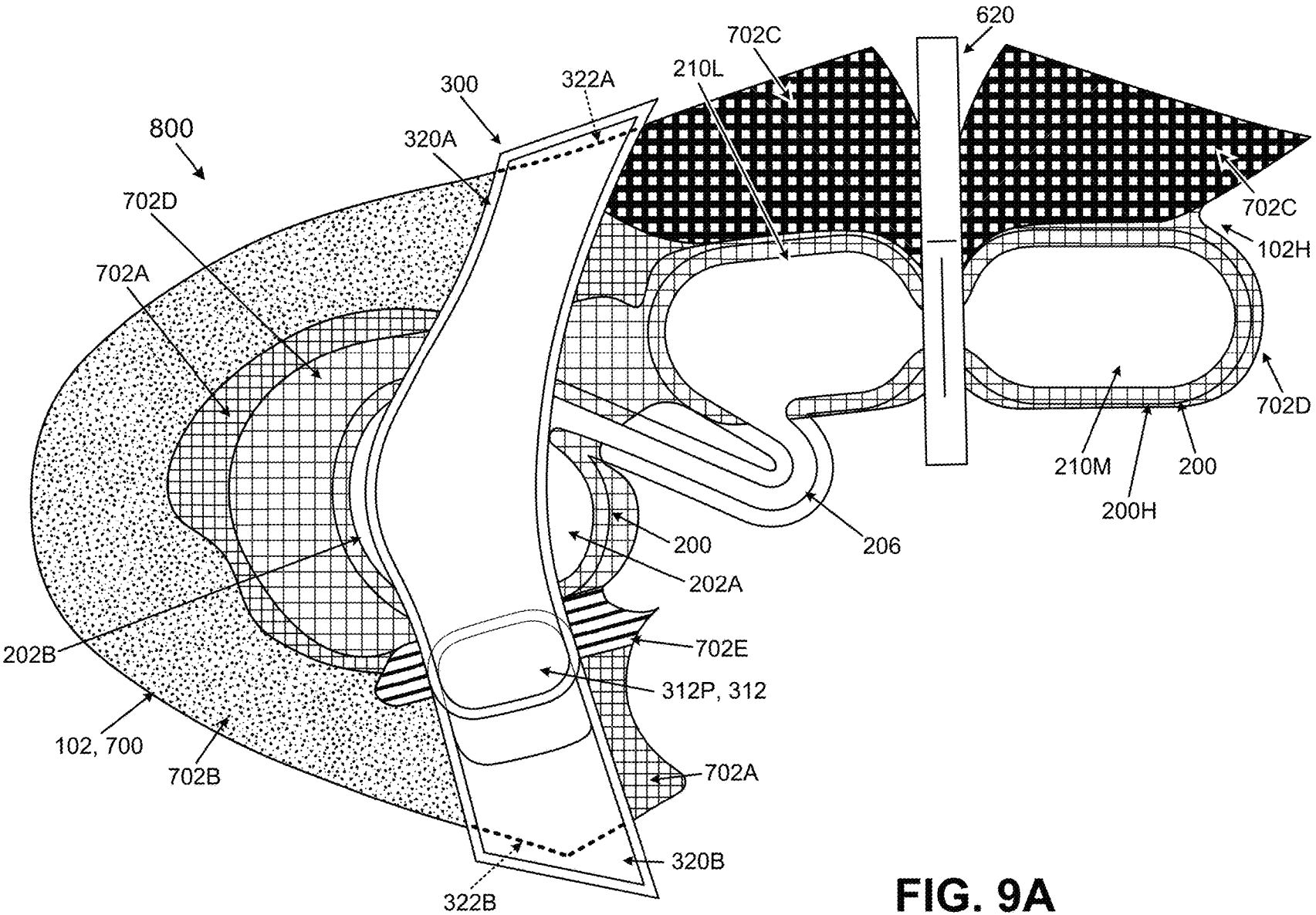
FIGS. 9A-9E illustrate footwear uppers, footwear components, articles of footwear, and footwear manufacturing methods in accordance with at least some examples of this technology.

FIG. 9A illustrates an overall footwear upper 800 as footwear upper blank 700 with additional footwear components attached to it. FIGS. 9B-9E illustrate various component parts of the overall footwear upper 800 and features of the manner of making it. In a first step, the footwear upper blank 700 is formed, e.g., to the structure shown in FIG. 9B (and similar to the structure shown and described above in conjunction with FIG. 8). In this example, six component parts of a footwear upper blank 700 are engaged together, e.g., by one or more of sewing, adhesives, melt bonding (using heat and pressure), mechanical connectors (e.g., rivets, crimped metal rings, etc.), and the like. The six parts include components 702A (as a base component), 702B (as a forefoot and midfoot reinforcing component), 702C (as a heel reinforcing component), 702D (as a bladder support base component), 702E (as a stretch component to support foot insertion/removal), and heel loop 620. The component parts 702A-702E may be made from the materials described above in conjunction with FIG. 8 or from one or more different materials.

Figure 9B:
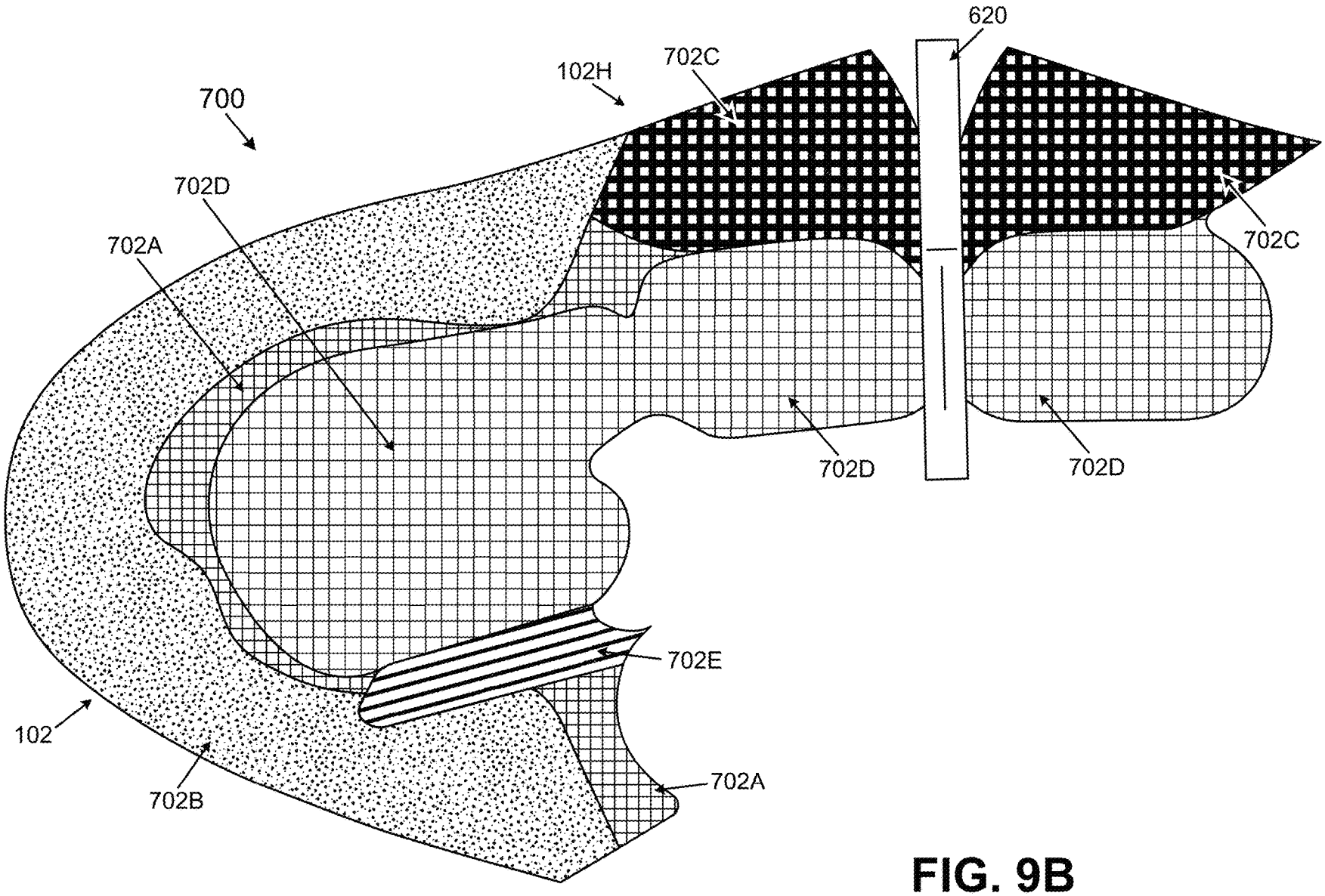
Figure 9C:
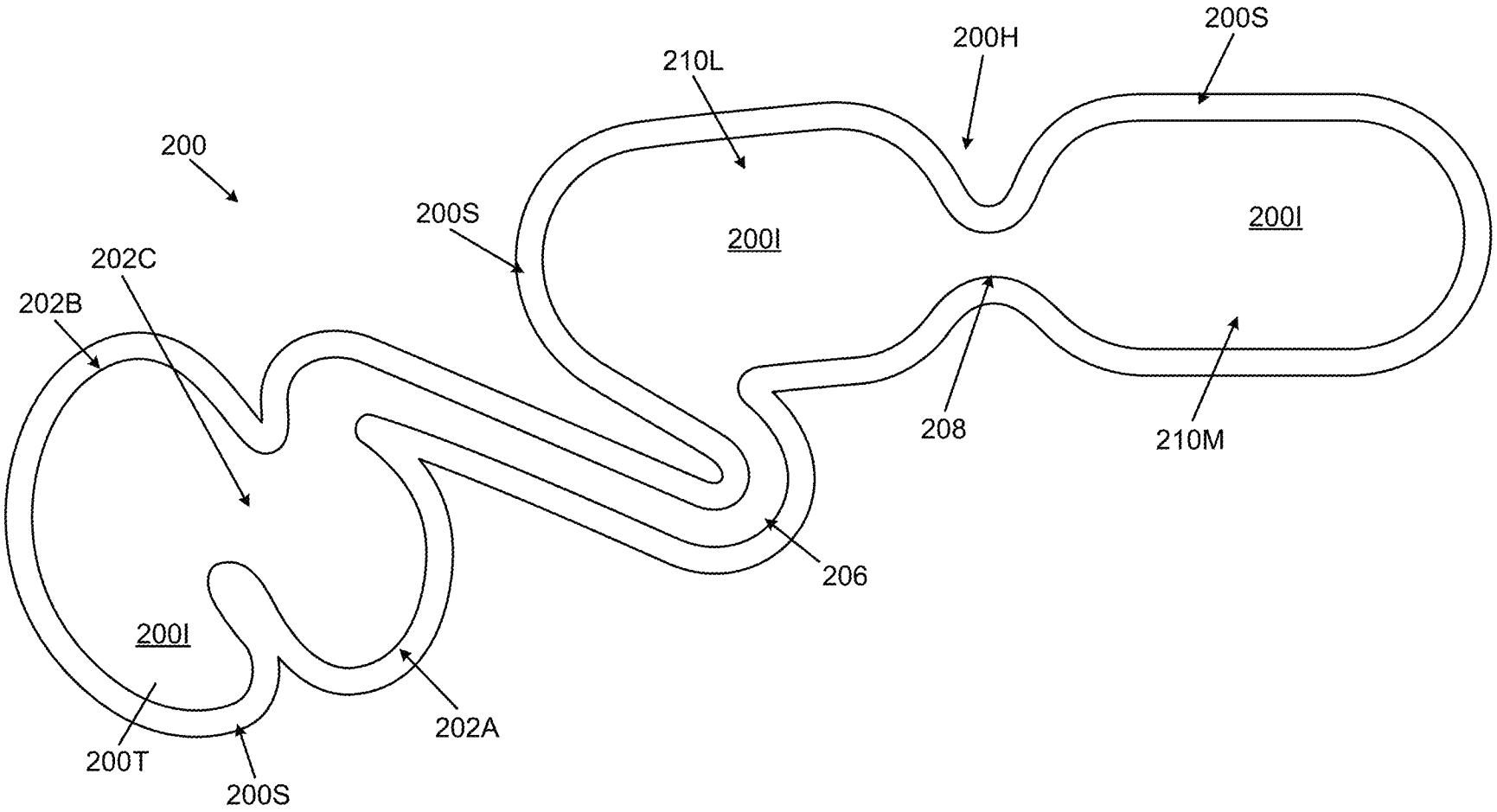

FIG. 9C shows an example bladder 200 component for this upper 800 and article of footwear. The bladder 200 includes a first thermoplastic sheet (e.g., the top sheet) and a second thermoplastic sheet (e.g., a bottom sheet) facing the first thermoplastic sheet as described above. The two thermoplastic sheets (which may be formed from two (or more) separate sheets or a single sheet (e.g., folded over at one edge) are sealed together by a continuous outer perimeter seam 200S. This sealed engagement can be accomplished using adhesives (e.g., a hot melt adhesive) or in an adhesive free manner, e.g., using any of the techniques described above.

The first thermoplastic sheet 200A, the second thermoplastic sheet 200B (not shown in FIG. 9C but shown in other figures), and the continuous outer perimeter seam 200S define a sealed interior volume 200I for containing a gas or other fluid. The continuous outer perimeter seam 200S forms the outermost exterior perimeter of the bladder 200 in this example. As illustrated in FIG. 9C, the continuous outer perimeter seam 200S extends continuously to form the sealed interior volume to include: (i) at least one fluid supply chamber (two chambers 202A and 202B shown connected by a connecting portion 202C) having a first major surface formed by the first thermoplastic sheet (an outermost exterior surface 200AX of the bladder 200), (ii) a first heel and/or ankle support chamber (lateral heel and/or ankle support chamber 210L in this example), (iii) a first fluid line 206 connecting the fluid supply chamber(s) 202A, 202B and the first heel and/or ankle support chamber 210L through the sealed interior volume 200I, (iv) a second heel and/or ankle support chamber (medial heel and/or ankle support chamber 210M in this example), and (v) a second fluid line 208 connecting the first heel and/or ankle support chamber 210L and the second heel and/or ankle support chamber 210M through the sealed interior volume 200I. In the illustrated example bladder 200, all portions of the sealed interior volume 200I defined by the first thermoplastic sheet, the second thermoplastic sheet, and the continuous outer perimeter seam 200S are in fluid communication with one another. Also, while FIG. 9C shows bladder 200's thermoplastic sheets engaged together only by the continuous perimeter seam 200S, other seams may be provided, such as interior weld lines, interior weld dots, or interior weld regions, e.g., to provide shape control to the bladder 200.

As further shown in FIG. 9C, the first heel and/or ankle support chamber 210L and the second heel and/or ankle support chamber 210M are in fluid communication only via the second fluid line 208. In at least some examples of bladders 200, the bladder chambers and the sealed interior volume 200I may be sized and shaped such that one or both of a first volume defined by the first heel and/or ankle support chamber 210L and a second volume defined by the second heel and/or ankle support chamber 210M is/are at least 5 times greater than a third volume defined by the second fluid line 208 connecting chambers 210L and 210M. In still other examples, the first volume and/or the second volume will be at least 8 times greater, at least 10 times greater, at least 12 times greater, or even at least 15 times greater than the third volume. Additionally or alternatively, in at least some examples of bladders 200, an axial length of the second fluid line 208 from the first heel and/or ankle support chamber 210L to the second heel and/or ankle support chamber 210M will be less than 35 mm, and in some examples, less than 30 mm, less than 25 mm, less than 20 mm, or even less than 15 mm. The second fluid line 208 may have a length of at least 4 mm in the example ranges provided above.

Figure 9D:
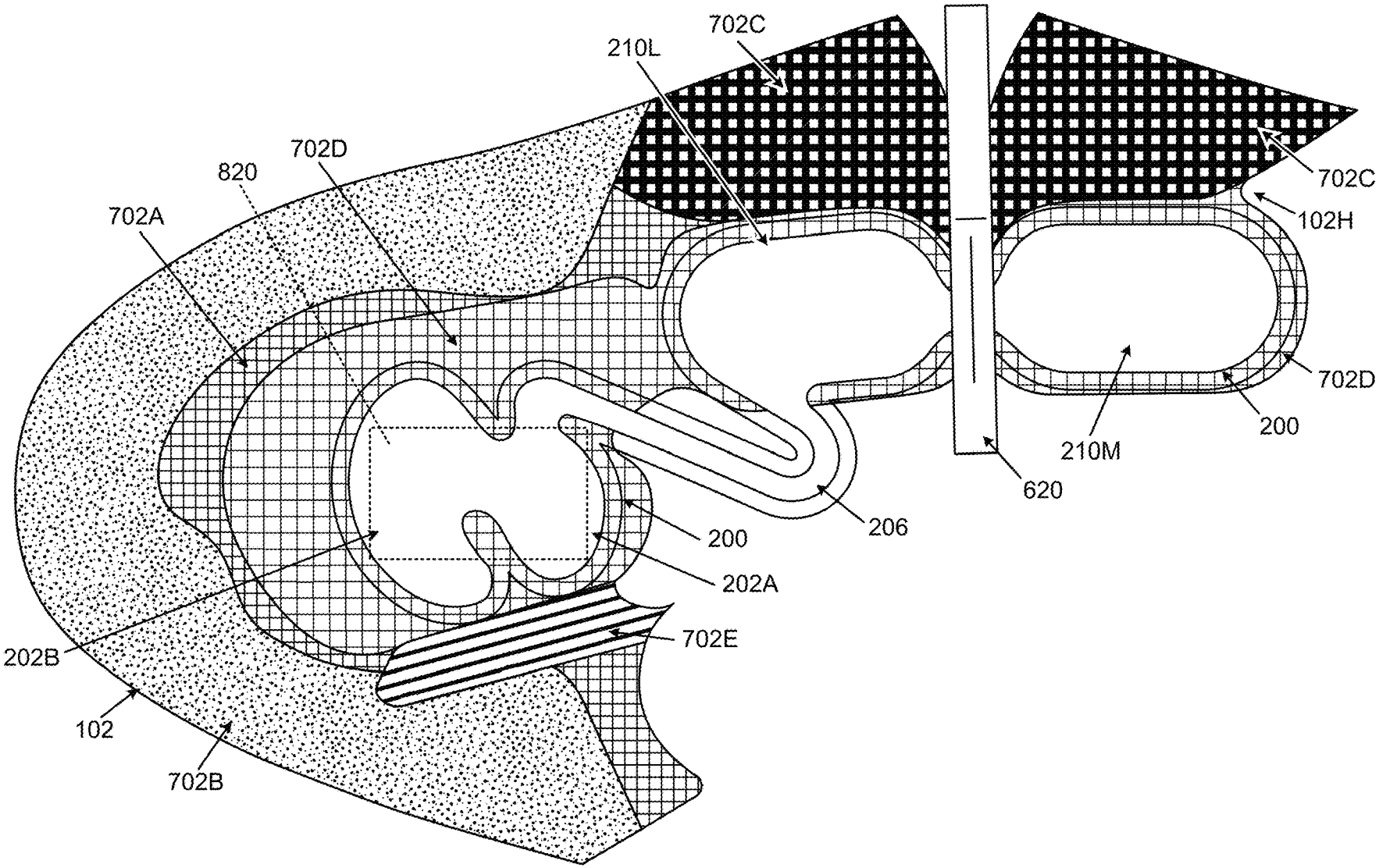

FIG. 9D illustrates the step of engaging the bladder 200 (e.g., of FIG. 9C) with the footwear upper base 102 (e.g., with component 702D shown in FIG. 9B). In some examples, this step may occur when the footwear upper base 102 is in the form of the upper blank 700 (e.g., a flat upper blank 700) and the bladder 200 is in an uninflated condition. As some more specific examples, the uninflated bladder 200 can be positioned atop footwear upper base 102 fabric component 702D, which, as noted above, may be formed at least in part from a TPU containing fabric component, e.g., a fabric component, optionally a knit fabric component, including at least one yarn formed from a TPU material and/or coated with a TPU material. Heat and pressure may be applied, e.g., to locally melt or soften the thermoplastic materials of the fabric component 702D and the bladder 200 to thereby melt or soften and/or bond fabric component 702D and bladder 200 together in an adhesive free manner. Additionally or alternatively, other ways of engaging the footwear upper base 102 materials and the bladder 200 may be used, including adhesive based engagement, mechanical fasteners, sewn seams, or the like.

Figure 9E:
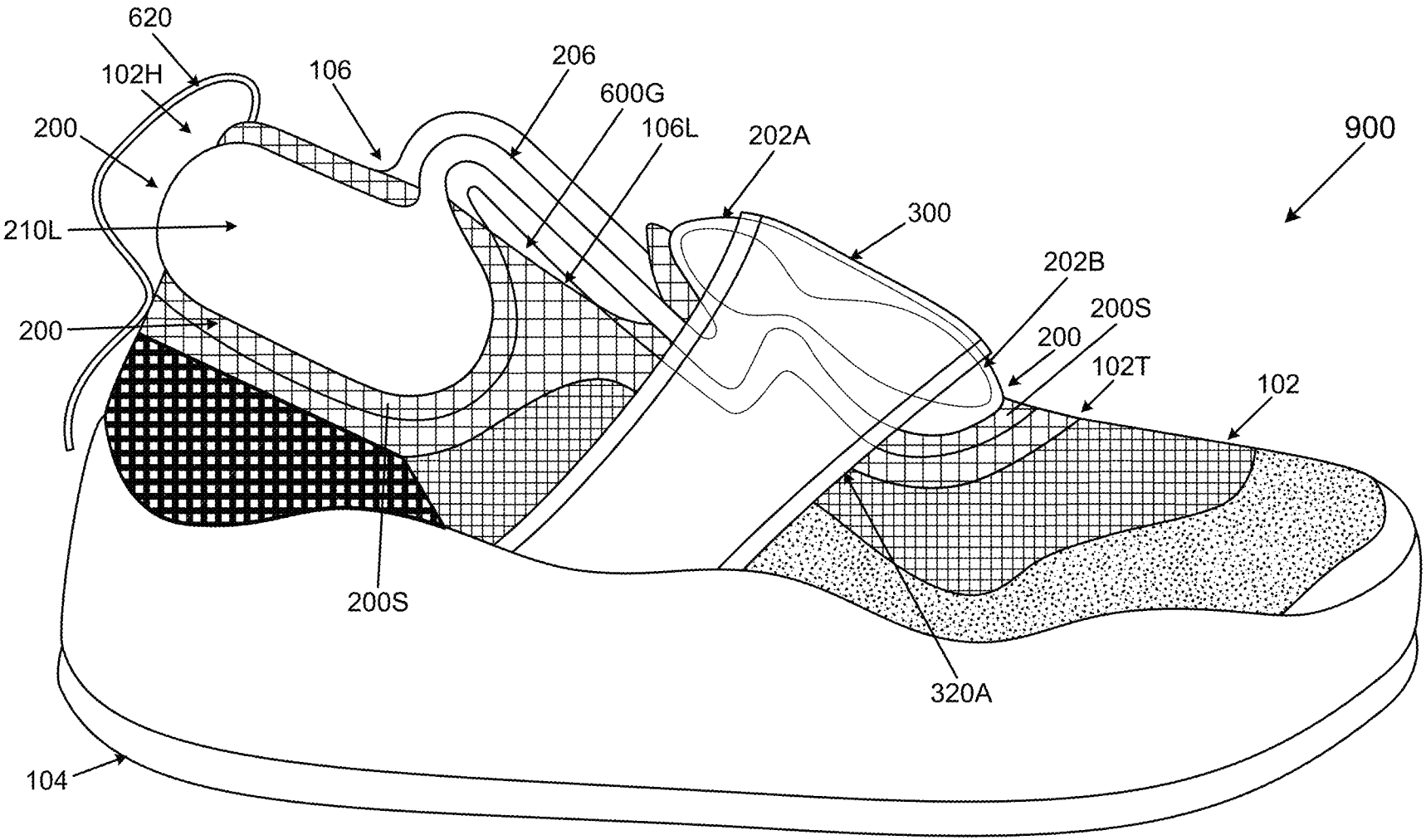

FIG. 9E illustrates the upper 800 engaged with a sole structure 104 to form an overall article of footwear 900. The overall article of footwear 900 of this example further includes two straps 320A, 320B of a strap system 300. As shown in FIG. 9A, these straps 320A, 320B may be incorporated into the footwear upper 800 (e.g., engaged with one or more of the footwear upper base 102 components, such as one or more of components 702A, 702B, and/or 702C). Engagement may occur via one or more of sewn seams 322A, 322B (see FIG. 9A), adhesives, mechanical fasteners, or the like. Additionally or alternatively, if desired, the ends of either or both straps 320A, 320B may be engaged with the sole structure 104 of the article of footwear 900 and/or sandwiched between the footwear upper 800 (e.g., a bottom surface of the upper 800, one of components 702A-702D, etc.) and the sole structure 104. FIG. 9A illustrates the footwear upper 800 as an upper blank (including footwear upper base 102 components), the attached bladder 200, and the attached strap system 300. This footwear upper 800 optionally may be engaged with an upper bottom component (e.g., a strobel) by stitching. Then, the overall footwear upper 800 (including the bottom component) may be engaged with a sole structure 104 (e.g., as shown in FIG. 9E), e.g., in conventional manners as are known and used in the footwear art (e.g., by one or more of adhesives, mechanical connectors, sewn seams, etc.).

Figure 11:
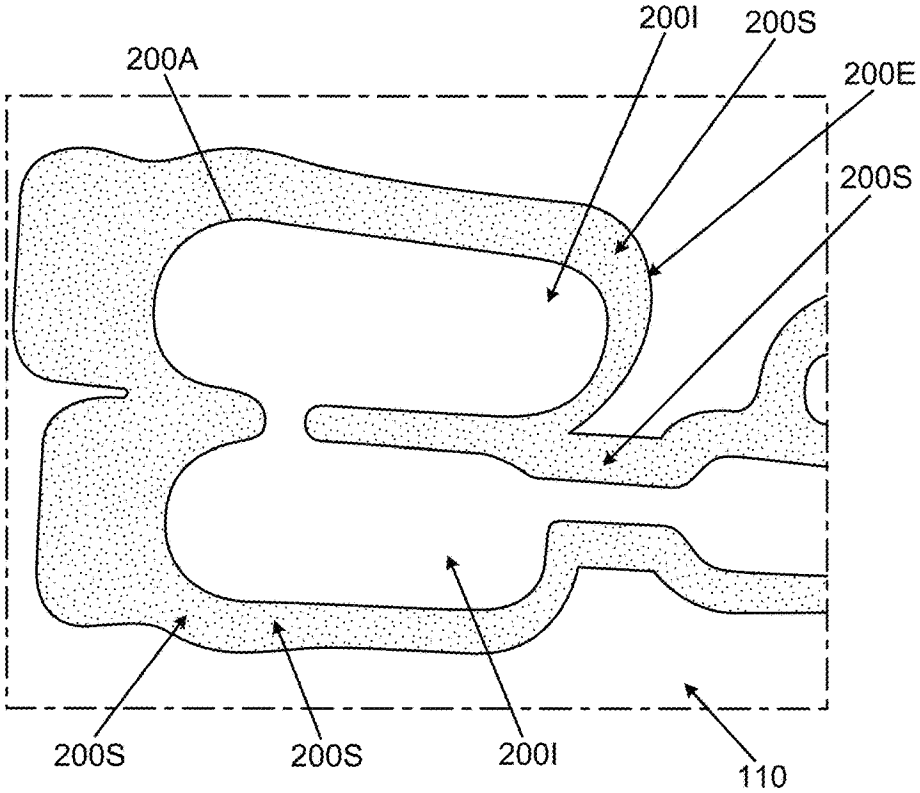
FIGS. 10-12B illustrate additional features of bladders and/or footwear upper components in accordance with at least some examples of this technology.
Figure 10:
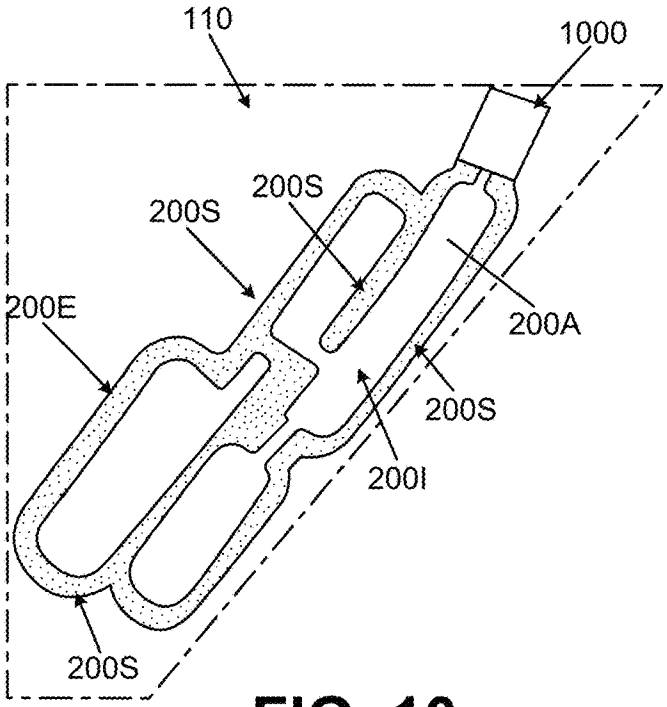
Figure 12A:
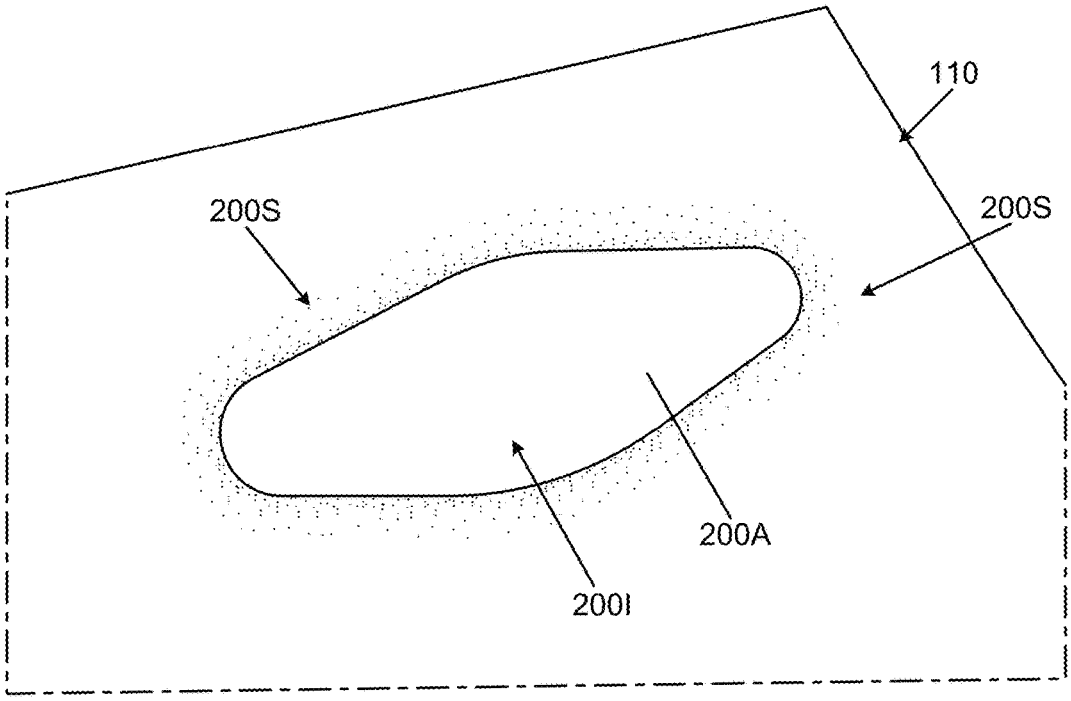
Figure 12B:
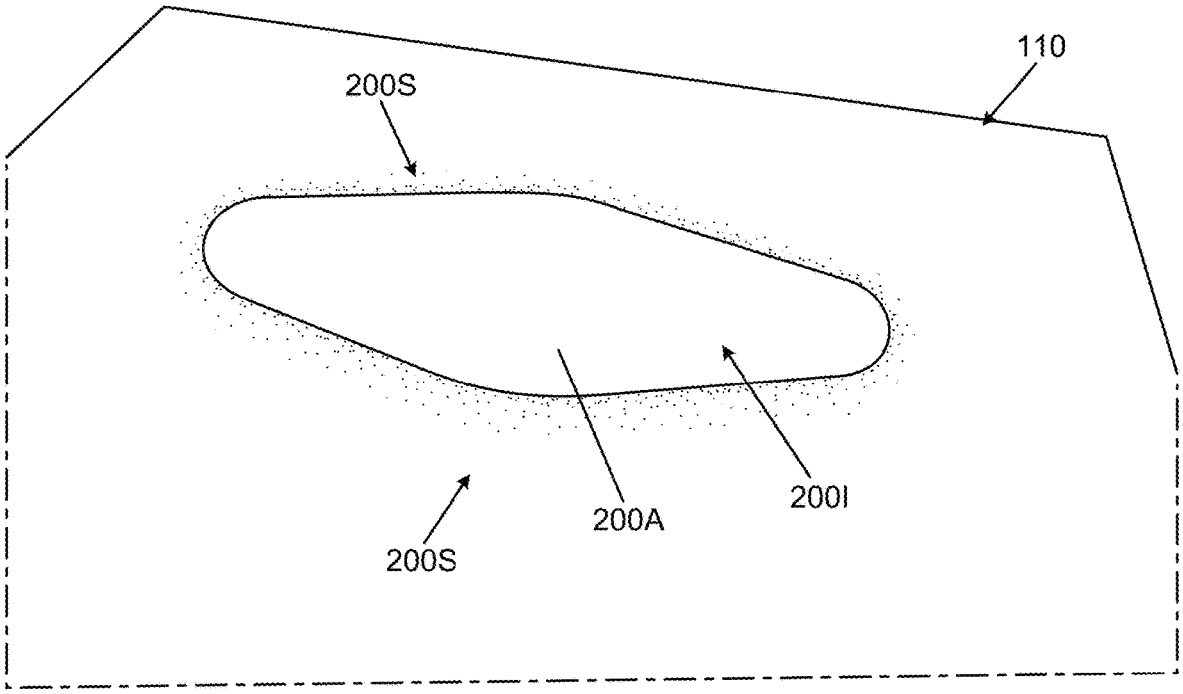

As previously described, FIG. 1 illustrates a bladder 200 engaged with a fabric component 110 in an adhesive free manner (or with adhesive based bonding, if desired). FIG. 1 shows the bladder 200 engaged in a deflated condition, e.g., flat pressed using heat and pressure to form at least seam 200S. FIGS. 10 and 11 illustrate portions of additional example bladder 200 components engaged with fabric components 110. Like the example of FIG. 1, the bladders 200 of FIGS. 10 and 11 may be engaged with the fabric component 110 in a deflated condition (e.g., by flat pressing using heat and pressure). The bladders 200 then may be inflated, e.g., via an inflation port, to the conditions shown in FIGS. 10 and 11. Once inflated, the inflation port may be sealed, cut off, and discarded. A small portion of the inflation line 1000 for the bladder 200 is shown in FIG. 10.

FIGS. 10 and 11 illustrate relatively distinct bladder edges 200E at the outer edge of the outer perimeter seam 200S, i.e., where the bladder 200 ends and uncovered fabric component 110 begins. FIG. 1, on the other hand, shows somewhat less of a distinct edge. The heat and pressing conditions (e.g., pressing force, pressing temperature, pressing time) and/or the material specifications (e.g., thickness of the first and/or second sheet or layer of thermoplastic polymer material 200A/200B) may affect the degree to which the distinct edge 200E disappears in a final bladder 200/fabric component 110 (or 120) product. For example, as compared to the distinct edges 200E shown in FIGS. 10 and 11, FIGS. 12A and 12B illustrate a bladder 200/fabric component 110 combination in which it is more difficult to discern exactly where the physical edge of the bladder 200 is located. Longer press times, higher press temperatures, higher pressing forces, and/or thinner bladder materials may enable the bladder 200 material (e.g., first and/or second sheet or layer of thermoplastic polymer material 200A/200B) and/or any meltable material in the fabric component 110 (e.g., a TPU material) to melt and mix to a greater extent, thereby eliminating or reducing the prominence of a distinct and/or regular edge (like edge 200E shown in FIGS. 10 and 11). In some examples, the material of the outer perimeter seam 200S and at least some of the fabric component 110 will mix and/or intermingle together under the pressing conditions to engage the bladder 200 and fabric component 110 together.

Examples of methods of making footwear upper components 100 now will be described in more detail. As an initial step, the bladder 200 (in an inflated or uninflated condition) or a bladder precursor is placed on a fabric component 110 or 120. In some examples, the fabric component 110 (e.g., a knit fabric element such as component 702D) will include a first thermoplastic polyurethane component that is capable of forming an adhesive free bond with the first sheet or layer of thermoplastic material (e.g., thermoplastic elastomer material) in the bladder 200 or the bladder precursor. In other examples, the fabric component 120 (e.g., a knit fabric element) will not be capable of forming an adhesive free bond with the first sheet or layer of thermoplastic material (e.g., thermoplastic elastomer material) in the bladder 200 or the bladder precursor under the pressing conditions, and thus an adhesive material (e.g., a hot melt adhesive) may be applied to at least one of the fabric component 120 and the bladder 200 (or bladder precursor).

Heat and pressure then are applied, in one step or in multiple steps: (a) to form a seam 200S to engage the first sheet or layer of thermoplastic polymer material 200A with the second sheet or layer of thermoplastic polymer material 200B and (b) to engage at least a portion of the first sheet or layer of thermoplastic polymer material 200A with fabric component 110, 120, e.g., in an adhesive free manner, in an adhesive based bond, etc. The seam 200S, the first sheet or layer of thermoplastic polymer material 200A, and the second sheet or layer of thermoplastic polymer material 200B define a sealed interior chamber 200I for containing a fluid (e.g., a gas, such as air, nitrogen, etc.).

Once the bladder 200 or bladder precursor is attached to the fabric component 110/120, the sealed interior chamber 200I may be inflated (if it was not already inflated). If necessary, the inflation port may be sealed after inflation is complete, and the port may be trimmed off. Footwear upper components 100 formed by these methods may have any of the specific structures, properties, features, and/or options described above in conjunction with FIGS. 1 to 12B.

In some examples of these methods, a second fabric component will be engaged with the bladder 200 or bladder precursor, e.g., to make a structure like that shown in FIG. 2J. The second fabric component also may be applied using heat and pressure (e.g., with an adhesive based bond or an adhesive free bond), in the same heat and pressing steps described above or in a separate heat and pressing step.

Once the footwear upper component 100 is formed, it may be combined with other footwear upper component parts (if needed, e.g., a strobel or other bottom member) and/or other footwear parts (e.g., a strap system), to form an overall upper 800 like that shown in FIG. 9A. The resulting upper 800 then may be engaged with a footwear sole structure 104, e.g., of the type shown in FIG. 9E.

Figure 13A:
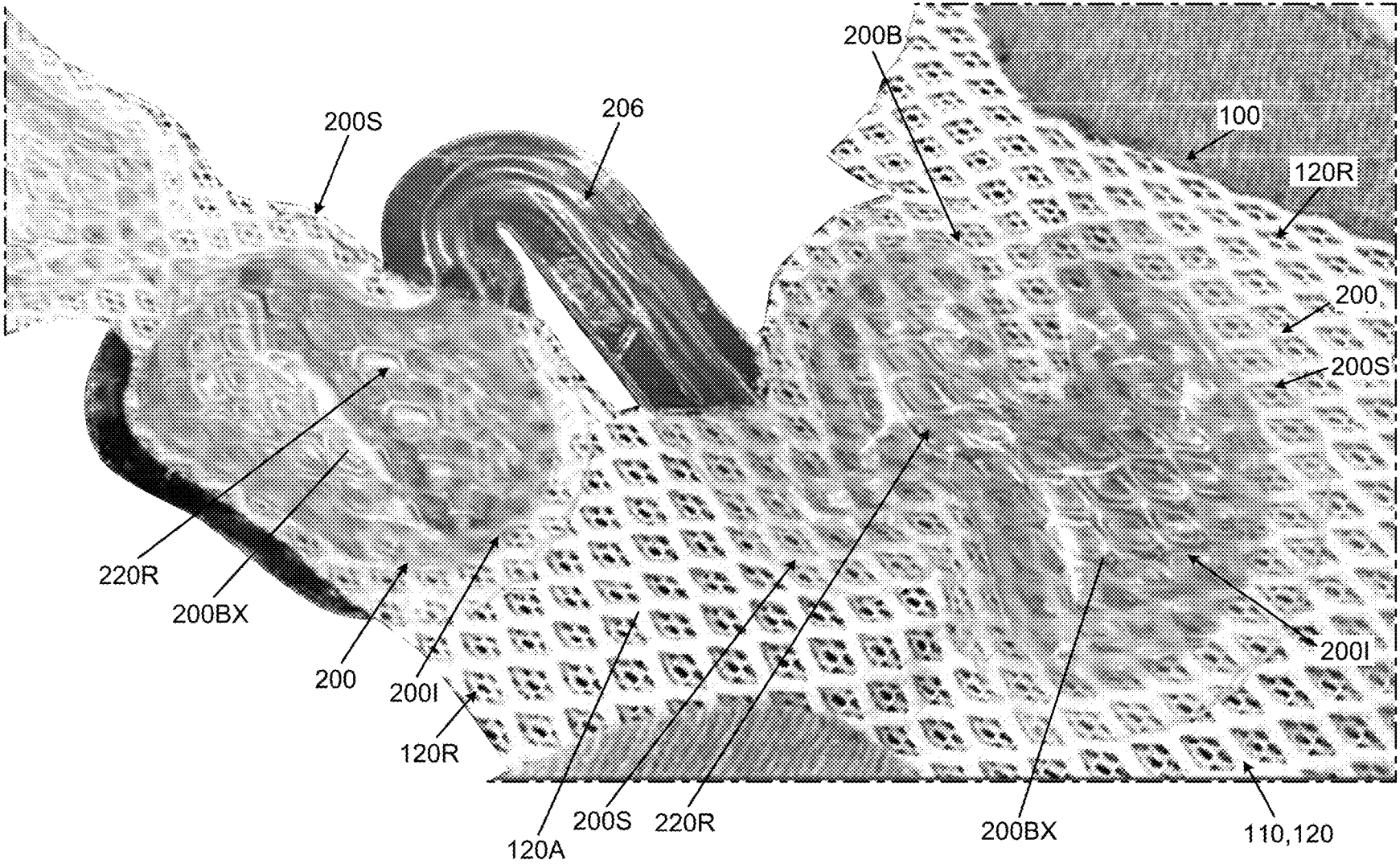
FIGS. 13A-13D illustrate texturing features for bladders and/or footwear upper components in accordance with at least some examples of this technology.
Figure 13B:
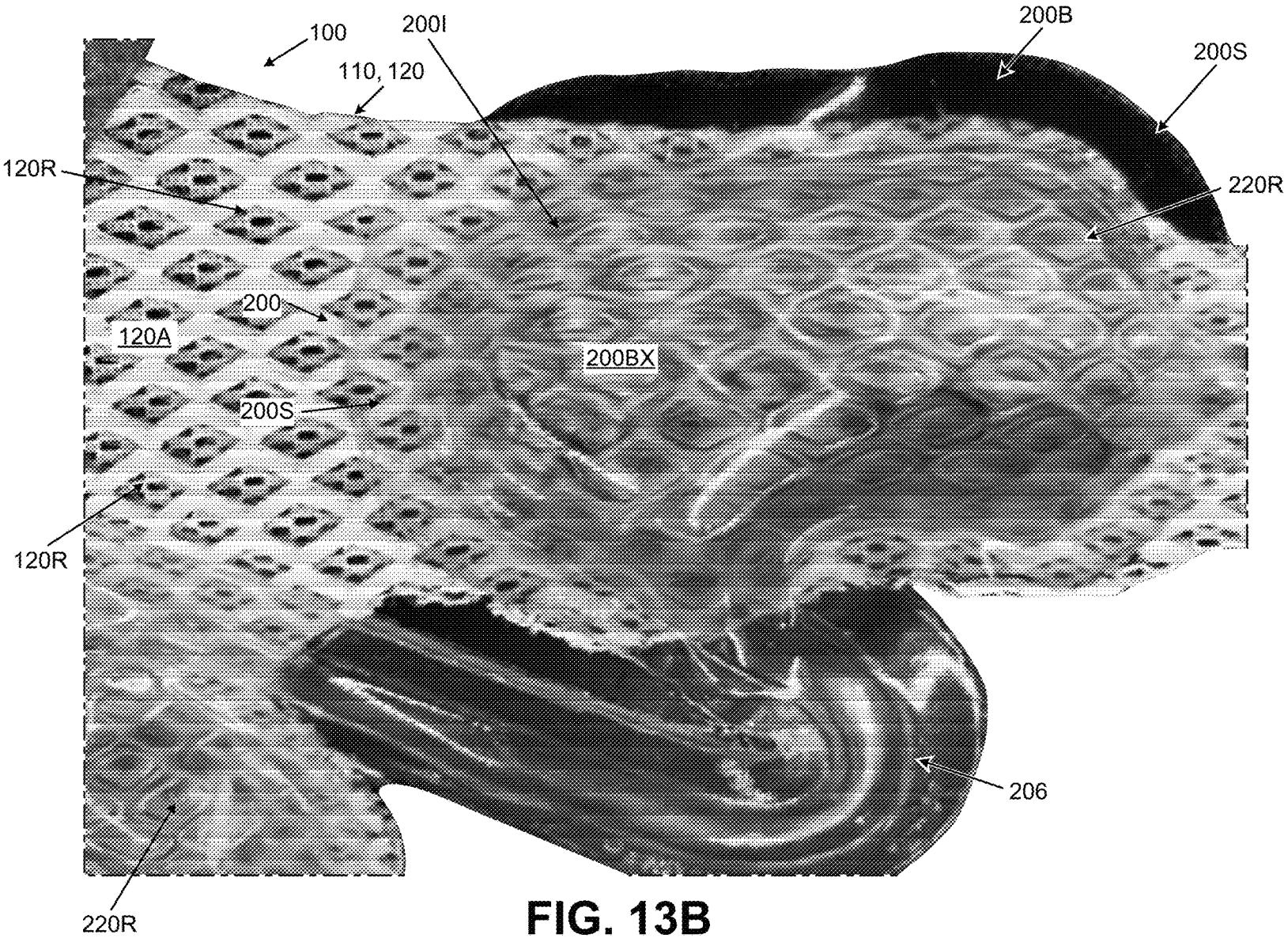
Figure 13D:
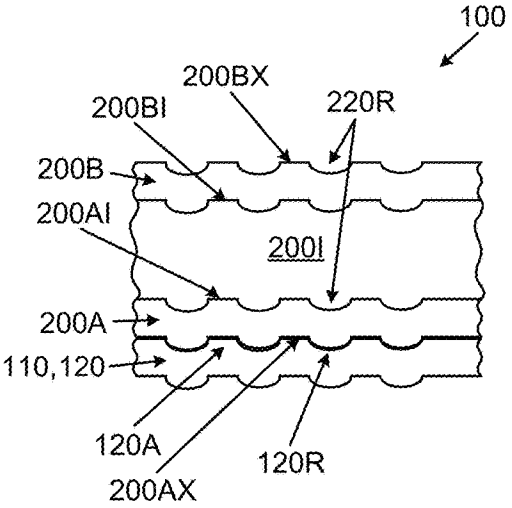
Figure 13C:
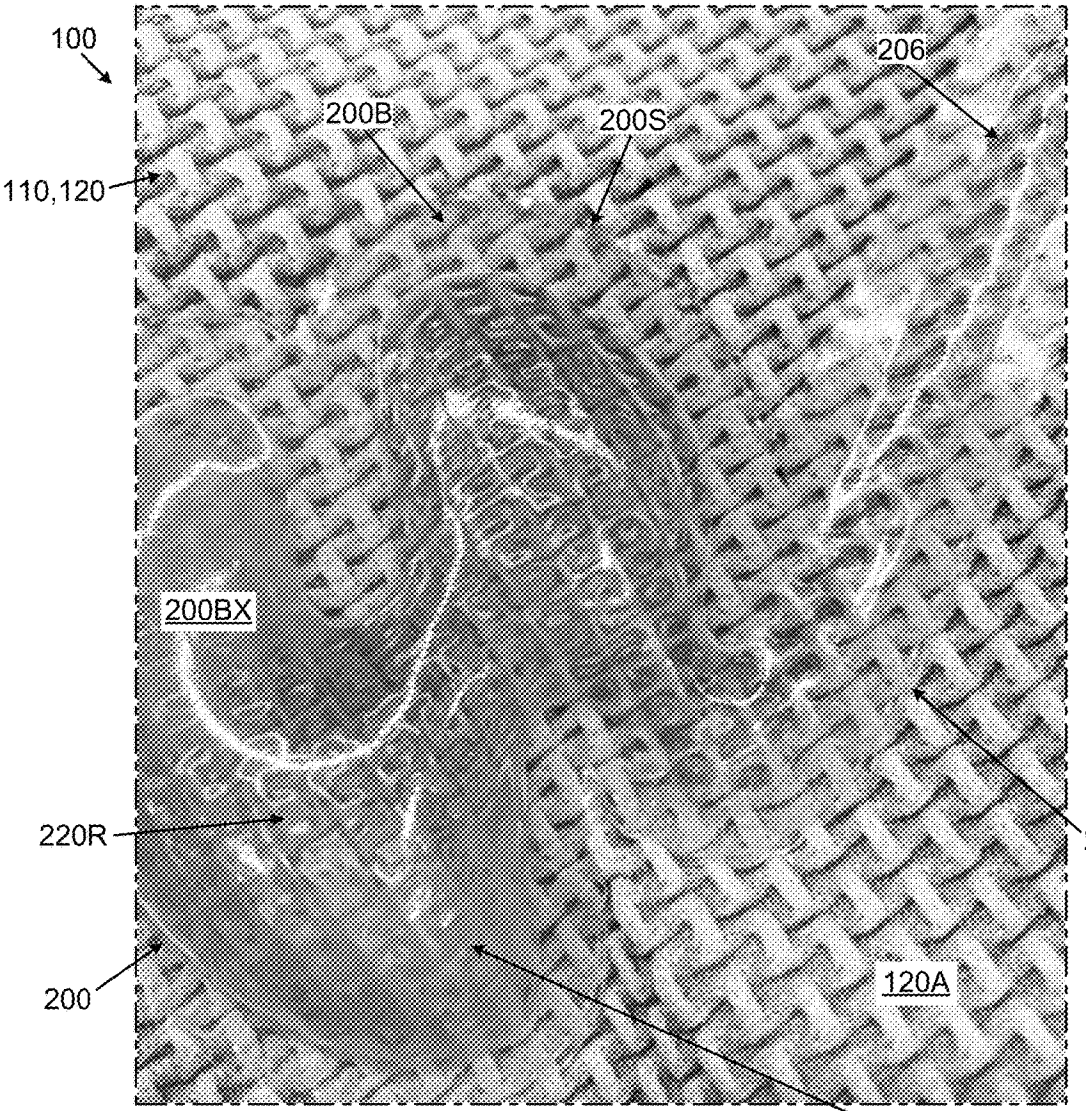

FIGS. 13A-13D illustrate additional features of bladders 200 and/or footwear upper components 100 with texturing features in accordance with at least some examples of this technology. FIGS. 13A-13C show various views of bladders 200 engaged with fabric components 110, 120. FIG. 13D provides a partial cross sectional view of a footwear upper component 100 showing a portion of the bladder 200 at the sealed interior chamber 200I to illustrate potential layering and texturing features. As shown in these figures, in some examples of this technology, the fabric component 110, 120 may form a mesh structure (e.g., with mesh openings or recesses 120R defined within a matrix formed by the fabric component 110, 120) or otherwise have surface texture on the surface 120A to be engaged with the bladder 200. During the heating and pressing steps, the first sheet or layer of thermoplastic polymer material 200A (and, if present, the second sheet or layer of thermoplastic polymer material 200B) may become softened, e.g., to enable formation of the adhesive free bond(s). If at least a portion of the fabric component 110, 120 (e.g., a portion that forms the texturing) does not significantly soften or melt under the heating and pressing conditions, then the heating and pressing step may alter the softened surfaces of at least one (and potentially both) of the first sheet or layer of thermoplastic polymer material 200A and/or the second sheet or layer of thermoplastic polymer material 200B to include texturing (e.g., recesses 220R). The texturing recesses 220R are formed from (imprinted or embossed into material 200A and/or 200B by) the openings or recesses 120R in surface 120A of fabric component 110, 120. The texturing is shown in the diamond shaped recess patterns and surface irregularities formed on the exterior surface 200BX of second sheet or layer of thermoplastic polymer material 200B in FIGS. 13A-13D.

FIGS. 13A-13C show the exposed exterior surface 200BX of the bladder 200 with texturing having surface contour features corresponding to the texturing present on the surface 120A of the first fabric component 110, 120. That texturing may be present on one or more of the surfaces of the bladder 200 forming the seam 200S and/or on one or more of the surfaces of the bladder 200 forming the sealed interior chamber 200I. Further, as shown in FIG. 13D, as a result of the heating and pressing step(s), the texturing 220R may be present on one or more of: (a) an exterior surface 200AX of the first sheet or layer of thermoplastic polymer material 200A (e.g., the surface that directly contacts and bonds with the textured surface 120A of the fabric component 110, 120), (b) an interior surface 200AI of the first sheet or layer of thermoplastic polymer material 200A (e.g., the surface that forms the bond for seam 200S and the interior of the sealed interior chamber 200I), (c) an interior surface 200BI of the second sheet or layer of thermoplastic polymer material 200B (e.g., the other surface that forms the bond for seam 200S and the interior of the sealed interior chamber 200I), and/or (d) an exterior surface 200BX of the second sheet or layer of thermoplastic polymer material 200B (e.g., the exposed exterior surface of the footwear upper 100 in the illustrated examples of FIGS. 13A-13C). The texturing can be formed on all of these surfaces, e.g., if the sheets or layers of the first and second polymer materials 200A and 200B of the bladder precursor are flat pressed against textured surface 120A before the bladder 200 is inflated.

The texturing may help provide feel differential when contacted by a user, e.g., to help locate the bladder 200 and/or to provide proprioceptive feedback. In addition, the texturing may provide an interesting aesthetic, as texturing may create different lighting, reflecting, and/or shadowing effects. Also, in some examples of this technology, at least one of the first sheet or layer of thermoplastic polymer material 200A and/or the second sheet or layer of thermoplastic polymer material 200B (e.g., at least the second sheet or layer 200B in FIG. 13D) may be formed from an at least partially transparent material (e.g., a clear or colored thermoplastic polyurethane material). In such structures, texturing (e.g., recesses 220R) present on the interior sheet (e.g., on the interior surface 200A1 and/or the exterior surface 200AX of the first sheet or layer of thermoplastic polymer material 200A in the example of FIG. 13D) may be visible at the exterior of the bladder 200 through the second sheet or layer of thermoplastic polymer material 200B and through the sealed interior chamber 200I of the bladder 200. Further, as shown in FIGS. 13A-13C, in these examples of this technology, the underlying fabric component 110, 120 is visible through the at least partially transparent materials forming the first sheet or layer of thermoplastic polymer material 200A and the second sheet or layer of thermoplastic polymer material 200B. At least portions of either or both of the first sheet or layer of thermoplastic polymer material 200A and/or the second sheet or layer of thermoplastic polymer material 200B may be tinted to provide additional color palette and color combination choices.

FIGS. 13A-13D relate to examples in which texturing is applied to one or more surfaces of a bladder 200 from texture present on a fabric component 110, 120 with which the bladder 200 is engaged (e.g., from a mesh structure of fabric component 110, 120). Texture may be applied to bladders 200 in other manners as well. FIGS. 14A-14K illustrate additional examples and features of bladders, footwear upper components, and methods of making them that include texturing (e.g., at least on an exposed surface of the bladder 200) in accordance with some examples of this technology.

Figure 14A:
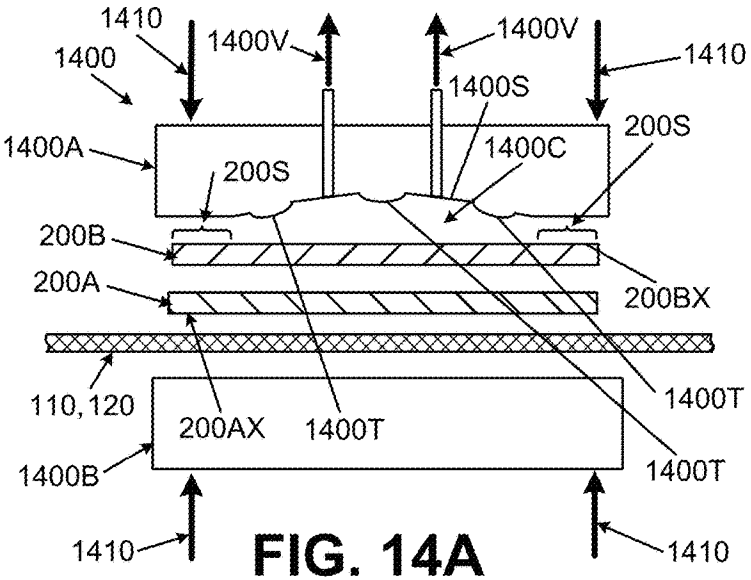
FIGS. 14A-14K illustrate additional examples and features of bladders, footwear upper components, and methods of making them that include texturing in accordance with some examples of this technology.

As some more specific examples, texturing may be applied to a bladder 200 surface 200BX using molding processes (e.g., when the bladder 200 is formed, when the bladder 200 is inflated, and/or when the bladder 200 or a bladder precursor is engaged with a fabric component 110, 120), using a thermoforming process, using a vacuum forming process, using an embossing process, etc. FIG. 14A shows an example mold assembly 1400 and molding and pressing process, e.g., for forming a bladder 200 from two thermoplastic sheets 200A, 200B and engaging the bladder 200 with a fabric component 110, 120. In this example, the thermoplastic sheets 200A, 200B are placed in a mold cavity 1400C (defined between top mold plate 1400A and bottom mold plate 1400B). In this example, a fabric component 110, 120 extends into the area of the mold cavity 1400C between the mold plates 1400A, 1400B to engage the bottom surface 200AX of thermoplastic sheet 200A. Alternatively, in some examples of this technology, the fabric component 110, 120 could be omitted in this process (e.g., and engaged with the bladder 200 or bladder precursor at a later time).

In this illustrated example, the mold plates 1400A, 1400B are pressed together (shown by arrows 1410) with sufficient heating to soften the thermoplastic sheets 200A, 200B, form the outer perimeter seam 200S (e.g., by an adhesive free bond or by an adhesive based bond (if an adhesive has been applied to one or both of sheets 200A, 200B)), and engage thermoplastic sheet 200A with fabric component 110, 120 (e.g., by an adhesive free bond or by an adhesive based bond (if an adhesive has been applied to one or both of sheet 200A and fabric component 110, 120)). Because of the cavity 1400C in top mold plate 1400A in this example, the thermoplastic sheets 200A, 200B will not bond in the area adjacent and within the cavity 1400C (as no compressive force is applied to the sheets 200A, 200B in the cavity 1400C area).

As shown in FIG. 14A, the interior surface 1400S of the top plate 1400A in the cavity 1400C area includes texturing 1400T. While the plates 1400A, 1400B remain pressed together and the thermoplastic sheets 200A, 200B remain softened, a vacuum may be applied to the cavity 1400C (see vacuum arrows 1400V). The vacuum force pulls at least the top thermoplastic sheet 200B against interior surface 1400S of the cavity 1400C. Due to its softened state, this action applies texturing 1400T from the cavity 1400C surface 1400S onto at least the incident surface 200BX of the top thermoplastic sheet 200B. Additionally or alternatively, the bladder 200 could be inflated while in the mold assembly 1400 (e.g., if a fluid inlet is present to introduce fluid between thermoplastic sheets 200A and 200B after the seam 200S is made).

Alternatively, if desired, the cavity 1400C could be omitted such that the applied force 1410 from pressing the mold plates 1400A, 1400B together also presses mold surface 1400S (with its texturing 1400T) against surface 200BX of the second thermoplastic sheet 200B. In such examples, the vacuum force 1400V may not be present and/or needed to apply texturing to surface 200BX. In such examples, texturing may be applied to thermoplastic sheet 200A as well.

Figure 14B:
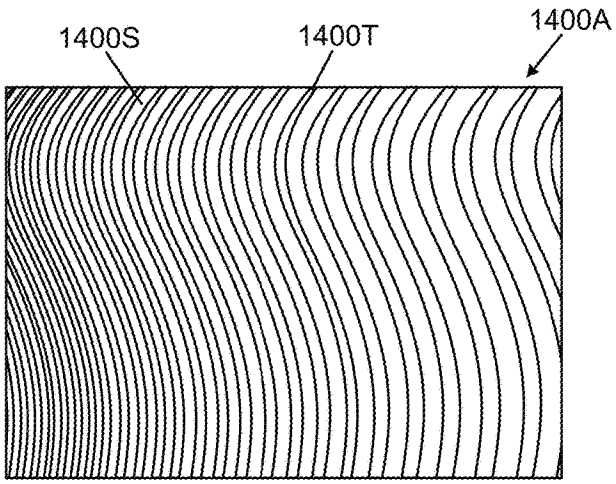
Figure 14C:
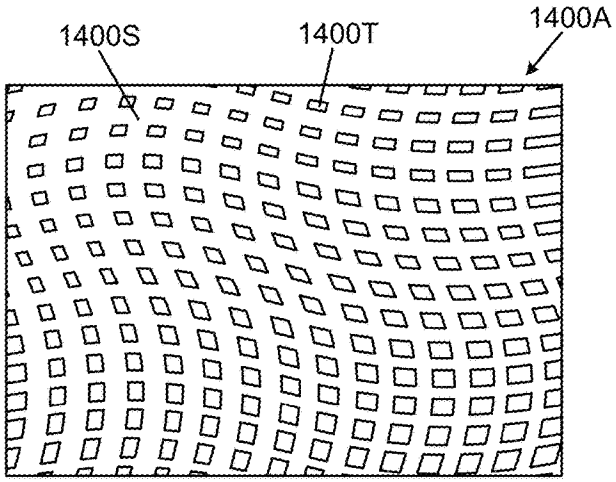
Figure 14D:
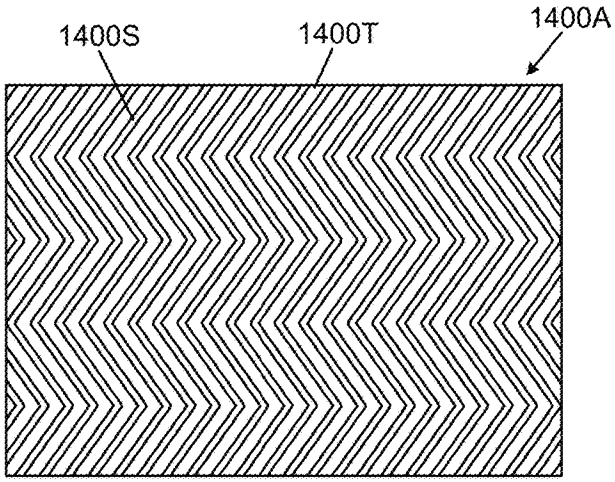

Any type of texturing pattern may be applied to the bladder 200. FIG. 14B shows an example of a mold plate 1400A in which surface 1400S includes texturing 1400T in the form of wavy raised ridges separated by wavy recessed curves. FIG. 14C shows an example of a mold plate 1400A in which surface 1400S includes texturing 1400T in the form of a matrix (e.g., rows and columns, staggered rows and/or columns, etc.) of raised polygons separated by wavy recessed curves. FIG. 14D shows an example of a mold plate 1400A in which surface 1400S includes texturing 1400T in the form of a herringbone pattern.

Figure 14E:
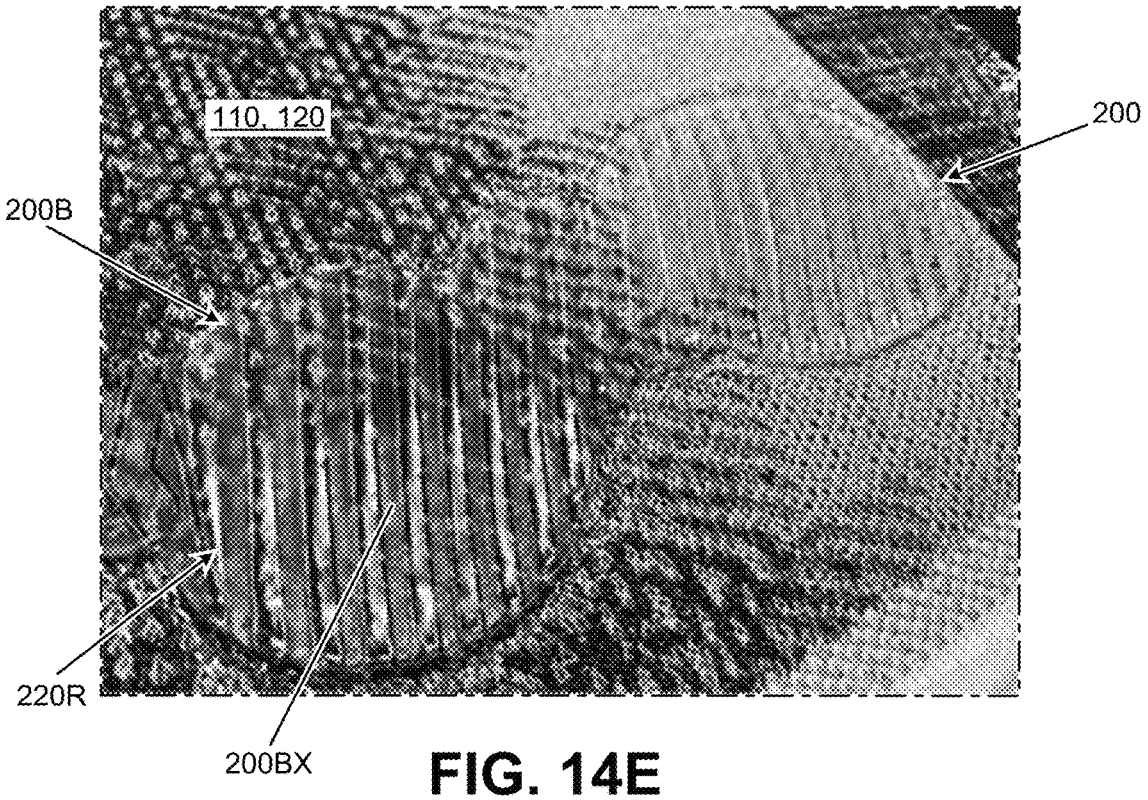
Figure 14F:
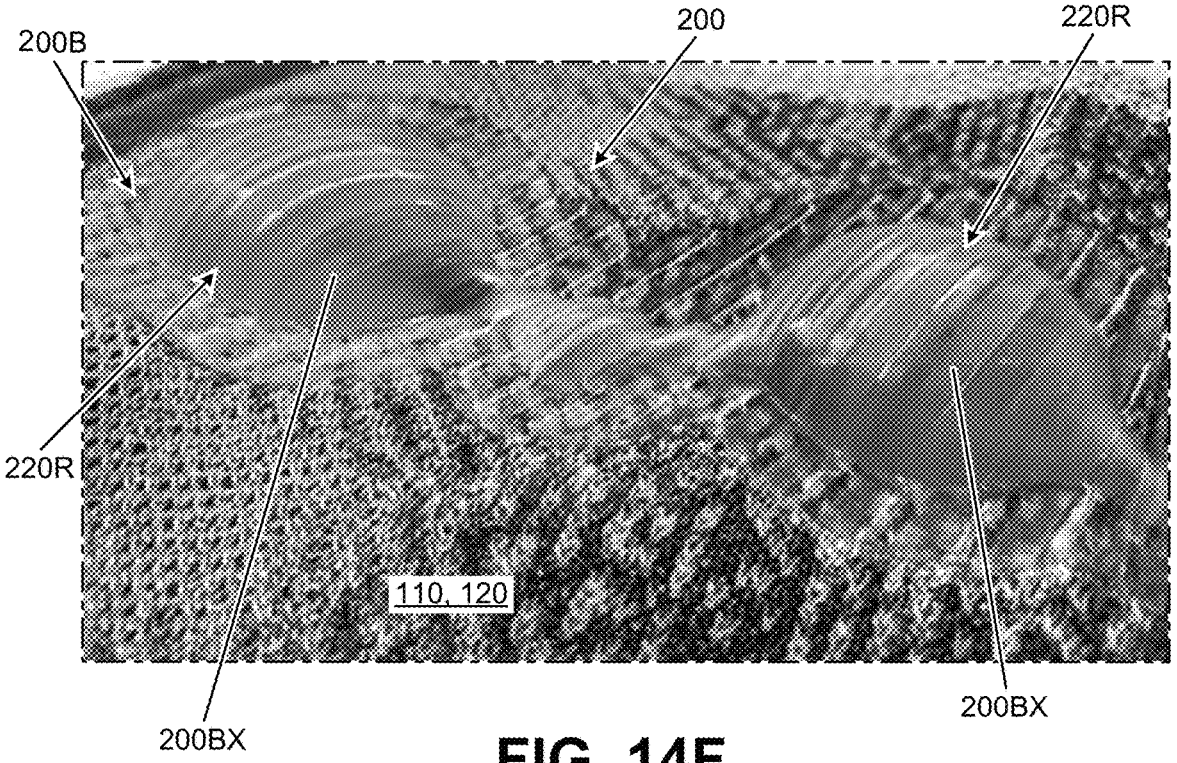
Figure 14G:
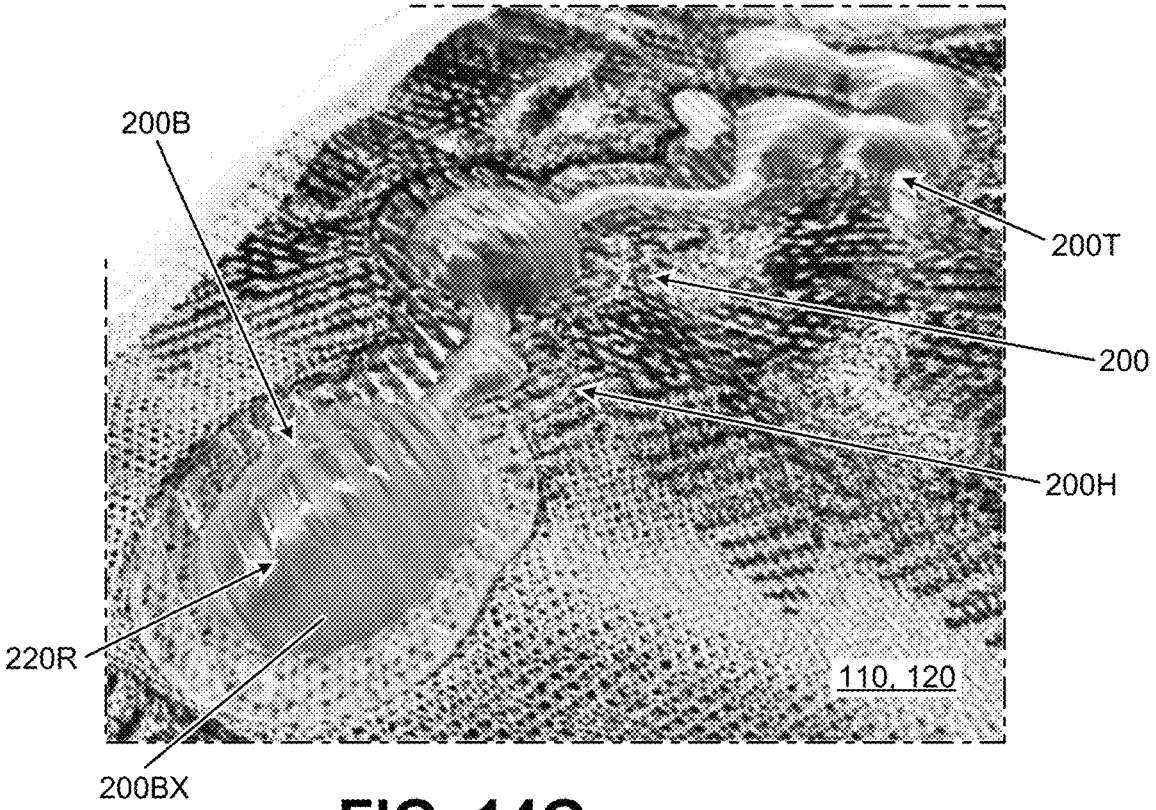

FIGS. 14E-14K show views of bladders 200 and/or portions thereof that include texturing 220R at least on exposed exterior surface 200BX of the bladder 200, e.g., formed by one or more of the methods described above in conjunction with FIGS. 14A-14D. FIG. 14E shows a portion of bladder 200 formed in a deflated condition. Note the texturing 220R, which in this example generally corresponds to the mold plate 1400A shown in FIG. 14B. The bladder 200 is engaged with a fabric component 110, 120 while the bladder 200 was formed (e.g., as shown in FIG. 14A) or in a separate step. FIG. 14F shows this same bladder 200 portion in an inflated condition, and FIG. 14G shows the overall bladder 200 (e.g., forming an instep and/or tongue based region 200T and a heel and/or ankle support region 200H of the types described above in conjunction with FIGS. 3A, 4A, 5A, 9A, and 9C-9E).

Figure 14H:
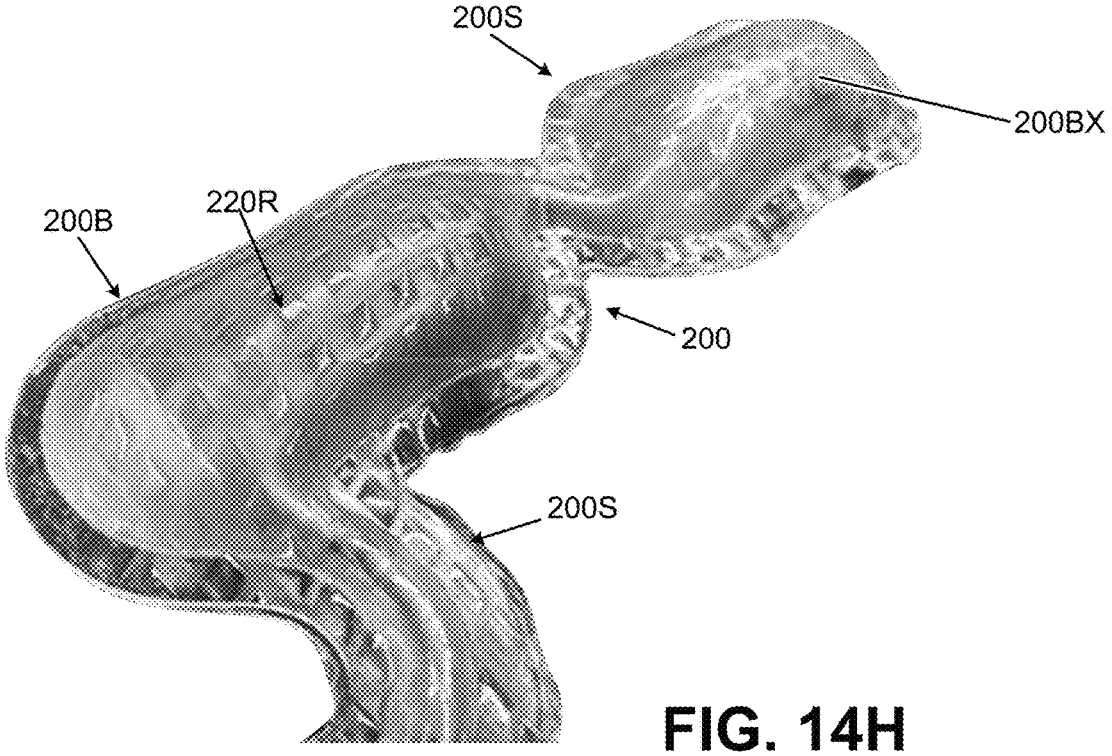
Figure 14I:
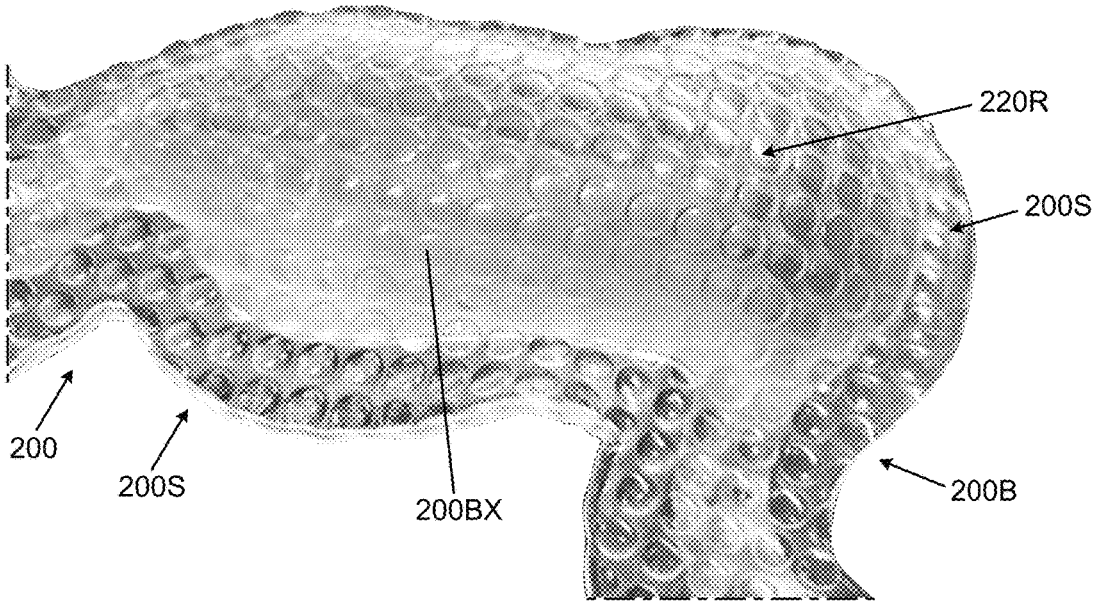
Figure 14J:
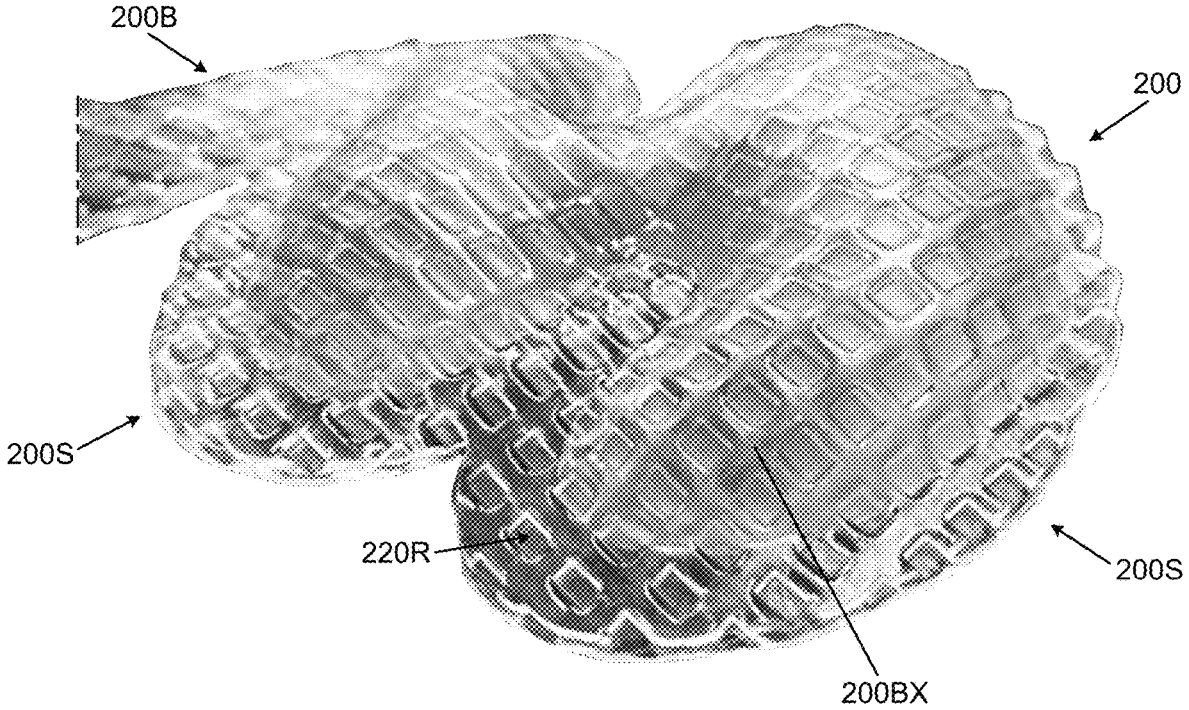
Figure 14K:
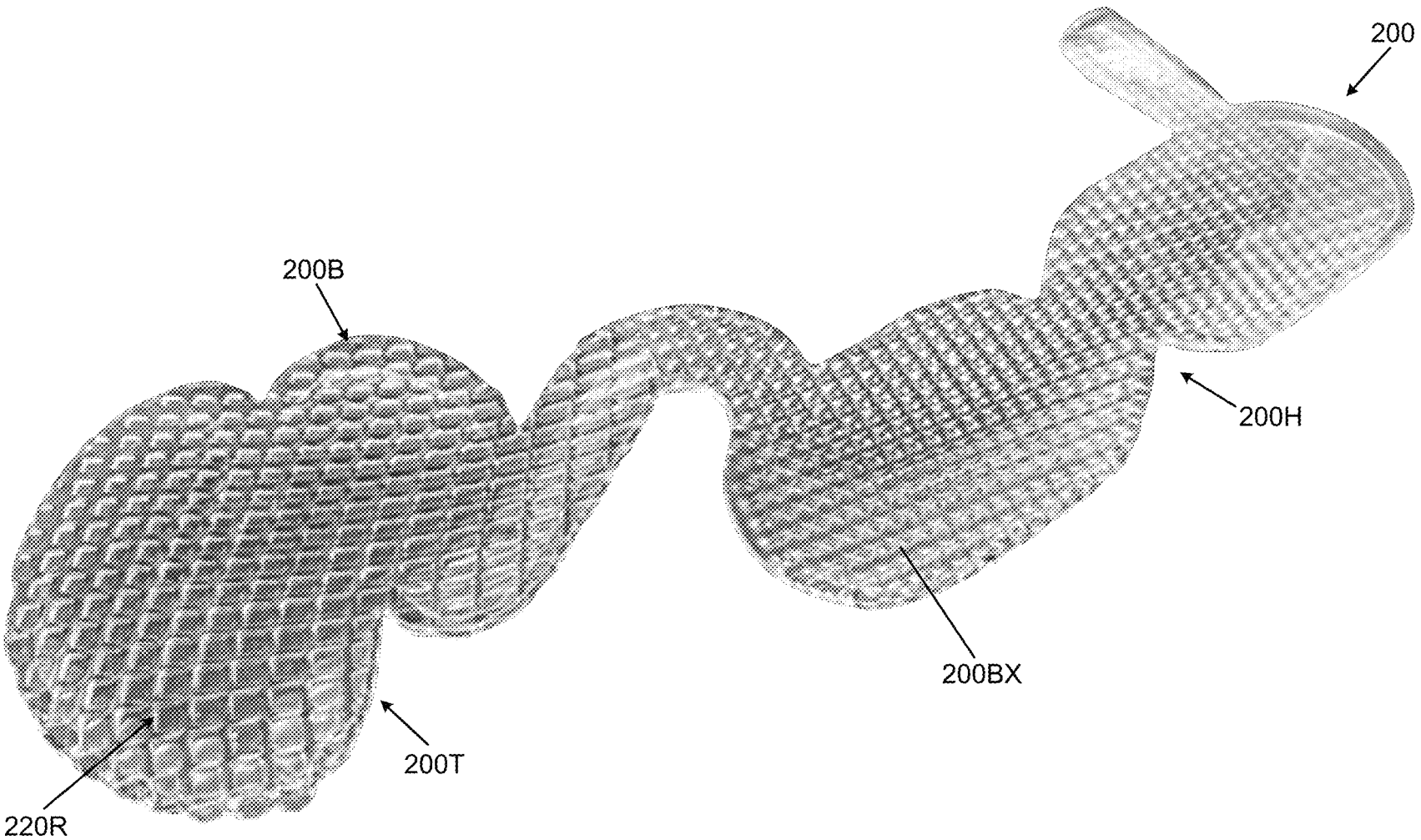

FIG. 14H illustrates a portion of an example bladder 200 formed separate from a fabric component and inflated. In this illustrated example, the bladder 200 has texturing 220R on exposed exterior surface 200BX in the form of raised polygons in a matrix pattern separated by curved recesses (e.g., arranged in rows and columns, arranged in staggered rows and/or columns, etc.). FIG. 14I illustrates a portion of an example bladder 200 formed separate from a fabric component and inflated in which the bladder 200 has texturing 220R on exposed exterior surface 200BX in the form of raised rounded elements (e.g., circular elements, oval elements, elliptical elements, teardrop shaped elements, etc.) in a matrix pattern (e.g., arranged in rows and columns, arranged in staggered rows and/or columns, etc.). FIG. 14J illustrates a portion of an example bladder 200 formed separate from a fabric component and inflated in which texturing 220R on exposed exterior surface 200BX is in the form of recessed polygons in a matrix pattern (e.g., arranged in rows and columns, arranged in staggered rows and/or columns, etc.). Such a pattern may be formed, for example, using mold plate 1400A of the type shown in FIG. 14C. FIG. 14K illustrates an example bladder 200 formed separate from a fabric component and in an uninflated condition. This example bladder 200 has different texturing at different locations on its exterior surface 200BX. Any desired number and/or types of different texturing patterns may be provided. In this illustrated example, the instep and/or tongue based region 200T has one texturing pattern (e.g., recessed polygons in a matrix arrangement) and the heel and/or ankle support region 200H as a different texturing pattern (e.g., a matrix of smaller raised and recessed elements). The bladders 200 of FIGS. 14H-14K may be attached to a fabric component 110, 120 at any desired time (e.g., before or after inflation), e.g., by engaging seam 200S with the fabric component 110, 120, e.g., in any of the manners described above.

The texturing 220R may help provide feel differential when contacted by a user, e.g., to help locate the bladder 200 with one's fingers and/or to provide proprioceptive feedback. The texturing 220R may face toward the interior of the shoe (e.g., to contact the wearer's foot or leg at least in the heel and/or ankle support area 200H), toward the exterior of the shoe (e.g., to enable easy location of the bladder 200 parts by feel), or in both directions in all or part of the bladder 200 (e.g., in one direction in one area of the bladder 200 and in the other direction in another area of the bladder 200). In addition, the texturing 220R may provide an interesting aesthetic, as texturing may create different lighting, reflecting, and/or shadowing effects. The bladder 200 also may have any of the transparency and/or other properties of the bladders described above in conjunction with FIGS. 13A-13D.

As other alternatives, if desired, texturing may be applied to one or more bladder surfaces (e.g., 200AX, 200BX) in other processes. For example, with one or both of the first and/or second thermoplastic sheets 200A, 200B softened (e.g., by application of heat), the sheet(s) 200A, 200B could be pressed by one or more rollers having a textured surface (e.g., passed between rollers, one of which may have a textured surface), e.g., in an embossing, calendaring, or rolling process.

While FIGS. 1-14K illustrate various different bladder sizes, shapes, and specific configurations, many variations in bladder sizes, shapes, and/or configurations are possible without departing from this technology. The specifically illustrated bladders could be varied widely in size, shape, and/or configuration while still providing the desired functions and/or properties described above.

III. Conclusion

The present invention is disclosed above and in the accompanying drawings with reference to a variety of example structures. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims.

For the avoidance of doubt, the present application includes at least the subject matter described in the following numbered Clauses:

Clause 1. A footwear upper component, comprising:
- a first knit fabric element that includes a first thermoplastic polyurethane component; and
- a bladder component that defines a sealed interior chamber for containing a fluid, wherein the bladder component includes an outer perimeter seam that extends at least partially around the sealed interior chamber, and wherein at least a portion of the outer perimeter seam is bonded to or otherwise engaged with the first thermoplastic polyurethane component of the first knit fabric element.

Clause 2. The footwear upper component according to Clause 1, wherein the bladder component includes a first thermoplastic sheet and a second thermoplastic sheet facing the first thermoplastic sheet, wherein the outer perimeter seam fixes the first thermoplastic sheet to the second thermoplastic sheet, and wherein a first major interior surface of the first thermoplastic sheet, a first major interior surface of the second thermoplastic sheet, and the outer perimeter seam define the sealed interior chamber.

Clause 3. The footwear upper component according to Clause 2, wherein the first thermoplastic sheet includes a first major exterior surface opposite the first major interior surface of the first thermoplastic sheet, wherein at least a portion of the first major exterior surface of the first thermoplastic sheet that defines the sealed interior chamber is bonded to the first thermoplastic polyurethane component of the first knit fabric element in an adhesive free manner, and wherein the portion of the outer perimeter seam that is bonded to the first thermoplastic polyurethane component of the first knit fabric element is bonded in an adhesive free manner.

Clause 4. The footwear upper component according to Clause 3, wherein the outer perimeter seam includes a first seam portion engaging a first side of the first thermoplastic sheet with a first side of the second thermoplastic sheet and a second seam portion engaging a second side of the first thermoplastic sheet with a second side of the second thermoplastic sheet, wherein the first seam portion is located on an opposite side of the sealed interior chamber from the second seam portion, and wherein the portion of the first major exterior surface of the first thermoplastic sheet that is bonded to the first thermoplastic polyurethane component of the first knit fabric element extends continuously from the first seam portion to the second seam portion.

Clause 5. The footwear upper component according to Clause 2, wherein the first thermoplastic sheet includes a first major exterior surface opposite the first major interior surface of the first thermoplastic sheet, and wherein at least 50% of a surface area of the first major exterior surface of the first thermoplastic sheet is bonded to the first thermoplastic polyurethane component of the first knit fabric element in an adhesive free manner.

Clause 6. The footwear upper component according to Clause 2, wherein the first thermoplastic sheet includes a first major exterior surface opposite the first major interior surface of the first thermoplastic sheet, and wherein at least 80% of a surface area of the first major exterior surface of the first thermoplastic sheet is bonded to the first thermoplastic polyurethane component of the first knit fabric element in an adhesive free manner.

Clause 7. The footwear upper component according to any one of Clauses 2 to 6, further comprising: a second knit fabric element engaged with at least one of the first knit fabric element or the bladder component.

Clause 8. The footwear upper component according to Clause 7, wherein the second knit fabric element includes a second thermoplastic polyurethane component, wherein the second thermoplastic sheet includes a first major exterior surface opposite the first major interior surface of the second thermoplastic sheet, and wherein at least a portion of the first major exterior surface of the second thermoplastic sheet is bonded to the second thermoplastic polyurethane component of the second knit fabric element in an adhesive free manner.

Clause 9. The footwear upper component according to Clause 8, wherein at least 50% of a surface area of the first major exterior surface of the second thermoplastic sheet is bonded to the second thermoplastic polyurethane component of the second knit fabric element in an adhesive free manner.

Clause 10. The footwear upper component according to Clause 8, wherein at least 80% of a surface area of the first major exterior surface of the second thermoplastic sheet is bonded to the second thermoplastic polyurethane component of the second knit fabric element in an adhesive free manner.

Clause 11. The footwear upper component according to any one of Clauses 7 to 10, wherein the second knit fabric element includes an opening defined through it, and wherein at least a portion of an exterior surface of the sealed interior chamber is exposed through the opening.

Clause 12. The footwear upper component according to any one of Clauses 2 to 6, further comprising: a fabric component engaged with the second thermoplastic sheet.

Clause 13. The footwear upper component according to Clause 12, wherein the second thermoplastic sheet includes a first major exterior surface opposite the first major interior surface of the second thermoplastic sheet, and wherein at least a portion of the first major exterior surface of the second thermoplastic sheet is fixedly bonded to the fabric component.

Clause 14. The footwear upper component according to Clause 13, wherein at least 50% of a surface area of the first major exterior surface of the second thermoplastic sheet is fixedly bonded to the fabric component.

Clause 15. The footwear upper component according to Clause 13, wherein at least 80% of a surface area of the first major exterior surface of the second thermoplastic sheet is fixedly bonded to the fabric component.

Clause 16. The footwear upper component according to any one of Clauses 12 to 15, wherein the fabric component includes an opening defined through it, and wherein at least a portion of an exterior surface of the sealed interior chamber is exposed through the opening.

Clause 17. The footwear upper component according to any one of Clauses 12 to 15, wherein a portion of the fabric component partially covers an exterior surface of the sealed interior chamber.

Clause 18. The footwear upper component according to any one of Clauses 1 to 17, wherein the outer perimeter seam extends continuously and completely around the sealed interior chamber.

Clause 19. The footwear upper component according to Clause 18, wherein at least 90% of a surface area of one surface of the outer perimeter seam is bonded to the first thermoplastic polyurethane component of the first knit fabric element.

Clause 20. The footwear upper component according to any one of Clauses 1 to 19, wherein the outer perimeter seam includes a thermoplastic polyurethane material that melts under heat and pressure to bond with melted material of the first thermoplastic polyurethane component of the first knit fabric element.

Clause 21. The footwear upper component according to any one of Clauses 1 to 11 or Clauses 18 to 20, further comprising: a fabric component engaged with the bladder component.

Clause 22. The footwear upper component according to Clause 21, wherein at least a portion of an exterior major surface of the bladder component forming the sealed interior chamber is fixedly bonded to the fabric component.

Clause 23. The footwear upper component according to Clause 22, wherein at least 50% of a surface area of the exterior major surface of the bladder component is fixedly bonded to the fabric component.

Clause 24. The footwear upper component according to Clause 22, wherein at least 80% of a surface area of the exterior major surface of the bladder component is fixedly bonded to the fabric component.

Clause 25. The footwear upper component according to any one of Clauses 21 to 24, wherein the fabric component includes an opening defined through it, and wherein at least a portion of an exterior major surface of the sealed interior chamber is exposed through the opening.

Clause 26. The footwear upper component according to Clause 25, wherein a portion of the fabric component is dissolved to form the opening.

Clause 27. The footwear upper component according to any one of Clauses 21 to 26, wherein a portion of the fabric component partially covers an exterior surface of the sealed interior chamber.

Clause 28. The footwear upper component according to Clause 27, wherein at least a portion of an exterior major surface of the sealed interior chamber is exposed at an exterior surface of the footwear upper component.

Clause 29. The footwear upper component according to any one of Clauses 21 to 28, wherein at least a portion of the fabric component that engages the sealed interior chamber is formed from a dissolvable material.

Clause 30. The footwear upper component according to any one of Clauses 1 to 29, wherein the outer perimeter seam forms a closed loop, and wherein a perimeter of the closed loop encloses a single sealed interior chamber which consists of the sealed interior chamber.

Clause 31. An article of footwear, comprising:

a footwear upper component according to any one of Clauses 1 to 30; and a sole structure engaged with the footwear upper component.

Clause 32. A method of forming a footwear upper component, comprising:

placing a bladder or a bladder precursor on a first knit fabric element, wherein the first knit fabric element includes a first thermoplastic polyurethane component, and wherein the bladder or the bladder precursor includes a first thermoplastic polymer layer and a second thermoplastic polymer layer overlapping the first thermoplastic polymer layer;

applying heat and pressure to form a seam to engage the first thermoplastic polymer layer with the second thermoplastic polymer layer and to engage at least a portion of the first thermoplastic polymer layer with the first thermoplastic polyurethane component of the first knit fabric element, wherein the seam, the first thermoplastic polymer layer, and the second thermoplastic polymer layer define a sealed interior chamber for containing a fluid; and inflating the sealed interior chamber.

Clause 33. The method according to Clause 32, wherein the first thermoplastic polymer layer and the second thermoplastic polymer layer are formed as separate sheets.

Clause 34. The method according to Clause 32 or 33, wherein the sealed interior chamber includes a first major exterior surface formed from the first thermoplastic polymer layer and a second major exterior surface formed from the second thermoplastic polymer layer opposite the first major exterior surface, and wherein at least a portion of the first major exterior surface of the first thermoplastic polymer layer is bonded to the first thermoplastic polyurethane component of the first knit fabric element.

Clause 35. The method according to any one of Clauses 32 to 34, wherein the seam comprises an outer perimeter seam that completely surrounds the sealed interior chamber.

Clause 36. The method according to any one of Clauses 32 to 35, wherein the first thermoplastic polymer layer includes a first major interior surface and a first major exterior surface opposite the first major interior surface, and wherein at least 50% of a surface area of the first major exterior surface of the first thermoplastic polymer layer is bonded to the first thermoplastic polyurethane component of the first knit fabric element in an adhesive free manner.

Clause 37. The method according to any one of Clauses 32 to 35, wherein the first thermoplastic polymer layer includes a first major interior surface and a first major exterior surface opposite the first major interior surface, and wherein at least 80% of a surface area of the first major exterior surface of the first thermoplastic polymer layer is bonded to the first thermoplastic polyurethane component of the first knit fabric element in an adhesive free manner.

Clause 38. The method according to any one of Clauses 32 to 37, further comprising: engaging a fabric component with the second thermoplastic polymer layer.

Clause 39. The method according to Clause 38, wherein the step of engaging the fabric component with the second thermoplastic polymer layer takes place simultaneous with the step of applying heat and pressure.

Clause 40. The method according to Clause 39, wherein the second thermoplastic polymer layer includes a first major interior surface and a first major exterior surface opposite the first major interior surface of the second thermoplastic polymer layer, and wherein at least a portion of the first major exterior surface of the second thermoplastic polymer layer is bonded to a thermoplastic polyurethane component included in the fabric component.

Clause 41. The method according to Clause 40, wherein at least 50% of a surface area of the first major exterior surface of the second thermoplastic polymer layer is bonded to the thermoplastic polyurethane component of the fabric component in an adhesive free manner.

Clause 42. The method according to Clause 40, wherein at least 80% of a surface area of the first major exterior surface of the second thermoplastic polymer layer is bonded to the thermoplastic polyurethane component of the fabric component in an adhesive free manner.

Clause 43. The method according to any one of Clauses 38 to 42, wherein the fabric component includes an opening defined through it, and wherein at least a portion of an exterior surface of the sealed interior chamber is exposed through the opening.

Clause 44. The method according to any one of Clauses 32 to 37, further comprising: (i) engaging a fabric component with the second thermoplastic polymer layer; and (ii) forming an opening through the fabric component, wherein a portion an exterior surface of the second thermoplastic polymer layer is exposed through the opening.

Clause 45. The method according to Clause 44, wherein the portion of the exterior surface of the second thermoplastic polymer layer exposed through the opening includes a portion that forms an exterior surface of the sealed interior chamber.

Clause 46. The method according to Clause 44 or 45, wherein the step of forming the opening includes dissolving a portion of the fabric component to form the opening.

Clause 47. The method according to any one of Clauses 32 to 46, wherein the step of applying heat and pressure to form the seam includes localized melting to bond the portion of the first thermoplastic polymer layer with the first thermoplastic polyurethane component of the first knit fabric element.

Clause 48. The method according to any one of Clauses 32 to 47, wherein the step of applying heat and pressure to form the seam includes localized melting to bond the first thermoplastic polymer layer with the second thermoplastic polymer layer.

Clause 49. The method according to any one of Clauses 32 to 48, wherein the step of inflating the sealed interior chamber takes place after the step of applying heat and pressure.

Clause 50. The method according to any one of Clauses 32 to 48, wherein the step of inflating the sealed interior chamber takes place before the step of applying heat and pressure.

Clause 51. A footwear upper component formed by the method according to any one of Clauses 32 to 50.

Clause 52. A method of making an article of footwear, comprising:

forming a footwear upper component using the method according to any one of Clauses 32 to 50; and engaging a sole structure with the footwear upper component.

Clause 53. An article of footwear formed by the method according to Clause 52.

Clause 54. A footwear upper component, comprising:

a first fabric element; and a bladder component that defines a sealed interior chamber for containing a fluid, wherein the bladder component includes an outer perimeter seam that extends at least partially around the sealed interior chamber, and wherein at least a portion of the outer perimeter seam is bonded to the first fabric element.

Clause 55. The footwear upper component according to Clause 54, wherein the bladder component includes a first thermoplastic sheet and a second thermoplastic sheet facing the first thermoplastic sheet, wherein the outer perimeter seam fixes the first thermoplastic sheet to the second thermoplastic sheet, and wherein a first major interior surface of the first thermoplastic sheet, a first major interior surface of the second thermoplastic sheet, and the outer perimeter seam define the sealed interior chamber.

Clause 56. The footwear upper component according to Clause 55, wherein the first thermoplastic sheet includes a first major exterior surface opposite the first major interior surface of the first thermoplastic sheet, wherein at least a portion of the first major exterior surface of the first thermoplastic sheet that defines the sealed interior chamber is bonded to the first fabric element in an adhesive free manner, and wherein the portion of the outer perimeter seam that is bonded to the first fabric element is bonded in an adhesive free manner.

Clause 57. The footwear upper component according to Clause 56, wherein the outer perimeter seam includes a first seam portion engaging a first side of the first thermoplastic sheet with a first side of the second thermoplastic sheet and a second seam portion engaging a second side of the first thermoplastic sheet with a second side of the second thermoplastic sheet, wherein the first seam portion is located on an opposite side of the sealed interior chamber from the second seam portion, and wherein the portion of the first major exterior surface of the first thermoplastic sheet that is bonded to the first fabric element extends continuously from the first seam portion to the second seam portion.

Clause 58. The footwear upper component according to Clause 55, wherein the first thermoplastic sheet includes a first major exterior surface opposite the first major interior surface of the first thermoplastic sheet, and wherein at least 50% of a surface area of the first major exterior surface of the first thermoplastic sheet is bonded to the first fabric element in an adhesive free manner.

Clause 59. The footwear upper component according to Clause 55, wherein the first thermoplastic sheet includes a first major exterior surface opposite the first major interior surface of the first thermoplastic sheet, and wherein at least 80% of a surface area of the first major exterior surface of the first thermoplastic sheet is bonded to the first fabric element in an adhesive free manner.

Clause 60. The footwear upper component according to any one of Clauses 55 to 59, further comprising: a second fabric element engaged with at least one of the first fabric element or the bladder component.

Clause 61. The footwear upper component according to Clause 60, wherein the second thermoplastic sheet includes a first major exterior surface opposite the first major interior surface of the second thermoplastic sheet, and wherein at least a portion of the first major exterior surface of the second thermoplastic sheet is bonded to the second fabric element in an adhesive free manner.

Clause 62. The footwear upper component according to Clause 61, wherein at least 50% of a surface area of the first major exterior surface of the second thermoplastic sheet is bonded to the second fabric element in an adhesive free manner.

Clause 63. The footwear upper component according to Clause 61, wherein at least 80% of a surface area of the first major exterior surface of the second thermoplastic sheet is bonded to the second fabric element in an adhesive free manner.

Clause 64. The footwear upper component according to any one of Clauses 60 to 63, wherein the second fabric element includes an opening defined through it, and wherein at least a portion of an exterior surface of the sealed interior chamber is exposed through the opening.

Clause 65. The footwear upper component according to any one of Clauses 54 to 64, wherein the outer perimeter seam extends continuously and completely around the sealed interior chamber.

Clause 66. The footwear upper component according to Clause 65, wherein at least 90% of a surface area of one surface of the outer perimeter seam is bonded to the first fabric element.

Clause 67. The footwear upper component according to any one of Clauses 54 to 66, wherein the outer perimeter seam includes a thermoplastic material that melts under heat and pressure to bond with melted material of the first fabric element.

Clause 68. The footwear upper component according to any one of Clauses 54 to 67, wherein the outer perimeter seam forms a closed loop, and wherein a perimeter of the closed loop encloses a single sealed interior chamber which consists of the sealed interior chamber.

Clause 69. An article of footwear, comprising:

a footwear upper component according to any one of Clauses 54 to 68; and a sole structure engaged with the footwear upper component.

Clause 70. A method of forming a footwear upper component, comprising:

placing a bladder or a bladder precursor on a first fabric element, wherein the bladder or the bladder precursor includes a first thermoplastic polymer layer and a second thermoplastic polymer layer overlapping the first thermoplastic polymer layer;

applying heat and pressure to form a seam to engage the first thermoplastic polymer layer with the second thermoplastic polymer layer and to engage at least a portion of the first thermoplastic polymer layer with the first fabric element, wherein the seam, the first thermoplastic polymer layer, and the second thermoplastic polymer layer define a sealed interior chamber for containing a fluid; and inflating the sealed interior chamber.

Clause 71. The method according to Clause 70, wherein the first thermoplastic polymer layer and the second thermoplastic polymer layer are formed as separate sheets.

Clause 72. The method according to Clause 70 or 71, wherein the sealed interior chamber includes a first major exterior surface formed from the first thermoplastic polymer layer and a second major exterior surface formed from the second thermoplastic polymer layer opposite the first major exterior surface, and wherein at least a portion of the first major exterior surface of the first thermoplastic polymer layer is bonded to the first fabric element.

Clause 73. The method according to any one of Clauses 70 to 72, wherein the seam comprises an outer perimeter seam that completely surrounds the sealed interior chamber.

Clause 74. The method according to any one of Clauses 70 to 73, wherein the first thermoplastic polymer layer includes a first major interior surface and a first major exterior surface opposite the first major interior surface, and wherein at least 50% of a surface area of the first major exterior surface of the first thermoplastic polymer layer is bonded to the first fabric element in an adhesive free manner.

Clause 75. The method according to any one of Clauses 70 to 73, wherein the first thermoplastic polymer layer includes a first major interior surface and a first major exterior surface opposite the first major interior surface, and wherein at least 80% of a surface area of the first major exterior surface of the first thermoplastic polymer layer is bonded to the first fabric element in an adhesive free manner.

Clause 76. The method according to any one of Clauses 70 to 75, further comprising: engaging a fabric component with the second thermoplastic polymer layer.

Clause 77. The method according to Clause 76, wherein the step of engaging the fabric component with the second thermoplastic polymer layer takes place simultaneous with the step of applying heat and pressure.

Clause 78. The method according to Clause 77, wherein the second thermoplastic polymer layer includes a first major interior surface and a first major exterior surface opposite the first major interior surface of the second thermoplastic polymer layer, and wherein at least a portion of the first major exterior surface of the second thermoplastic polymer layer is bonded to the fabric component.

Clause 79. The method according to Clause 78, wherein at least 50% of a surface area of the first major exterior surface of the second thermoplastic polymer layer is bonded to the fabric component in an adhesive free manner.

Clause 80. The method according to Clause 78, wherein at least 80% of a surface area of the first major exterior surface of the second thermoplastic polymer layer is bonded to the fabric component in an adhesive free manner.

Clause 81. The method according to any one of Clauses 76 to 80, wherein the fabric component includes an opening defined through it, and wherein at least a portion of an exterior surface of the sealed interior chamber is exposed through the opening.

Clause 82. The method according to any one of Clauses 70 to 75, further comprising: (i) engaging a fabric component with the second thermoplastic polymer layer; and (ii) forming an opening through the fabric component, wherein a portion an exterior surface of the second thermoplastic polymer layer is exposed through the opening.

Clause 83. The method according to Clause 82, wherein the portion of the exterior surface of the second thermoplastic polymer layer exposed through the opening includes a portion that forms an exterior surface of the sealed interior chamber.

Clause 84. The method according to Clause 82 or 83, wherein the step of forming the opening includes dissolving a portion of the fabric component to form the opening.

Clause 85. The method according to any one of Clauses 70 to 84, wherein the step of applying heat and pressure to form the seam includes localized melting to bond the portion of the first thermoplastic polymer layer with the first fabric element.

Clause 86. The method according to any one of Clauses 70 to 85, wherein the step of applying heat and pressure to form the seam includes localized melting to bond the first thermoplastic polymer layer with the second thermoplastic polymer layer.

Clause 87. The method according to any one of Clauses 70 to 86, wherein the step of inflating the sealed interior chamber takes place after the step of applying heat and pressure.

Clause 88. The method according to any one of Clauses 70 to 86, wherein the step of inflating the sealed interior chamber takes place before the step of applying heat and pressure.

Clause 89. A footwear upper component formed by the method according to any one of Clauses 70 to 88.

Clause 90. A method of making an article of footwear, comprising:

forming a footwear upper component using the method according to any one of Clauses 70 to 88; and engaging a sole structure with the footwear upper component.

Clause 91. An article of footwear formed by the method according to Clause 90.

Clause 92. A footwear upper component, comprising:

a first fabric element that includes a first surface having texturing; and a bladder component that defines a sealed interior chamber for containing a fluid, wherein the bladder component includes: (a) a first major surface engaged with the first surface of the first fabric element, wherein the first major surface defines at least part of a first perimeter seam surface and at least part of a first surface of the sealed interior chamber, (b) a second major surface opposite the first major surface, wherein the second major surface defines at least part of a second perimeter seam surface opposite the first perimeter seam surface and at least part of a second surface of the sealed interior chamber opposite the first surface of the sealed interior chamber, and (c) and a fluid chamber located between the first major surface and the second major surface, and wherein at least a portion of the first major surface includes texturing having surface contour features corresponding to the texturing present on the first surface of the first fabric element.

Clause 93. The footwear upper component according to Clause 92, wherein the texturing on the first major surface of the bladder component includes texturing on the first surface of the sealed interior chamber.

Clause 94. The footwear upper component according to Clause 92 or 93, wherein the texturing on the first major surface of the bladder component includes texturing on the first perimeter seam surface.

Clause 95. The footwear upper component according to any one of Clauses 92 to 94, wherein at least a portion of the second major surface includes texturing corresponding to the texturing present on the first surface of the first fabric element.

Clause 96. The footwear upper component according to Clause 95, wherein the texturing on the second major surface of the bladder component includes texturing on the second surface of the sealed interior chamber.

Clause 97. The footwear upper component according to Clause 95 or 96, wherein the texturing on the second major surface of the bladder component includes texturing on the second perimeter seam surface.

Clause 98. The footwear upper component according to any one of Clauses 92 to 97, wherein the first major surface of the bladder component is formed from a first thermoplastic sheet and the second major surface of the bladder component is formed from a second thermoplastic sheet.

Clause 99. The footwear upper component according to Clause 98, wherein the second thermoplastic sheet is formed from an at least partially transparent or translucent material such that the texturing present on at least a portion of the first major surface is visible through the second thermoplastic sheet.

Clause 100. The footwear upper component according to any one of Clauses 92 to 99, wherein the first surface of the first fabric element has a mesh structure.

Clause 101. The footwear upper component according to any one of Clauses 92 to 99, wherein the first surface of the first fabric element has a mesh structure with openings defined within a matrix formed by the first fabric element, and wherein the mesh structure and openings produce the surface contour features on the first major surface of the bladder component.

Clause 102. The footwear upper component according to any one of Clauses 92 to 101, wherein the first fabric element is a knit fabric element.

Clause 103. An article of footwear, comprising:

a footwear upper component according to any one of Clauses 92 to 102; and a sole structure engaged with the footwear upper component.

Clause 104. A method of forming a footwear upper component, comprising:

placing a bladder or a bladder precursor on a first fabric element, wherein the first fabric element includes a first surface having texturing, and wherein the bladder or the bladder precursor includes a first thermoplastic polymer layer and a second thermoplastic polymer layer overlapping the first thermoplastic polymer layer; and forming texturing on at least a portion of the first thermoplastic polymer layer by applying heat and pressure to form at least one of: (a) a seam that engages the first thermoplastic polymer layer with the second thermoplastic polymer layer and (ii) an engagement of at least the portion of the first thermoplastic polymer layer with the first fabric element, wherein the bladder or the bladder precursor defines a sealed interior chamber for containing a fluid, and wherein the texturing formed on the portion of the first thermoplastic polymer layer corresponds in surface contour features to the texturing included on the first surface of the first fabric element.

Clause 105. The method according to Clause 104, wherein the first thermoplastic polymer layer and the second thermoplastic polymer layer are formed as separate sheets.

Clause 106. The method according to Clause 104 or 105, wherein the portion of the first thermoplastic polymer layer on which the texturing is formed comprises at least a portion of the seam.

Clause 107. The method according to any one of Clauses 104 to 106, wherein the sealed interior chamber includes a first major exterior surface formed by the first thermoplastic polymer layer and a second major exterior surface formed by the second thermoplastic polymer layer, and wherein the portion of the first thermoplastic polymer layer on which the texturing is formed comprises at least a portion of the first major exterior surface.

Clause 108. The method according to Clause 107, wherein the step of forming the texturing forms texturing on at least a portion of the second major exterior surface.

Clause 109. The method according to any one of Clauses 104 to 106, wherein the sealed interior chamber includes a first major exterior surface formed by the first thermoplastic polymer layer and a second major exterior surface formed by the second thermoplastic polymer layer, and wherein the step of forming the texturing forms texturing on at least a portion of the second major exterior surface.

Clause 110. The method according to any one of Clauses 104 to 109, wherein the seam comprises an outer perimeter seam that completely surrounds the sealed interior chamber.

Clause 111. The method according to any one of Clauses 104 to 110, further comprising: engaging a second fabric element with the second thermoplastic polymer layer.

Clause 112. The method according to Clause 111, wherein the step of engaging the second fabric element with the second thermoplastic polymer layer takes place simultaneous with the step of applying heat and pressure to form the texturing on at least the portion of the first thermoplastic polymer layer.

Clause 113. The method according to any one of Clauses 104 to 112, wherein the step of forming the texturing further includes forming texturing on at least a portion of the second thermoplastic polymer layer by applying heat and pressure to the second thermoplastic polymer layer, and wherein the texturing formed on the portion of the second thermoplastic polymer layer corresponds in surface contour features to the texturing included on the first surface of the first fabric element.

Clause 114. The method according to any one of Clauses 104 to 113, wherein the second thermoplastic polymer layer is formed at least in part from an at least partially transparent or translucent material, and wherein the texturing present on at least a portion of the first thermoplastic polymer layer is visible through the second thermoplastic polymer layer.

Clause 115. The method according to any one of Clauses 104 to 114, further comprising: inflating the sealed interior chamber after the step of forming the texturing.

Clause 116. The method according to any one of Clauses 104 to 114, further comprising: inflating the sealed interior chamber before the step of forming the texturing.

Clause 117. The method according to any one of Clauses 104 to 116, wherein the first surface of the first fabric element has a mesh structure.

Clause 118. The method according to any one of Clauses 104 to 116, wherein the first surface of the first fabric element has a mesh structure with openings defined within a matrix formed by the first fabric element, and wherein the mesh structure and openings produce the surface contour features on the first thermoplastic polymer layer.

Clause 119. The method according to any one of Clauses 104 to 118, wherein the first fabric element is a knit fabric element.

Clause 120. A footwear upper component formed by the method according to any one of Clauses 104 to 119.

Clause 121. A method of making an article of footwear, comprising:

forming a footwear upper component using the method according to any one of Clauses 104 to 119; and engaging a sole structure with the footwear upper component.

Clause 122. An article of footwear formed by the method according to Clause 121.

Clause 123. A footwear upper component, comprising:

a first fabric element; and a bladder component that defines a sealed interior chamber for containing a fluid, wherein the bladder component includes: (a) a first major surface engaged with the first fabric element, wherein the first major surface defines at least part of a first perimeter seam surface and at least part of a first surface of the sealed interior chamber, (b) a second major surface opposite the first major surface, wherein the second major surface defines at least part of a second perimeter seam surface opposite the first perimeter seam surface and at least part of a second surface of the sealed interior chamber opposite the first surface of the sealed interior chamber, and (c) and a fluid chamber located between the first major surface and the second major surface, and wherein at least a portion of the second major surface includes molded-in texturing.

Clause 124. The footwear upper component according to Clause 123, wherein the molded-in texturing on the second major surface of the bladder component includes texturing on at least a portion of the second surface of the sealed interior chamber.

Clause 125. The footwear upper component according to Clause 123 or 124, wherein the molded-in texturing on the second major surface of the bladder component includes texturing on the second perimeter seam surface.

Clause 126. The footwear upper component according to any one of Clauses 123 to 125, wherein the first major surface of the bladder component is formed from a first thermoplastic sheet and the second major surface of the bladder component is formed from a second thermoplastic sheet.

Clause 127. The footwear upper component according to any one of Clauses 123 to 126, wherein the molded-in texturing includes a plurality of raised ridges.

Clause 128. The footwear upper component according to any one of Clauses 123 to 126, wherein the molded-in texturing includes a plurality of raised grid elements.

Clause 129. The footwear upper component according to any one of Clauses 123 to 126, wherein the molded-in texturing includes a plurality of recessed grid elements.

Clause 130. The footwear upper component according to any one of Clauses 123 to 126, wherein the molded-in texturing includes a herringbone pattern.

Clause 131. The footwear upper component according to any one of Clauses 123 to 126, wherein the molded-in texturing includes a plurality of rounded elements.

Clause 132. The footwear upper component according to any one of Clauses 123 to 126, wherein the molded-in texturing includes a first portion having a first pattern and a second portion having a second pattern different from the first pattern.

Clause 133. An article of footwear, comprising:

a footwear upper component according to any one of Clauses 123 to 132; and a sole structure engaged with the footwear upper component.

What is claimed is:

1. A footwear upper component, comprising:

a first fabric element that includes a first surface having texturing, wherein the first surface has a mesh structure with openings defined within a matrix formed by the first fabric element; and a bladder component that defines a sealed interior chamber for containing a fluid, wherein the bladder component includes: (a) a first major surface engaged with the first surface of the first fabric element, wherein the first major surface defines at least part of a first perimeter seam surface and at least part of a first surface of the sealed interior chamber, (b) a second major surface opposite the first major surface, wherein the second major surface defines at least part of a second perimeter seam surface opposite the first perimeter seam surface and at least part of a second surface of the sealed interior chamber opposite the first surface of the sealed interior chamber, and (c) and a fluid chamber located between the first major surface and the second major surface, wherein at least a portion of the first major surface includes texturing having surface contour features corresponding to the texturing present on the first surface of the first fabric element, and wherein the mesh structure and openings of the first surface of the first fabric element produce the surface contour features on the first major surface of the bladder component.

2. The footwear upper component according to claim 1, wherein the texturing on the first major surface of the bladder component includes texturing on the first surface of the sealed interior chamber.

3. The footwear upper component according to claim 1, wherein the texturing on the first major surface of the bladder component includes texturing on the first perimeter seam surface.

4. The footwear upper component according to claim 1, wherein at least a portion of the second major surface includes texturing corresponding to the texturing present on the first surface of the first fabric element.

5. The footwear upper component according to claim 4, wherein the texturing on the second major surface of the bladder component includes texturing on the second surface of the sealed interior chamber.

6. The footwear upper component according to claim 1, wherein the first major surface of the bladder component is formed from a first thermoplastic sheet and the second major surface of the bladder component is formed from a second thermoplastic sheet, and wherein the second thermoplastic sheet is formed from an at least partially transparent or translucent material such that the texturing present on at least a portion of the first major surface is visible through the second thermoplastic sheet.

7. A footwear upper component, comprising:

a first fabric element that includes a first surface having texturing, wherein the first surface has a mesh structure with openings defined within a matrix formed by the first fabric element; and a bladder component that defines a sealed interior chamber for containing a fluid, wherein the bladder component includes: (a) a first major surface engaged with the first fabric element, wherein the first major surface defines at least part of a first perimeter seam surface and at least part of a first surface of the sealed interior chamber, (b) a second major surface opposite the first major surface, wherein the second major surface defines at least part of a second perimeter seam surface opposite the first perimeter seam surface and at least part of a second surface of the sealed interior chamber opposite the first surface of the sealed interior chamber, and (c) and a fluid chamber located between the first major surface and the second major surface, wherein at least a portion of the second major surface includes molded-in texturing, and wherein the mesh structure and openings of the first surface of the first fabric element produce the molded-in texturing on the second major surface of the bladder component.

8. The footwear upper component according to claim 7, wherein the molded-in texturing on the second major surface of the bladder component includes texturing on at least a portion of the second surface of the sealed interior chamber.

9. The footwear upper component according to claim 7, wherein the molded-in texturing includes at least one member selected from the group consisting of: a plurality of raised grid elements; a plurality of recessed grid elements; and a first portion having a first pattern and a second portion having a second pattern different from the first pattern.

10. The footwear upper component according to claim 7, wherein the molded-in texturing on the second major surface of the bladder component includes texturing on the second perimeter seam surface.

11. The footwear upper component according to claim 7, wherein the first major surface of the bladder component is formed from a first thermoplastic sheet and the second major surface of the bladder component is formed from a second thermoplastic sheet.

12. The footwear upper component according to claim 7, wherein the first fabric element is a knit fabric element.

13. The footwear upper component according to claim 7, wherein the first major surface of the bladder component is engaged with the first fabric element by an adhesive free bond.

14. The footwear upper component according to claim 7, wherein the second major surface of the bladder component is exposed at an exterior of the footwear upper component.

15. The footwear upper component according to claim 7, wherein at least a portion of the first major surface includes texturing having surface contour features corresponding to the texturing present on the first surface of the first fabric element, wherein the second major surface of the bladder component is formed from a thermoplastic sheet, and wherein the thermoplastic sheet is formed from an at least partially transparent or translucent material such that the texturing present on at least a portion of the first major surface is visible through the thermoplastic sheet.

16. The footwear upper component according to claim 4, wherein the texturing on the second major surface of the bladder component includes texturing on the second perimeter seam surface.

17. The footwear upper component according to claim 1, wherein the first fabric element is a knit fabric element.

18. The footwear upper component according to claim 1, wherein the first major surface of the bladder component is engaged with the first fabric element by an adhesive free bond.

19. The footwear upper component according to claim 4, wherein the second major surface of the bladder component is exposed at an exterior of the footwear upper component.

20. The footwear upper component according to claim 1, wherein the second major surface of the bladder component is formed from a thermoplastic sheet, and wherein the thermoplastic sheet is formed from an at least partially transparent or translucent material such that the texturing present on at least a portion of the first major surface is visible through the thermoplastic sheet.

* * * * *